US009994355B2

(12) United States Patent
Ishikawa et al.

(10) Patent No.: US 9,994,355 B2
(45) Date of Patent: Jun. 12, 2018

(54) PACKING BOX AND BOX MANUFACTURING APPARATUS

(71) Applicant: Rengo Co., Ltd., Osaka (JP)

(72) Inventors: Atsuo Ishikawa, Tokyo (JP); Yoichi Nishikawa, Tokyo (JP); Takafumi Makiuchi, Kawaguchi (JP); Masanori Yoshida, Tokyo (JP); Hiroyuki Noguchi, Tokyo (JP); Hiromu Ikeda, Hyogo (JP)

(73) Assignee: RENGO CO., LTD., Osaka (JP)

( * ) Notice: Subject to any disclaimer, the term of this patent is extended or adjusted under 35 U.S.C. 154(b) by 164 days.

(21) Appl. No.: 15/125,842

(22) PCT Filed: Sep. 5, 2014

(86) PCT No.: PCT/JP2014/073561
§ 371 (c)(1),
(2) Date: Sep. 13, 2016

(87) PCT Pub. No.: WO2015/136741
PCT Pub. Date: Sep. 17, 2015

(65) Prior Publication Data

US 2017/0001752 A1 Jan. 5, 2017

(30) Foreign Application Priority Data

Mar. 14, 2014 (JP) ..... 2014-052354

(51) Int. Cl.
*B65D 5/44* (2006.01)
*B65D 5/00* (2006.01)
(Continued)

(52) U.S. Cl.
CPC ..... *B65D 5/443* (2013.01); *B31B 50/60* (2017.08); *B65D 5/001* (2013.01); *B65D 5/002* (2013.01);
(Continued)

(58) Field of Classification Search
CPC ..... B65D 5/443; B65D 5/001; B65D 5/002; B65D 5/4266; B65D 5/44; B65D 5/545;
(Continued)

(56) References Cited

U.S. PATENT DOCUMENTS 3,184,136 A * 5/1965 Forbes, Jr. ..... B65D 5/30 206/586
4,871,067 A 10/1989 Valenti
(Continued)

FOREIGN PATENT DOCUMENTS

EP 0076883 A1 4/1983
ES 2070675 A2 6/1995
(Continued)

OTHER PUBLICATIONS

European Patent Application No. 14885625.5; Partial Search Report; dated Nov. 22, 2017; 12 pages.

*Primary Examiner* — Corey Skurdal
(74) *Attorney, Agent, or Firm* — Baker & Hostetler LLP

(57) ABSTRACT

A packing box has a bottom panel, end panels raised from first edges of the bottom panel, side panels arranged adjacently to the end panels, edge panels connected to side edges of the end panels via outer panel fold lines, fold-back panels arranged on inner side surfaces of the edge panels, inner panels arranged on inner side surfaces of the end panels, and reinforcing panels continuously formed with the fold-back panels via first fold lines and the inner panels via second fold lines. The reinforcing panel 16 is formed in an inwardly projecting manner between the fold-back panel and the inner panel. Any of the first and second fold lines positioned on a side closer to the outer panel fold line than a projecting top portion is arranged away from the outer panel fold line by a distance.

15 Claims, 40 Drawing Sheets

(51) Int. Cl.

| | |
|---|---|
| ***B65D 5/42*** | (2006.01) |
| ***B65D 5/54*** | (2006.01) |
| ***B65D 5/64*** | (2006.01) |
| ***B31B 50/60*** | (2017.01) |
| *B31B 50/46* | (2017.01) |
| *B31B 50/81* | (2017.01) |
| *B31B 100/00* | (2017.01) |
| *B31B 50/62* | (2017.01) |
| *B31B 120/00* | (2017.01) |

(52) U.S. Cl.
CPC ..... *B65D 5/4266* (2013.01); *B65D 5/44* (2013.01); *B65D 5/545* (2013.01); *B65D 5/64* (2013.01); *B31B 50/46* (2017.08); *B31B 50/624* (2017.08); *B31B 50/81* (2017.08); *B31B 2100/00* (2017.08); *B31B 2120/502* (2017.08)

(58) Field of Classification Search
CPC ..... B65D 5/64; B31B 50/60; B31B 50/624; B31B 2100/00; B31B 50/46; B31B 50/81; B31B 2120/502
See application file for complete search history.

(56) References Cited

U.S. PATENT DOCUMENTS

| | | | | |
|---|---|---|---|---|
| 5,285,956 | A * | 2/1994 | Piepho | B65D 5/002 229/191 |
| 5,588,585 | A * | 12/1996 | McClure | B65D 5/002 229/149 |
| 5,996,885 | A * | 12/1999 | Chu | B65D 5/0035 229/179 |
| 6,675,970 | B1 * | 1/2004 | Nemoto | B65D 5/5021 206/521 |
| 6,676,012 | B1 * | 1/2004 | Southwell | B65D 5/002 229/120.17 |
| 7,121,453 | B2 * | 10/2006 | Nass | B65D 5/0045 229/177 |
| 8,087,569 | B2 * | 1/2012 | Ledvina | B65D 5/443 229/108 |

FOREIGN PATENT DOCUMENTS

| | | | |
|---|---|---|---|
| GB | 2148254 | A | 5/1985 |
| GB | 2196608 | A | 5/1988 |
| JP | 01-094229 | A | 6/1989 |
| JP | 01-254541 | A | 10/1989 |
| JP | H04-049061 | A | 11/1992 |
| JP | 09-272525 | A | 10/1997 |
| JP | 2000-185767 | A | 7/2000 |
| WO | WO 2010/096536 | A2 | 8/2010 |

* cited by examiner

PACKING BOX AND BOX MANUFACTURING APPARATUS

CROSS-REFERENCE TO RELATED APPLICATIONS

This is a national phase application in the United States of International Patent Application No. PCT/JP2014/073561, with an international filing date of Sep. 5, 2014, which claims priority of Japanese Patent Application No. 2014-052354, filed on Mar. 14, 2014, the entire contents of which are incorporated herein by reference

TECHNICAL FIELD

The present disclosure relates to a packing box and a box manufacturing apparatus.

BACKGROUND ART

It is often the case where a packing box which stores products therein is arranged in a stacked state during transportation or after the packing box is transported to a sales shop. U.S. Pat. No. 4,871,067 discloses a packing box where a reinforcing panel extending from a bottom panel to a ceiling panel is provided to corner portions of an outer peripheral panel, and such a packing box has high strength against pressure suitable for stacking. The packing box includes: a bottom panel; end panels connected to both ends of the bottom panel; and side panels connected to both sides of the bottom panel. Edge panels adhered to inner side surfaces of the side panel are connected to both sides of end panels, and the reinforcing panels are connected to the edge panels. Inner panels adhered to inner side surfaces of the end panels are connected to the reinforcing panels.

In the case of this packing box, at the time of assembling the packing box, it is necessary to adhere two or more kinds of panels to each other using an adhesive agent (hotmelt) made of a hot-melt resin, an adhesive agent made of a vinyl acetate emulsion or the like and hence, assembling operability is poor. To be more specific, the end panels and the side panels are folded against the bottom panel, and the edge panels are folded against the end panels and are arranged on the inner side surfaces of the side panels. The reinforcing panels and the inner panels are folded against the edge panels, and the inner panels are arranged on the inner side surfaces of the end panels. It is necessary to adhere the side panels to the edge panels and to adhere the inner panels to the end panels while maintaining such a folded state. Accordingly, the assembling operability is poor.

In view of the above, there has been a demand for the improvement of assembling operability while maintaining high strength against pressure from product manufacturers of products. A case is considered where a cumbersome assembling operation is performed by a box manufacturer, and packing boxes in an assembled state are supplied to a product manufacturer. In this case, however, the number of packing boxes which can be transported to the product manufacturer from the box manufacturer becomes small. Further, it is necessary for the product manufacturer to ensure a large storage space for storing unused packing boxes and hence, a cost is pushed up.

SUMMARY

Problems to be Solved

It is an object of the present invention disclosure to improve an assembling operability of a packing box having a reinforcing panel for enhancing strength against pressure. It is another object of the present disclosure to provide a box manufacturing apparatus which can automatically assemble a packing box having a reinforcing panel.

Means for Solving the Problems

In order to address one or more of the above-problems, a packing box may be provided. In one aspect, a packing box may comprise a bottom panel, end panels raised from first edges of the bottom panel, side panels raised from second edges of the bottom panel extending in a direction which intersects with the first edges, the side panels arranged adjacently to the end panels, edge panels connected to side edges of the end panels via outer panel fold lines, and fixed to inner side surfaces of the side panels arranged adjacently to the edge panels, fold-back panels arranged on inner side surfaces of the edge panels, inner panels arranged on inner side surfaces of the end panels; and reinforcing panels continuously formed with the fold-back panels via first fold lines, and continuously formed with the inner panels via second fold lines, each reinforcing panel being formed in an inwardly projecting manner between the fold-back panel and the inner panel, wherein any of the first fold line and the second fold line positioned on a side closer to the outer panel fold line than a projecting top portion is arranged away from the outer panel fold line by a distance.

In this packing box, the reinforcing panel projects inwardly from an end panel side or a side panel side at a corner portion formed between the end panel and the side panel and hence, compressive strength of the packing box in an assembled state can be enhanced with certainty. Further, the first or second fold line is offset from the outer panel fold line and hence, in a state before the edge panel is adhered to the side panel, the fold-back panel, the reinforcing panel and the inner panel can be brought into a state where the fold-back panel, the reinforcing panel and the inner panel flatly overlap with the end panels and the edge panels. By transporting and storing the packing box in such a state, a large occupation space is not required. In assembling the packing box, the end panels and the side panels are folded against the bottom panel and the edge panels are folded against the end panels. Then, the packing box can be assembled by merely arranging and fixing the edge panels on and to the inner side surfaces of the side panels. That is, it is not necessary to perform fixing of the panels at two or more portions in a state where the respective panels are held in a folded state and hence, assembling operability can be enhanced.

The inner panel is fixed to the end panel, the first fold line positioned on a side closer to the outer panel fold line than the projecting top portion is arranged away from the outer panel fold line by a distance, and the reinforcing panel is projected inward from an end panel side. The reinforcing panel projects in a triangular shape as viewed in a plan view and hence, the packing box can acquire high compressive strength compared to a packing box which is reinforced by lamination of panels. When the reinforcing panel is configured to project from a side panel side, the side panel side has the two layered structure where the edge panel overlaps with an inner surface side of the side panel, and the reinforcing panel projects from the inner surface side of the edge panel. An end panel side has the two layered structure where the inner panel overlaps with an inner surface side of the end panel. Accordingly, compressive strength of the packing box on the side panel side can be enhanced. On the other hand, when the reinforcing panel is configured to project from the end panel side, the side panel side has the three layered structure where the edge panel and the fold-back panel overlap with the inner surface side of the side panel. On the end panel side, the reinforcing panel projects from an inner surface side of the end panel formed of a single layer. With such a configuration, the whole side panels and the whole end panels can be uniformly reinforced.

It is preferable that a third fold line extending parallel to the first and second fold lines be formed between the first and second fold lines of the reinforcing panel. With such a configuration, it is possible to make the reinforcing panel project from the end panel or the side panel with certainty such that the third fold line forms a top portion. It is preferable that the packing box be made of a paper-made corrugated board sheet, and a stage collapsed portion where a panel thickness of the paper-made corrugated board sheet is reduced by compression be formed on the reinforcing panel such that the stage collapsed portion has a predetermined width so as to include the third fold line in the stage collapsed portion. With such a configuration, rigidity (stiffness) of the paper-made corrugated board sheet can be lowered due to the provision of the stage collapsed portion and hence, it is possible to make the reinforcing panel project with certainty such that the third fold line forms the top portion.

It is preferable that the fold-back panel be fixed to the inner side surface of the edge panel. With such a configuration, it is possible to make the reinforcing panel project with certainty by folding the edge panel. Further, it is preferable that the fold-back panel, the reinforcing panel and the inner panel be integrally formed with the edge panel. With such a configuration, the number of parts of the blank for forming the packing box can be reduced and hence, a cost can be reduced.

The blank for forming the packing box includes: the bottom panel; the end panels connected to end edges of the bottom panel; the side panels continuously formed with side edges of the bottom panel; the edge panels connected to side edges of the end panels; the fold-back panels connected to side edges of the edge panels; the reinforcing panels connected to side edges of the fold-back panels; and the inner panels connected to side edges of the reinforcing panels. The packing box is assembled such that the fold-back panels are folded against the edge panels, the inner panels continuously formed with the fold-back panels are fixed to the end panels and, thereafter, the edge panels are folded against the end panels so as to fold the reinforcing panels along the first and second fold lines disposed on both sides of the reinforcing panels thus making the reinforcing panel project inwardly and, then, the end panels are folded against the bottom panel and, thereafter, the side edges are folded against the bottom panel, and the edge panels and the side panels are fixed to each other.

The packing box assembled in such a manner may be delivered to a product manufacturer in a state where the fold-back panels are folded against the edge panels and the inner panels are fixed to the end panels. However, the delivery of the packing box is not limited to such a method, and the packing box may be automatically assembled by a box manufacturing apparatus at the product manufacturer. In this case, a box manufacturer can deliver the packing box to the product manufacturer in a form of a blank punched out from a corrugated board sheet and hence, a cost can be further reduced.

A box manufacturing apparatus for automatically manufacturing the packing box comprises a first coating part which applies by coating an adhesive agent to the inner panel or a portion of the end panel to which the inner panel overlaps, a fixing part which folds the fold-back panel against the edge panel, and fixes the inner panel continuously formed with the fold-back panel to the end panel, a second coating part which applies by coating an adhesive agent to the edge panel or a portion of the side panel to which the edge panel overlaps, and a forming part which folds the edge panel against the end panel, bends the first and second fold lines on both sides of the reinforcing panel thus making the reinforcing panel project inwardly, and folds the end panel against the bottom panel and, thereafter, folds the side panel against the bottom panel, and fixes the edge panel and the side panel to each other.

As described above, the reinforcing panel which projects inward in an assembled state may be fixed such that the reinforcing panel flatly overlaps with the end panel or the edge panel. Accordingly, the box manufacturing apparatus is not required to perform a complicated folding working and hence, the configuration of the box manufacturing apparatus can be simplified.

The forming part includes a forming plate which is arranged in the vicinity of the first fold line, and guides the reinforcing panel such that the reinforcing panel is folded against the fold-back panel along the first fold line in folding the edge panel against the end panel. With such a configuration, the reinforcing panel can be folded with certainty against the fold-back panel along the first fold line positioned with a distance from the outer panel fold line disposed between the end panel and the edge panel.

To be more specific, the forming part includes: an upper die which is configured to make the forming plate slidable to a reinforcing panel side from a fold-back panel side; and a lower die which is arranged in front of the upper die in an advancing direction of the upper die, and is configured to guide folding of the edge panel against the end panel. The box manufacturing apparatus further includes a biasing member which biases the forming plate to the fold-back panel side from the reinforcing panel side. With such a configuration, the forming plate can follow the first fold line which moves along the folding of the edge panel against the end panel and hence, the folding of the edge panel against the end panel at a different position can be prevented with certainty.

The forming part includes: a male die which is configured to move a blank for forming the packing box downward by pressing the bottom panel from above; and a female die which is arranged below the lower die, and is configured to fold the end panel and the side panel against the bottom panel due to the movement of the blank by the male die. With such a configuration, after the edge panel is folded against the end panel, the end panel and the side panel can be folded with certainty against the bottom panel.

The fixing part includes: a folding member which folds the fold-back panel against the edge panel; and a pressing member which presses at least the inner panel to the end panel. With such a configuration, the fold-back panel, the reinforcing panel and the inner panel can be adhered (fixed) to the edge panel and the end panel such that the fold-back panel, the reinforcing panel and the inner panel flatly overlap with the edge panel and the end panel.

The fixing part further includes a positioning member for positioning an area in the vicinity of a fold line between the edge panel and the fold-back panel. It is preferable that the positioning member release such positioning at the time of pressing the fold-back panel and the inner panel by the pressing member. With such a configuration, at the time of folding the fold-back panel by the folding member, it is possible to fold the fold-back panel with certainty along the outer panel fold line disposed between the fold-back panel and the edge panel.

The folding member is configured to fold the fold-back panel against the edge, panel through a first folding step where the folding member is moved upward from below the fold-back panel thus folding the fold-back panel upward against the edge panel, a second folding step where the folding member is moved inward toward an end panel side thus folding the fold-back panel inward against the edge panel, and a third folding step where the folding member is moved downward thus making the fold-back panel overlap with the edge panel. With such a configuration, the fold-back panel can be folded such that where the fold-back panel overlaps with the edge panel using one folding member.

The box manufacturing apparatus further includes a temporarily folding part which is disposed in front of a first coating part, and is configured to impart a folding habit to the reinforcing panel by folding the reinforcing panel along a third fold line provided between the first and second fold lines. With such a configuration, in folding the edge panel against the end panel using the forming part in a succeeding step, it is possible to make the reinforcing panel project inwardly with certainty such that the third fold line forms a top portion.

Effect of the Disclosure

The packing box of the present disclosure includes the reinforcing panel which projects inward and hence, compressive strength of the packing box can be enhanced with certainty. The packing box is configured such that the first or second fold lines disposed on both sides of the reinforcing panel are offset from the outer panel fold line disposed between the end panel and the edge panel and, in a state before the packing box is assembled (folded), the reinforcing panel flatly overlaps with the end panel or the edge panel and hence, it is possible to reduce an occupation space at the time of transporting and storing the packing box. At the time of assembling the packing box, the packing box can be assembled by merely folding the end panel, the side panel and the edge panel and by fixing the side panel and the edge panel to each other and hence, operability can be enhanced.

It is sufficient for the packing box that the reinforcing panel is folded such that the reinforcing panel overlaps with the end panel or the edge panel and hence, it is unnecessary to perform complicated folding working at the time of assembling the packing box. Accordingly, it is possible to assemble the packing box by a box manufacturing apparatus which automatically manufactures the packing box from a blank punched out from a corrugated board sheet. As a result, a box manufacturer can deliver the packing box in a form of a flat blank and hence, a cost of the packing box can be further reduced.

DETAILED DESCRIPTION

Hereinafter, embodiments of the present disclosure are described with reference to drawings. In the description made hereinafter, terms indicating particular directions or positions (terms including "up", "down", "side", "end", "top" or "bottom", for example) are used when necessary. However, these terms are used for facilitating the understanding of the disclosure with reference to drawings, and a technical scope of the present disclosure is not limited by the meaning of these terms.

First Embodiment

Figure 1:
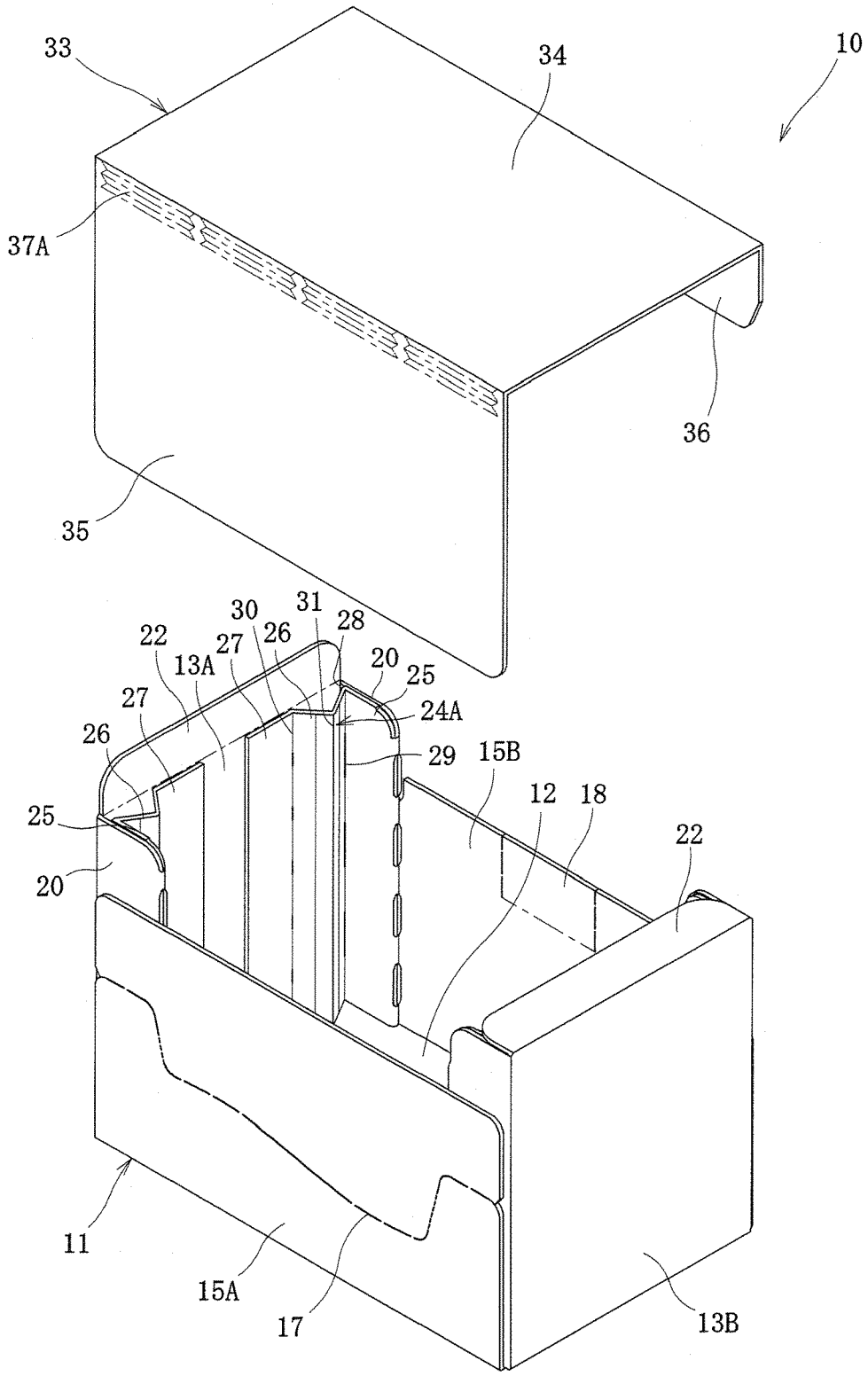
FIG. 1 is a perspective view showing a packing box according to a first embodiment of the present invention.

FIG. 1 shows a packing box 10 according to a first embodiment of the present invention. The packing box 10 includes: a box body 11; and a lid body 33 which closes an upper end opening of the box body 11. The box body 11 includes reinforcing panels 26 extending in a height (vertical) direction on both sides of individual end panels 13A, 13B. In this embodiment, the reinforcing panels 26 are in a flat overlapping state when the box body 11 is in an unused state, and the reinforcing panels 26 project inward in a state where the box body 11 is assembled by folding. The number of portions of the box body 11 to be adhered (fixed) by an adhesive agent in assembling the box body 11 is reduced and hence, assembling operability is enhanced.

Figure 2:
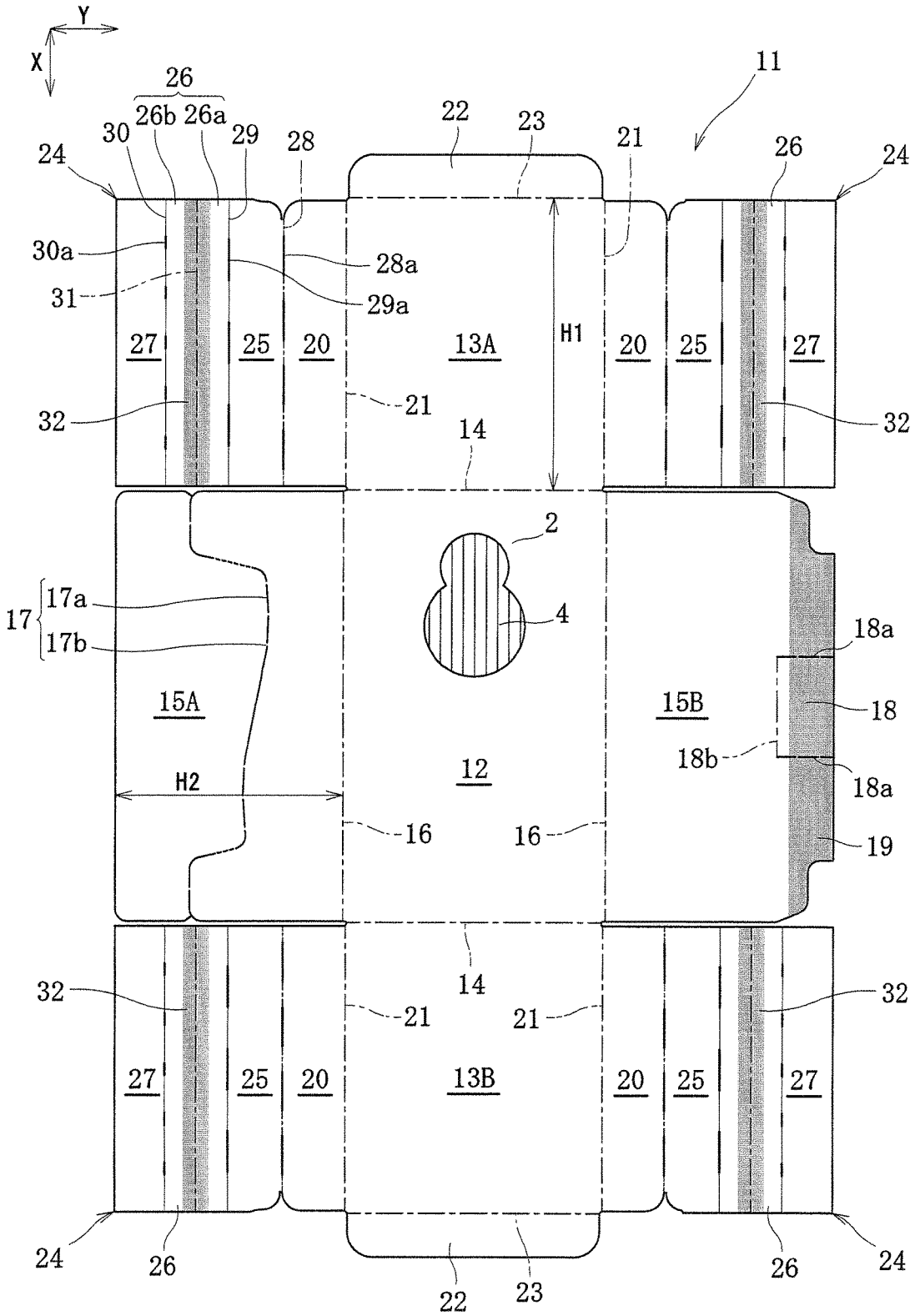
FIG. 2 is a plan view showing a blank for forming a box body.
Figure 3:
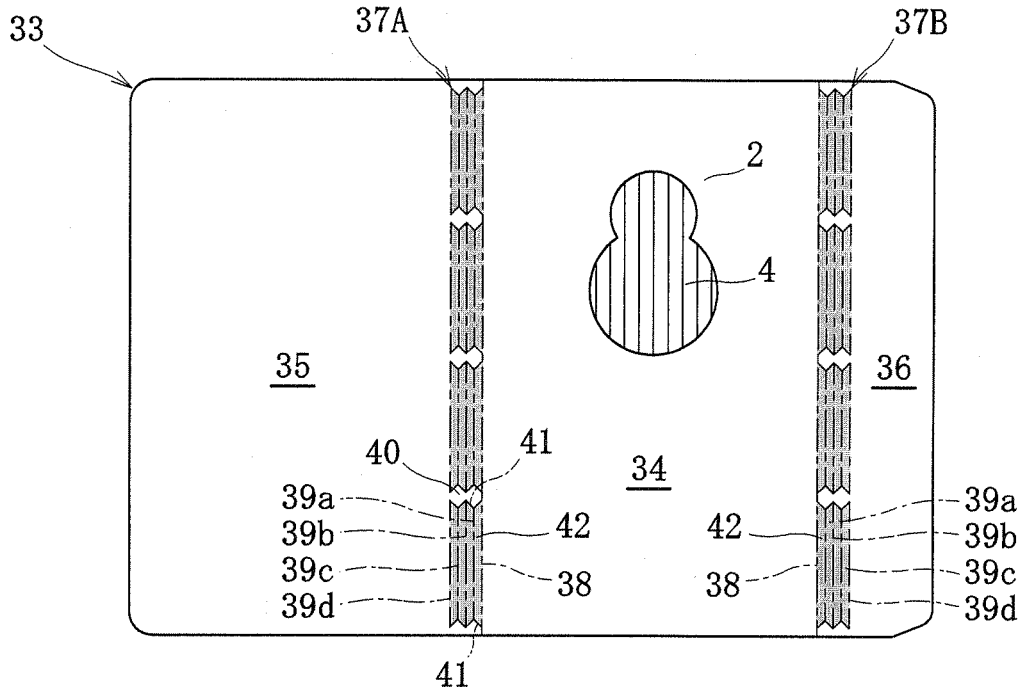
FIG. 3 is a plan view showing a blank for forming a lid body.
Figure 4A:
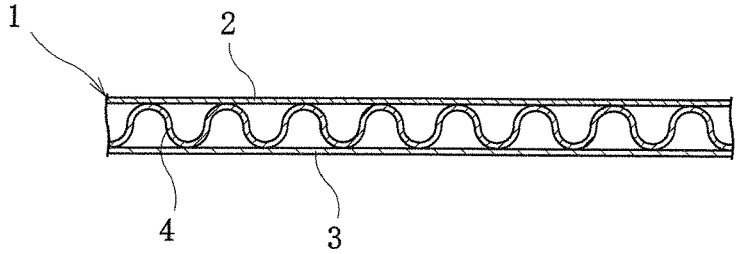
FIG. 4A is a cross-sectional view of a corrugated board sheet.

The box body 11 and the lid body 33 are formed such that one blank shown in FIG. 2 and one blank shown in FIG. 3 are punched out from a paper-made corrugated board sheet 1 by a known paper punching device, and predetermined portions of these blanks are folded and adhered. As shown in FIG. 4A, the corrugated board sheet 1 has a corrugated-shaped intermediate core 4 between a front liner 2 and a back liner 3. A cut face shown in FIG. 4A where the intermediate core 4 has a corrugated shape is referred to as "stage", and a direction along which the intermediate core 4 extends, that is, the direction perpendicular to a surface of the paper on which FIG. 4A is drawn is referred to as a stage direction.

Figure 4B:
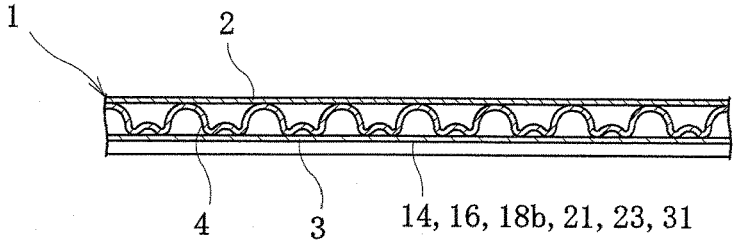
FIG. 4B is a cross-sectional view of a corrugated board sheet on which a general score line is formed.
Figure 4C:
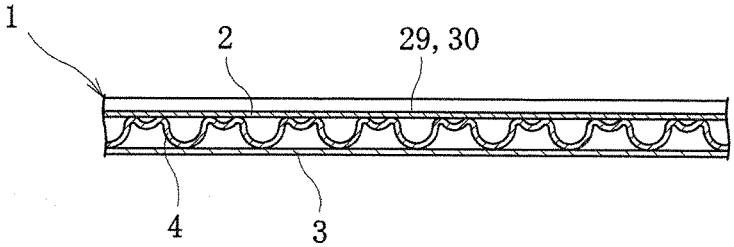
FIG. 4C is a cross-sectional view of a corrugated board sheet on which an inverted score line is formed.
Figure 4D:
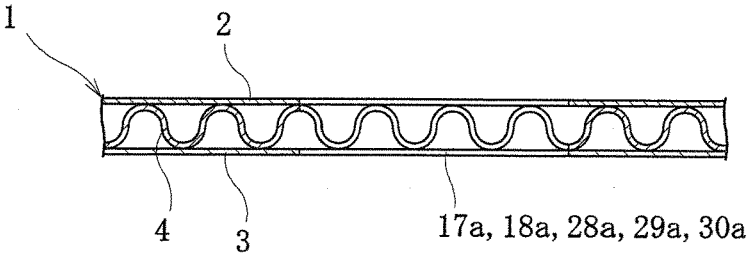
FIG. 4D is a cross-sectional view of a corrugated board sheet on which a cut line is formed.
Figure 4E:
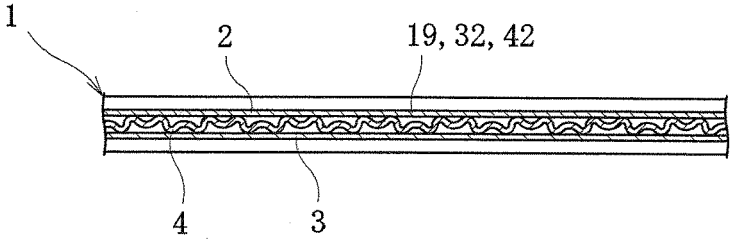
FIG. 4E is a cross-sectional view of a corrugated board sheet on which a stage collapsed portion is formed.

A chain line shown in FIG. 2 and FIG. 3 indicates, as shown in FIG. 4B, general score lines which are formed by forming scores from a back liner 3 side so as to reduce a panel thickness of the corrugated board sheet 1 by compression. A fine line indicates, as shown in FIG. 4C, inverted score lines which are formed by forming scores from a front liner 2 side so as to reduce the panel thickness of the corrugated board sheet 1 by compression. A bold line described in the blank indicates, as shown in FIG. 4D, a cut line formed by cutting the corrugated board sheet 1 from the front liner 2 to the back liner 3. Thin black portions are, as shown in FIG. 4E, stage collapsed regions where the intermediate core 4 is collapsed by compressing the corrugated board sheet 1 from both sides of the front liner 2 and the hack liner 3 thus decreasing a panel thickness of the corrugated board sheet 1.

As shown in FIG. 2, a blank for forming the box body 11 has a bottom panel 12 having a rectangular shape at the center thereof. End panels 13A, 13B are connected to short sides of the bottom panel 12 respectively, and side panels 15A, 15B are connected to long sides of the bottom panel 12 which extend in the direction perpendicular to the short sides respectively. To be more specific, the pair of end panels 13A, 13B is connected to end edges (first edges) of the bottom panel 12 disposed opposite to each other in the up-and-down direction in FIG. 2 via fold lines 14 formed of a general score line. A pair of side panels 15A, 15B is connected to side edges (second edges) of the bottom panel 12 disposed opposite to each other in the lateral direction in FIG. 2 via fold lines 16 formed of a general score line. The blank for forming the box body 11 is punched out from the corrugated board sheet 1 such that the stage direction extends along an X direction which extends between the end panels 13A, 13B disposed on both ends of the bottom panel 12. By punching out the blank as described above, in a state where the box body 11 is assembled, the extending direction of the end panels 13A, 13B and the extending direction of the reinforcing panels 26 are set as the stage direction so that compressive strength of the box body 11 is enhanced.

The end panels 13A, 13B have a rectangular shape where sides in the height direction which is the up-and-down direction in FIG. 2 are long sides of the rectangular shape. The end panels 13A, 13B are raised from end edges of the bottom panel 12 in an assembled state. The side panels 15A, 15B have a rectangular shape, and long sides of the side panels 15A, 15B extend in a width (lateral) direction which is the direction extending between upper and lower sides of FIG. 2. The side panels 15A, 15B are raised from the side edges of the bottom panel 12 in an assembled state. In this embodiment, a height H2 of the side panels 15A, 15B is set lower than a height H1 of the end panels 13A, 13B.

A design cut line 17 having cut portions 17*a* and uncut portions (continuous portions) 17*b* which are arranged in an alternating interspersed manner is formed on the side panel 15A such that the design cut line 17 extends in the width direction in an assembled state. By breaking the uncut portions 17*b* of the design cut line 17, an upper portion (left side in FIG. 2) of the side panel 15A is separated from the side panel 15A. A pair of cut lines 18*a*, 18*a* which extends parallel to each other with a predetermined distance therebetween and a fold line 18*b* formed of a general score line which connects end portions of the cut lines 18*a*, 18*a* to each other are formed on a center portion of an upper end of the side panel 15B. A manipulation opening forming portion 18 for holding an edge of the lid body 33 in an assembled state is formed of a portion defined by these cut lines 18*a*, 18*a* and the fold line 18*b*. A stage collapsed portion 19 where the intermediate core 4 is collapsed is formed on an upper region (a thin black region on a right side in FIG. 2) of the side panel 15B in an assembled state. The stage collapsed portion 19 is positioned on a side closer to a distal end side of the side panel 15B than the fold line 18*b* of the manipulation opening forming portion 18.

The edge panels 20 are connected to side edges of the end panels 13A, 13B respectively via fold lines (outer panel fold lines) 21 formed of a general score line. The edge panels 20 are adhered to inner side surfaces of the side panels 15A, 15B arranged adjacently to the edge panels 20 in an assembled state. The edge panels 20 have a rectangular shape having long sides thereof extending in the height direction thereof, and the edge panels 20 extend from lower ends (bottom panel 12 side) of the end panels 13A, 13B to upper ends (distal end side) of the end panels 13A, 13B. Adhesion panels 22 to which the lid body 33 is adhered are connected to edges of the end panels 13A, 13B on distal end sides via fold lines 23 formed of a general score line.

Reinforcing column forming portions 24 for forming reinforcing columns 24A extending in the height direction from the bottom panel 12 to the adhesion panel 22 in an assembled state are integrally formed with the side edges of the edge panels 20. The reinforcing column forming portion 24 includes: a fold-back panel 25 connected to the edge panel 20; a reinforcing panel 26 connected to the fold-back panel 25; and an inner panel 27 connected to the reinforcing panel 26.

The fold-back panel 25 has a rectangular shape, and a lateral width of the fold-back panel 25 is set smaller than a lateral width of the edge panel 20. The reinforcing panel 26 has a rectangular shape, and a lateral width of the reinforcing panel 26 obtained by combining a lateral width of the reinforcing panel 26 and the lateral width of the fold-back panel 25 is set larger than a lateral width of the edge panel 20. The inner panel 27 has a rectangular shape, and a internal width obtained by combining the lateral width of the fold-back panel 25 and the lateral width of the reinforcing panel 26 is set smaller than a size obtained by combining the lateral width of the edge panel 20 and half of a lateral width of the end panel 13A, 13B.

A fold line 28 for enhancing foldability is formed between the edge panel 20 and the fold-back panel 25. First and second fold lines 29, 30 are formed on both sides of the reinforcing panel 26. To be more specific, the fold line (first fold line) 29 which guides the inward folding of the reinforcing panel 26 is formed between the fold-back panel 25 and the reinforcing panel 26. The fold line (second fold line) 30 which guides the inward folding of the reinforcing panel 26 is formed between the reinforcing panel 26 and the inner panel 27.

The fold line 28 is formed of a lead score where a plurality of cut lines 28*a* are formed on a general score line at predetermined intervals. The fold line 29 is formed of a lead score where a plurality of cut lines 29*a* are formed on an inverted score line at predetermined intervals. In the same manner, the fold line 30 is formed of a lead score where a plurality of cut lines 30*a* are formed on an inverted score line at predetermined intervals. Out of these fold lines, the fold line 28 is formed such that an amount of the fold line 28 covering more than half of a total length of the fold line 28 is formed of cut lines 28*a*. The fold line 29 is formed such that an amount of the fold line 29 covering less than a half of a total length of the fold line 29 is formed of cut lines 29*a*. To be more specific, although a length of the cut line 29*a* of the fold line 29 is set longer than a length of the cut line 28*a* of the fold line 28, a total length (total cut length) of all cut lines 29*a* is shorter than a total length of the cut lines 28*a*. A length of the cut line 30*a* of the fold line 30 is set shorter than a length of the cut line 29*a* of the fold line 29, and a total length of all cut lines 30*a* is also set shorter than the total length of the cut lines 29*a*.

Figure 5:
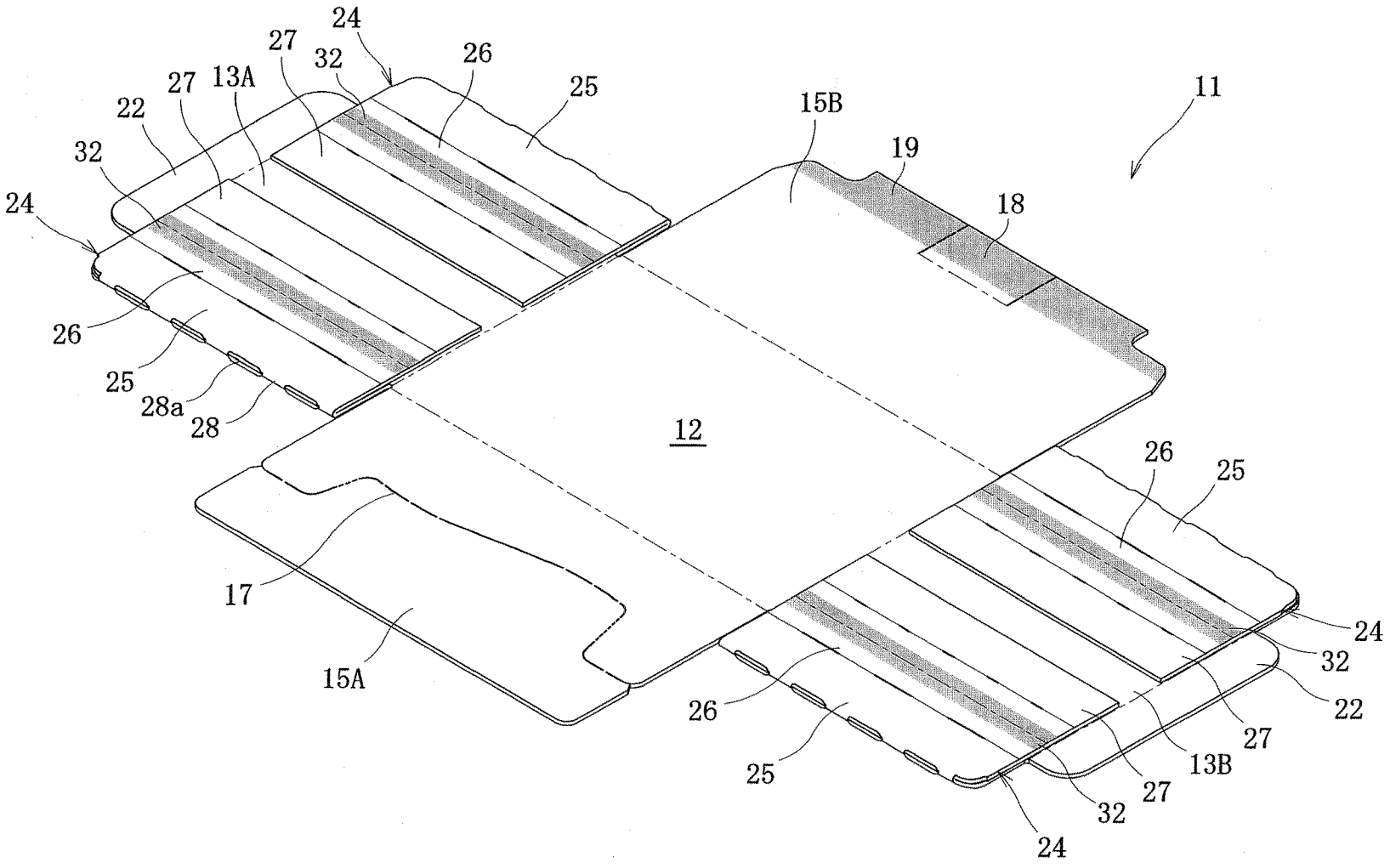
FIG. 5 is a perspective view showing the box body before the box body is assembled.
Figure 6A:
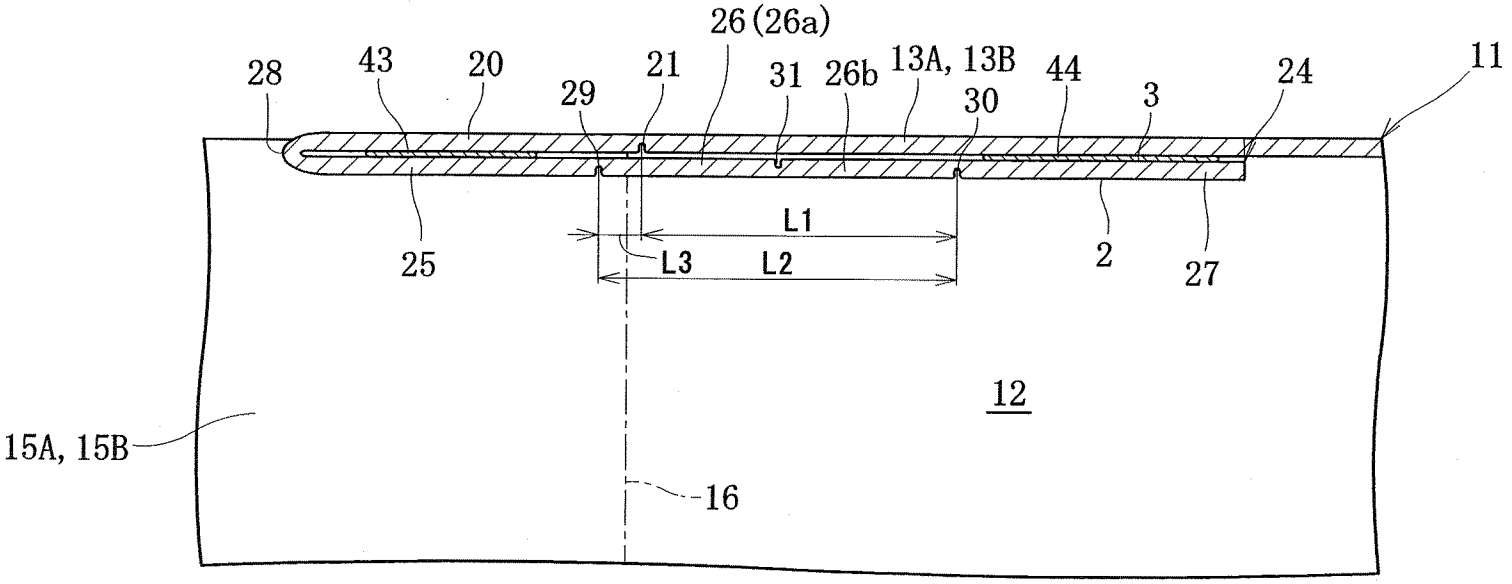
FIG. 6A is a cross-sectional view showing a reinforcing panel of the box body before the box body is assembled.

As shown in FIG. 5 and FIG. 6A, the reinforcing column forming portions 24 defined by the fold lines 28 to 30 are folded back such that each fold-back panel 25 overlaps with an inner surface side of the edge panel 20 along the fold line 28 at the time of assembling the reinforcing column forming portion 24. Then, the fold-back panels 25 are adhered (fixed) to the edge panels 20 by an adhesive agent. Accordingly, the inner panels 27 are arranged so as to overlap with inner side surfaces of the end panels 13A, 13B, and are adhered to the end panels 13A, 13B by an adhesive agent. The reinforcing panels 26 are adhered to neither of the end panels 13A, 13B nor the edge panels 20 so that the reinforcing panels 26 are freely deformed. In a state where the edge panels 20 are flatly developed with respect to the end panels 13A, 13B, the reinforcing panels 26 flatly overlap with the end panels 13A, 13B.

In such a state, each fold line 29 disposed between the fold-back panel 25 and the reinforcing panel 26 is positioned on the edge panel 20. Each fold line 30 disposed between the reinforcing panel 26 and the inner panel 27 is positioned on the end panel 13A, 13B. Assuming the fold line 30 as a reference point, each fold line 21 disposed on an edge of the end panel 13A, 13B is positioned away from the fold line 30 with a distance L1. The fold line 29 is positioned away from the fold line 30 with a distance L2. With respect to these distances L1, L2, the distance L2 is longer than the distance L1. That is, the fold line 29 is offset from the fold line 21 by a distance L3.

Figure 6B:
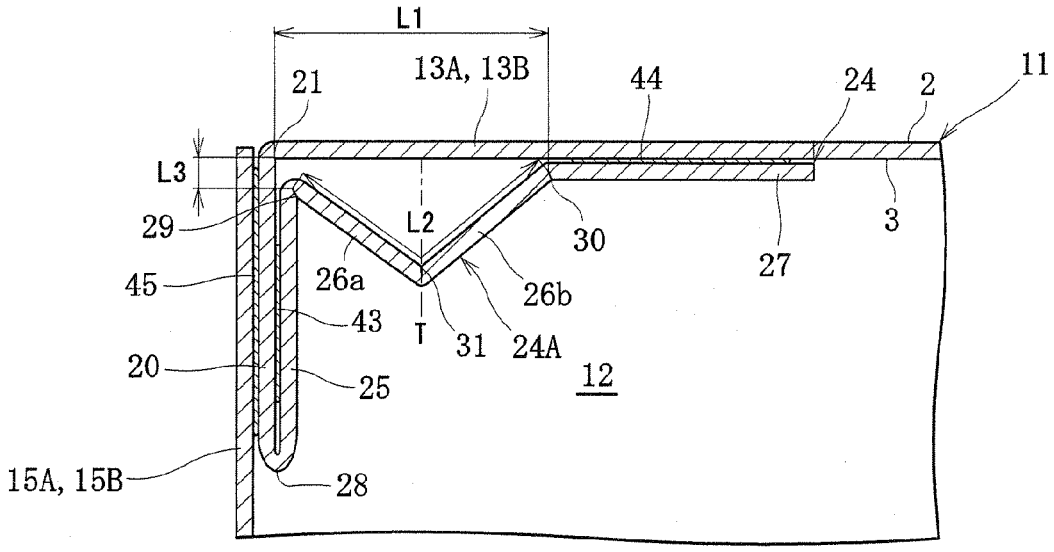
FIG. 6B is a cross-sectional view showing the reinforcing panel of the box body in an assembled state.

As shown in FIG. 1 and FIG. 6B, the fold line 29 is offset from the fold line 21 by the distance L3 and hence, when the edge panel 20 is folded against the end panel 13A, 13B along the fold line 21, the reinforcing panel 26 inwardly projects such that a fold line 31 described later forms a projecting top portion T. Also in a state where the reinforcing panel 26 is assembled, out of the fold lines 29, 30 disposed on both sides of the reinforcing panel 26, the fold line 29 positioned on a side closer to the fold line 21 side than the projecting top portion T is arranged away from the fold line 21 by the distance L3.

As shown in FIG. 2, in this embodiment, the fold line (third fold line) 31 formed of a general score line extending parallel to the fold lines 29, 30 is provided to the reinforcing panel 26 at a position between the fold lines 29, 30, that is, at a center portion of the reinforcing panel 26 in the width (Y) direction. The reinforcing panel 26 is divided into a first panel portion 26*a* positioned on a fold-back panel 25 side and a second panel portion 26*b* positioned on an inner panel 27 side by such a fold line 31. A stage collapsed portion 32 where the intermediate core 4 is collapsed by decreasing a panel thickness of the corrugated board sheet 1 by compression is provided to an intermediate region of each reinforcing panel 26 having a predetermined width within which the fold line 31 is included and tinted with thin black such that the intermediate region extends in the height direction. With such a configuration, in an assembled state, rigidity (stiffness) of the corrugated board sheet 1 is lowered in a region of the reinforcing panel 26 to which the stage collapsed portion 32 is provided. Accordingly, the reinforcing panel 26 projects from the end panel 13A, 13B in a triangular shape as viewed in a plan view such that a portion where the fold line 31 is formed forms a top portion.

As shown in FIG. 3, the lid body 33 is formed of a sheet having a rectangular shape. The lid body 33 is adhered to the assembled box body 11 such that the lid body 33 covers the assembled box body 11 and extends over the side panels 15A, 15B disposed on both sides of the box body 11. The lid body 33 includes: a lid main body 34 positioned at an intermediate portion in the lateral direction in FIG. 3; a first adhesion portion 35 to be adhered to a side panel 15A side; and a second adhesion portion 36 to be adhered to a side panel 15B side. The lid body 33 is punched out from the corrugated board sheet 1 such that the stage direction extends in a direction orthogonal to a direction extending between the adhesion portions 35, 36 disposed on both sides of the lid main body 34. By forming the lid body 33 as described above, it is possible to enhance operability of the lid body 33 at the time of peeling off the lid body 33 while holding edges of the adhesion portions 35, 36 in an assembled state.

The lid main body 34 is adhered to the adhesion panels 22 of the box body 11 by an adhesive agent at the time of assembling (packing) at a product manufacturer. The lid main body 34 is formed such that a width of the lid main body 34 in the up-and-down direction in FIG. 3 is set equal to a size between the end panels 13A, 13B in a state where the box body 11 is assembled. The first adhesion portion 35 is adhered to an outer side surface of the side panel 15A on a side closer to a distal end of the side panel 15A than the design cut line 17. The first adhesion portion 35 is formed with a size which allows the first adhesion portion 35 to cover the design cut line 17 formed on the side panel 15A in a state where the packing box 10 is assembled. A distal end portion of the second adhesion portion 36 is adhered to an outer side surface of the side panel 15B and, at the same time, both edge portions of the second adhesion portion 36 are adhered to the edge panels 20. The second adhesion portion 36 is formed with a size which allows the second adhesion portion 36 to overlap with the stage collapsed portion 19 of the side panel 15B in a state where the packing box 10 is assembled.

To enhance foldability of the lid main body 34 at a space portion of the box body 11 (a space defined between the end panels 13A, 13B in a state where the box body 11 is assembled), folding portions 37A, 37B to which flexibility is imparted are formed between the lid main body 34 and the first adhesion portion 35 as well as between the lid main body 34 and the second adhesion portion 36 respectively. The folding portions 37A, 37B include: a pair of fold lines 38 which is formed of a general score line and is spaced apart from each other by a distance equal to a size between the side panels 15A, 15B; and fold lines 39*a* to 39*d* which are disposed parallel to the respective fold lines 38 and away from the fold lines 38 with predetermined distances. Fold-line-non-formed portions 40 are formed on the respective fold lines 39*a* to 39*d* such that, the fold-line-non-formed portion 40 has an approximately rhombic shape as a whole. A fold line 41 is provided to respective end portions of the fold lines 39*a* to 39*d* on a fold-line-non-formed portion 40 side. In a portion surrounded by the fold line 38, the fold line 39*d* and the fold line 41, a stage collapsed portion 42 is provided where the intermediate core 4 is collapsed by reducing a panel thickness of the corrugated board sheet 1 by compression. The lid body 33 can be deformed in conformity with an outer shape of the box body 11 by such stage collapsed portions 42.

The box body 11 and the lid body 33 are punched out from the corrugated board sheet 1 respectively at a box manufacturer as shown in FIG. 2 and FIG. 3. With respect to the box body 11, as shown in FIG. 5, the fold-back panels 25 are folded against the edge panels 20 so that the reinforcing column forming portions 24 are made to overlap with the edge panels 20 and the end panels 13A, 13B. Then, the fold-back panels 25 are adhered to the edge panels 20 (see first fixing part 43 in FIG. 6A), and the inner panels 27 are adhered to the end panels 13A, 13B (see second fixing part 44 in FIG. 6A). With such a configuration, the reinforcing panels 26 of the reinforcing column forming portion 24 are brought into a developed state where the reinforcing panels 26 flatly overlap with the end panels 13A, 13B. The packing box 10 is delivered to a product manufacturer which manufactures predetermined products in such a developed state.

In this manner, according to the packing box 10 of the present invention, the box body 11 and the lid body 33 can be delivered to a product manufacturer in a flat sheet state. Accordingly, in transporting the box body 11 and the lid body 33 to the product manufacturer and in storing an unused packing box 10 at the product manufacturer, a large space is not required and hence, a cost can be reduced. The reinforcing column forming portions 24 are integrally formed with the edge panels 20 and hence, handling of the reinforcing column forming portions 24 is easy and, further, the number of parts of blanks for forming packing box 10 can be reduced and hence, a cost can be reduced also from such a viewpoint.

In assembling the packing box 10 and in packing the products at the product manufacturer, for example, as shown in FIG. 6A, the end panels 13A, 13B are folded against the bottom panel 12 and, thereafter, as shown in FIG. 6B, the edge panels 20 are folded against the end panels 13A, 13B. Further, the side panels 15A, 15B are folded against the bottom panel 12, and the side panels 15A, 15B are made to overlap with outer side surfaces of the edge panels 20. Then, the side panels 15A, 15B are adhered to the edge panels 20 by an adhesive agent (third fixing parts 45). A method of assembling the box body 11 is not limited to the above-mentioned method, and can be modified when desired. In short, it is sufficient that the end panels 13A, 13B and the side panel 15A, 15B are folded against the bottom panel 12, the edge panels 20 are folded against the end panels 13A, 13B, and the edge panels 20 are adhered to the inner side surfaces of both ends of the side panels 15A, 15B.

In this manner, according to the present invention, the assembling operation of the box body 11 is completed by adhering one kind of combination of panels, that is, the combination of the side panels 15A, 15B and the edge panels 20, 20. That is, it is unnecessary to adhere two or more kinds of combinations of panels while keeping a folded state of the box body 11 and hence, assembling operability can be enhanced.

As shown in FIG. 6A, in a state before the edge panel 20 is folded against the end panel 11A, 11B, the fold line 29 of the reinforcing panel 26 is offset from the fold line 21 disposed between the end panel 13A, 13B and the edge panel 20 by the distance L3. Accordingly, as shown in FIG. 6B, when the edge panel 20 is inwardly folded against the end panel 13A, 13B, due to the difference in total length (distance L1, L2), the reinforcing panel 26 disposed between the fold lines 29, 30 is compressed due to the difference in lateral size with respect to the end panel 13A, 13B. As a result, the reinforcing panel 26 inwardly projects from the end panel 13A, 13B in a triangular shape as viewed in a plan view. In this embodiment, the fold line 29, 30 is formed of a lead score which uses an inverted score line as a base and, further, the fold line 31 and the stage collapsed portion 32 are formed at the center portion of the reinforcing panel 26 and hence, it is possible to make the reinforcing panel 26 easily project in a triangular columnar shape with certainty.

After the box body 11 is assembled as described above, in the same manner as the conventional box body, products are stored in the inside of the box body 11. Thereafter, as shown in FIG. 1, the lid body 33 is arranged on an upper portion of the box body 11, and the lid body 33 is adhered to the adhesion panels 22, the side panels 15A, 15B and the predetermined edge panels 20 of the box body 11 thus closing (sealing) the box body 11.

The packing box 10 includes the reinforcing panels 26 each of which extends from the bottom panel 12 to the adhesion panel 22 on both sides of the end panel 13A, 13B. Accordingly, compressive strength of the packing box 10 in the top-and-bottom direction can be enhanced with certainty. Particularly, in this embodiment, the reinforcing panels 26 are made to project from the end panels 13A, 13B and hence, the end panels 13A, 13B and the side panels 15A, 15B can be reinforced uniformly over the whole panels. To be more specific, the reinforcing panels 26 project in a triangular shape as viewed in a plan view and hence, compared to a case where the packing box is reinforced by laminating the reinforcing panels, compressive strength of the packing box can be set to a high value. In this embodiment, the end panel 13A, 13B side has the structure where the reinforcing panels 26 project from the end panel 13A, 13B formed a single layer, and the side panel 15A, 15B side has the three layered structure where the edge panel 20 and the fold-back panel 25 overlap with the side panel 15A, 15B. With such a configuration, the end panels 13A, 13B and the side panels 15A, 15B can be uniformly reinforced. Accordingly, even when the packing boxes 10 are stacked at the time of transporting the packing boxes 10 and at the time of storing the packing boxes 10 at a sales shop, there is no possibility that the packing box 10 is deformed and hence, products stored in the inside of the packing box 10 can be protected with certainty.

In opening the packing box 10 in a sales shop to which products are delivered, a user presses the manipulation opening forming portion 18 inwardly, and holds a distal end edge of the second adhesion portion 36 of the lid body 33. Next, the user winds up the second adhesion portion 36 in the upward direction, and peels off the side panel 15B and the edge panels 20 which are adhered to each other. Then, the user winds up the lid main body 34 to a side panel 15A side so as to peel off the lid main body 34 adhered to the adhesion panels 22. Thereafter, the user rotates the first adhesion portion 35 in the lateral direction, for example, and breaks the uncut portions 17*b* of the design cut line 17.

With such an operation, it is possible to bring the packing box 10 into an open state where the products stored in the inside of the packing box 10 are exposed. In such an open state, an upper portion of the box body 11 is largely opened and hence, products stored in the inside of the box body 11 can be easily taken out from the box body 11. On the side panel 15A which forms a front surface of the box body 11, a broken edge of the design cut line 17 formed by taking decorativeness into account is exposed and hence, it is also possible to display and sell the products at a sales shop in a state where the products are stored in the box body 11.

Second Embodiment

Figure 7A:
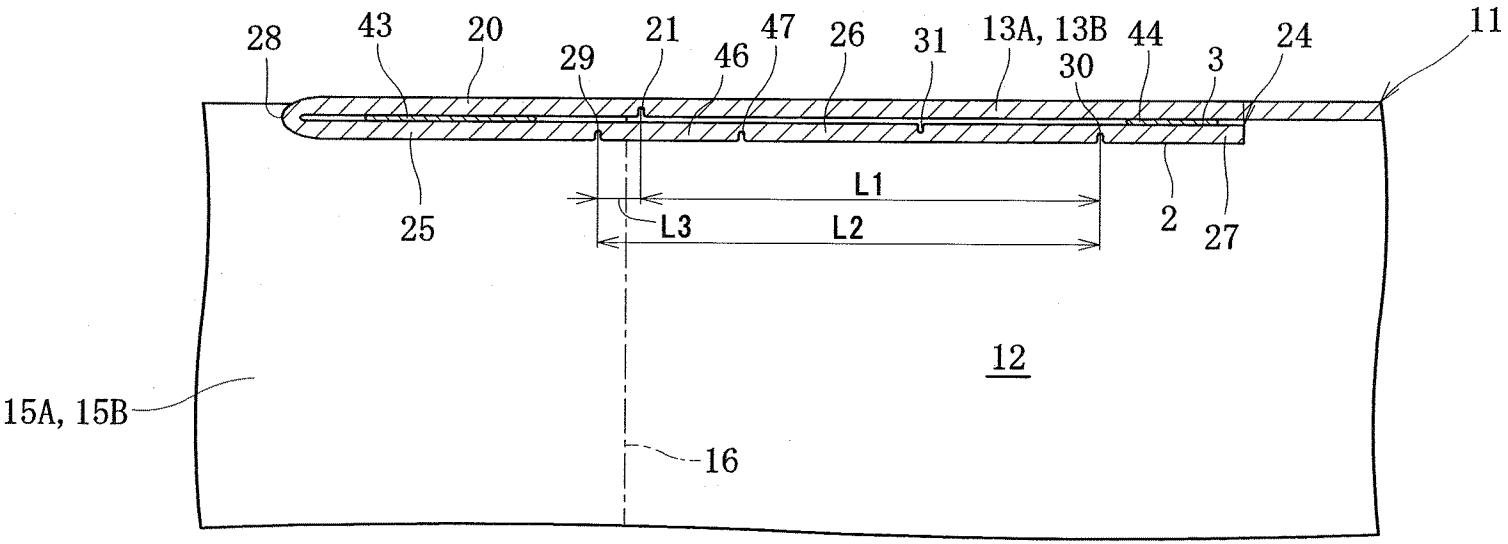
FIG. 7A is a cross-sectional view showing a reinforcing panel of a box body of a packing box according to a second embodiment before the packing box is assembled.
Figure 7B:
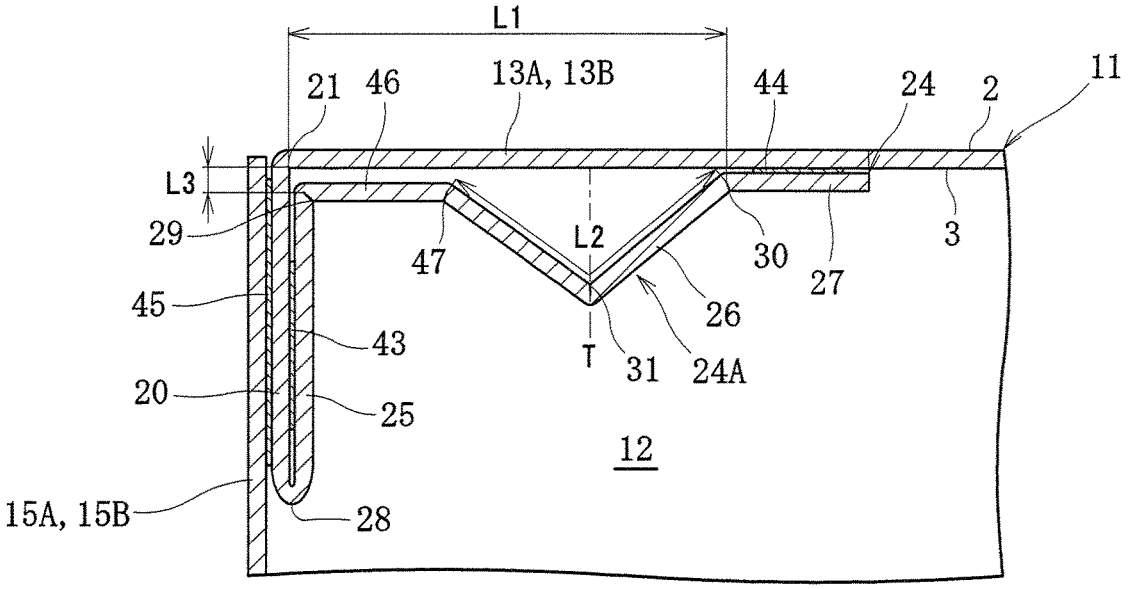
FIG. 7B is a cross-sectional view showing the reinforcing panel of the box body of the packing box according to the second embodiment in an assembled state.

FIG. 7A and FIG. 7B show a box body 11 of a packing box 10 according to a second embodiment. The second embodiment differs from the first embodiment with respect to a point that a continuous panel 46 extending along an end panel 13A, 13B is formed in a reinforcing panel 26. In the same manner as the first embodiment, first and second fold lines 29, 30 are formed on both sides of the reinforcing panel 26, and a third fold line 31 is formed on the center of the reinforcing panel 26. By forming a fold line 47 on the reinforcing panel 26 between the fold lines 29, 31 such that the fold line 47 is positioned on the end panel 13A, 13B, the continuous panel 46 is defined by the fold line 47. The fold line 47 is formed of a lead score where cut lines are formed on an inverted score line at predetermined intervals. In the box body 11 according to the second embodiment, the continuous panel 46 extends along the end panel 13A, 13B in a state where the box body 11 is assembled. Accordingly, it is possible to make a top portion T of the reinforcing panel 26 projecting inward positioned on a center side of the end panel 13A, 13B in a width direction.

Third Embodiment

Figure 8A:
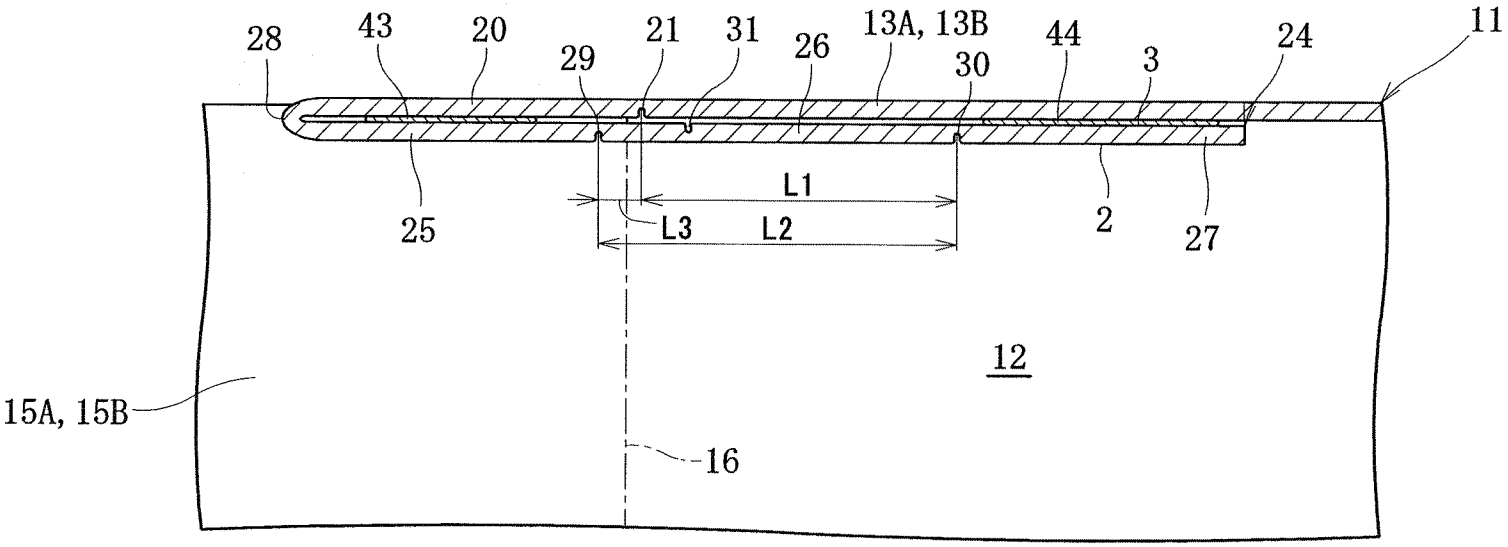
FIG. 8A is a cross-sectional view showing a reinforcing panel of a box body of a packing box according to a third embodiment before the packing box is assembled.
Figure 8B:
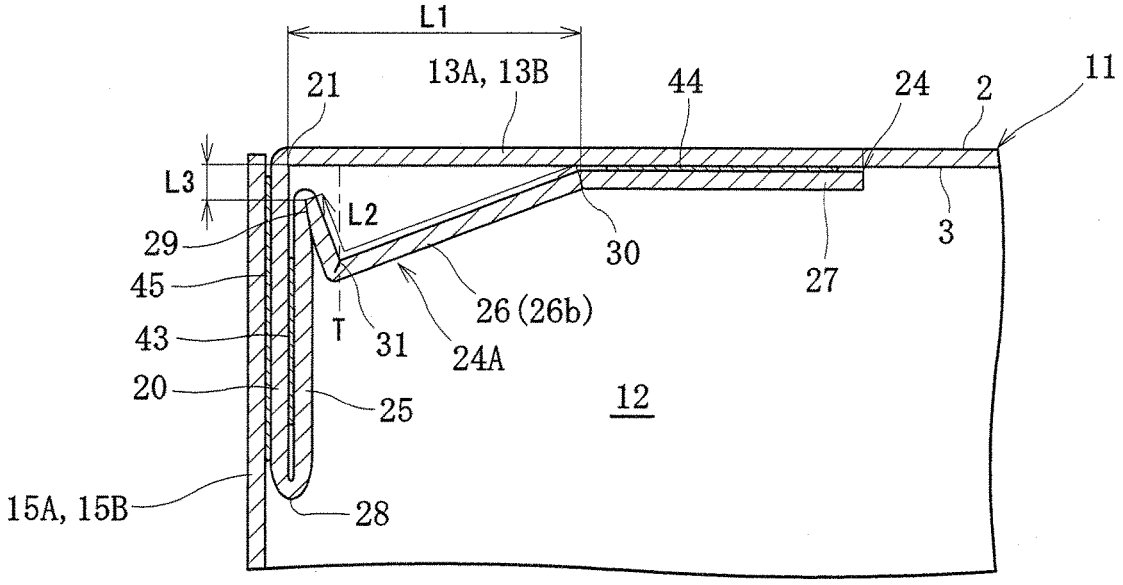
FIG. 8B is a cross-sectional view showing the reinforcing panel of the box body of the packing box according to the third embodiment in an assembled state.

FIG. 8A and FIG. 8B show a box body 11 of a packing box 10 according to a third embodiment. The third embodiment differs from the first embodiment with respect to a point that a forming position of a fold line (third fold line) 31 formed on a reinforcing panel 26 is positioned on a fold-back panel 25 side on an end panel 13A, 13B. With such a configuration, in the box body 11 of the third embodiment, it is possible to arrange a top portion T of a reinforcing panel 26 close to a side panel 15A, 15B side, and it is also possible to make an inclination angle of a second panel portion 26*b* of the reinforcing panel 26 which extends toward a center side of the end panel 13A, 13B gentle.

Fourth Embodiment

Figure 9A:
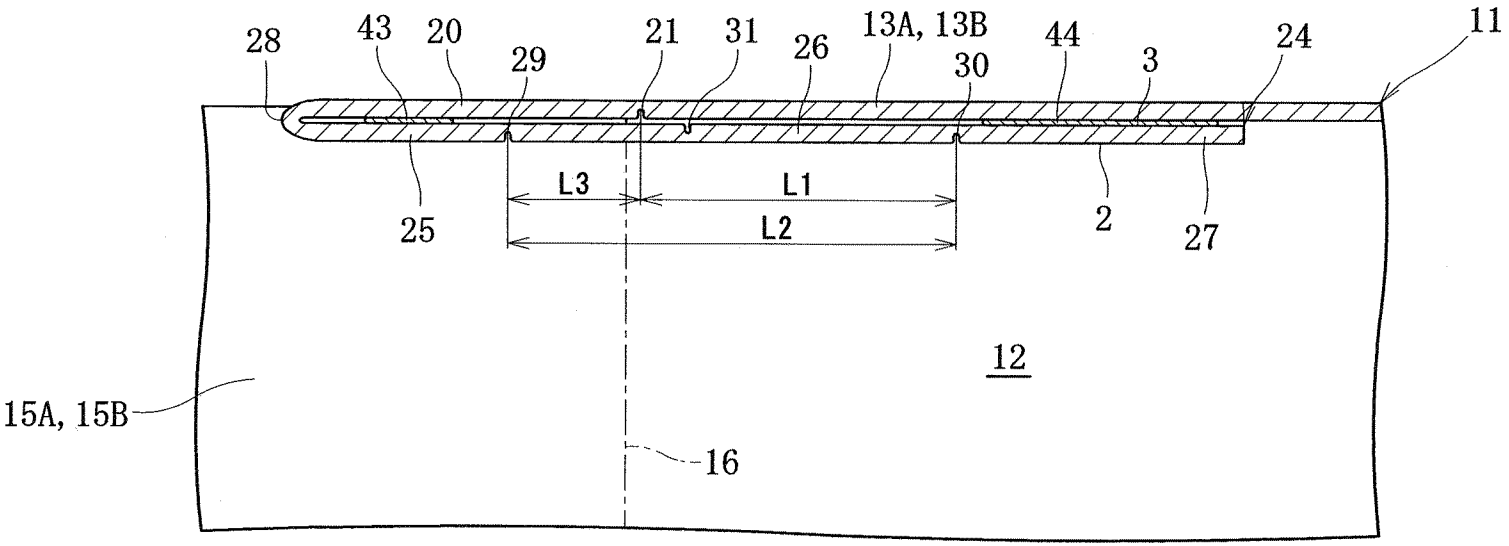
FIG. 9A is a cross-sectional view showing a reinforcing panel of a box body of a packing box according to a fourth embodiment before the packing box is assembled.
Figure 9B:
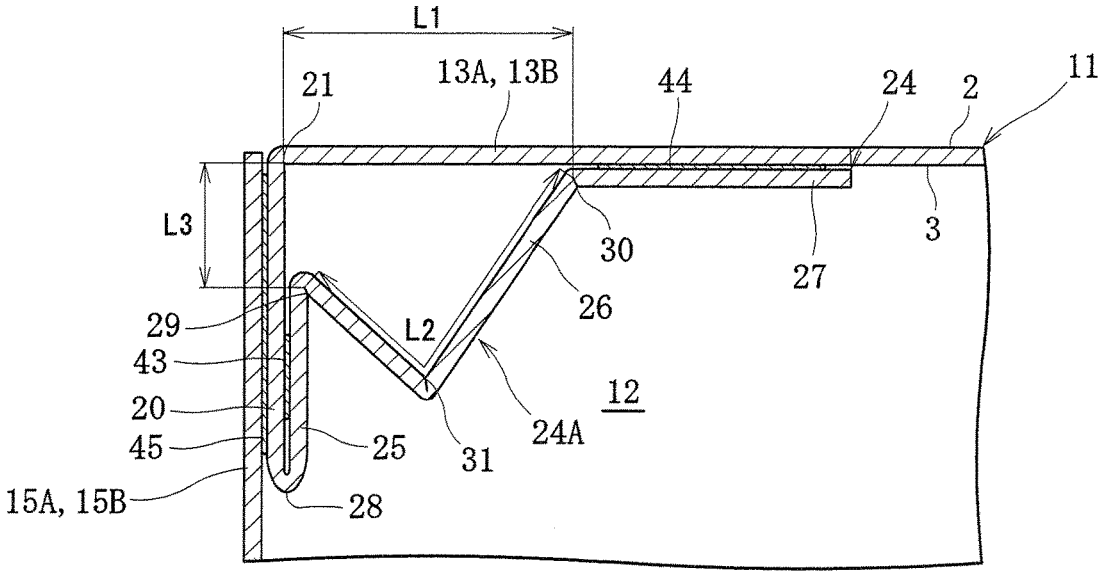
FIG. 9B is a cross-sectional view showing the reinforcing panel of the box body of the packing box according to the fourth embodiment in an assembled state.

FIG. 9A and FIG. 9B show a box body 11 of a packing box 10 according to a fourth embodiment. The fourth embodiment differs from the first embodiment with respect to a point that a fold line 29 formed between a fold-back panel 25 and a reinforcing panel 26 is positioned on a side of a fold line 28 formed between an edge panel 20 and the fold-back panel 25. To be more specific, compared to the first embodiment, in this embodiment, a distance L3 by which the fold line 29 is offset from a fold line 21 is increased so that the fold line 29 is arranged at the center of the edge panel 20 in the width direction. According to the box body 11 in the fourth embodiment, it is possible to arrange the reinforcing panel 26 projecting from an end panel 13A, 13B further close to a side panel 15A, 15B side, and a projecting size of the reinforcing panel 26 can be increased.

Fifth Embodiment

Figure 10A:
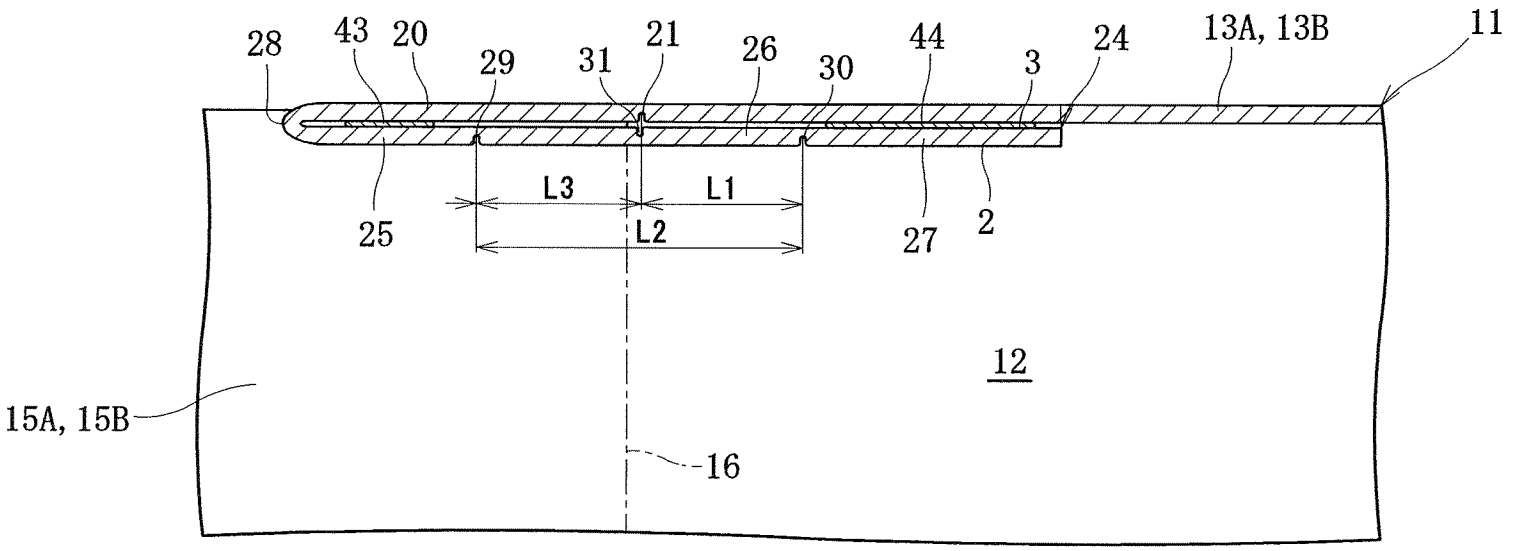
FIG. 10A is a cross-sectional view showing a reinforcing panel of a box body of a packing box according to a fifth embodiment before the packing box is assembled.
Figure 10B:
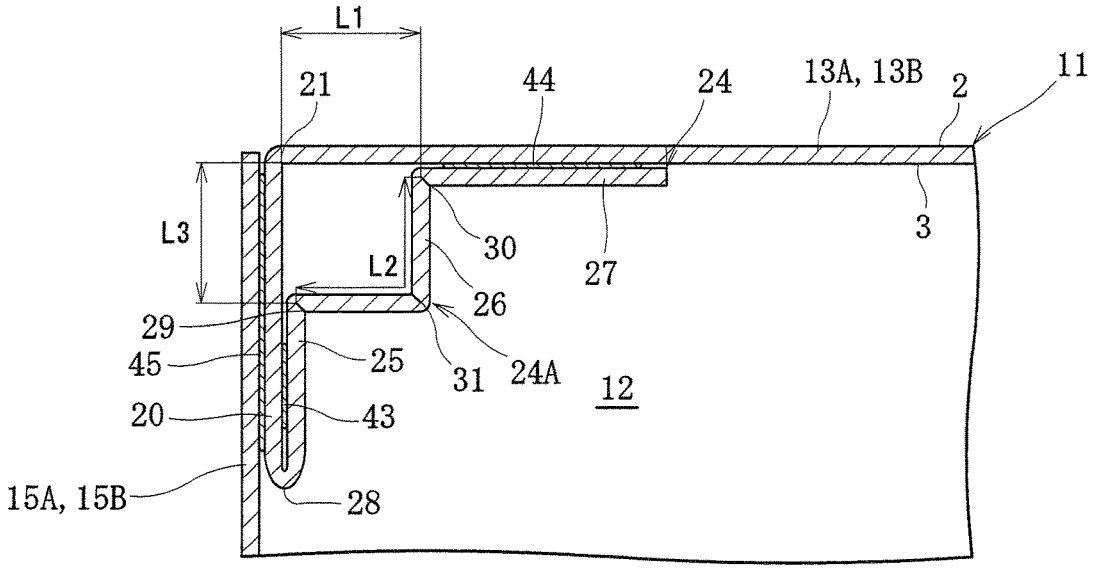
FIG. 10B is a cross-sectional view showing the reinforcing panel of the box body of the packing box according to the fifth embodiment in an assembled state.

FIG. 10A and FIG. 10B show a box body 11 of a packing box 10 according to a fifth embodiment. The fifth embodiment differs from the first embodiment with respect to a point that a reinforcing panel 26 having a rectangular shape as viewed in a plan view is formed at a corner portion ranging from an end panel 13A, 13B to a side panel 15A, 15B. To be more specific, a fold line 31 formed at the center of the reinforcing panel 26 is formed in the vicinity of a fold line 21 formed between the end panel 13A, 13B and an edge panel 20. Fold lines 29, 30 formed on both sides of the reinforcing panel 26 are disposed so as to be positioned symmetrically with each other with respect to the fold line 31. According to the box body 11 in the fifth embodiment, the reinforcing panel 26 projects approximately equally from both the end panel 13A, 13B and the side panel 15A, 15B and hence, rigidity of the reinforcing panel 26 can be further increased.

Sixth Embodiment

Figure 11A:
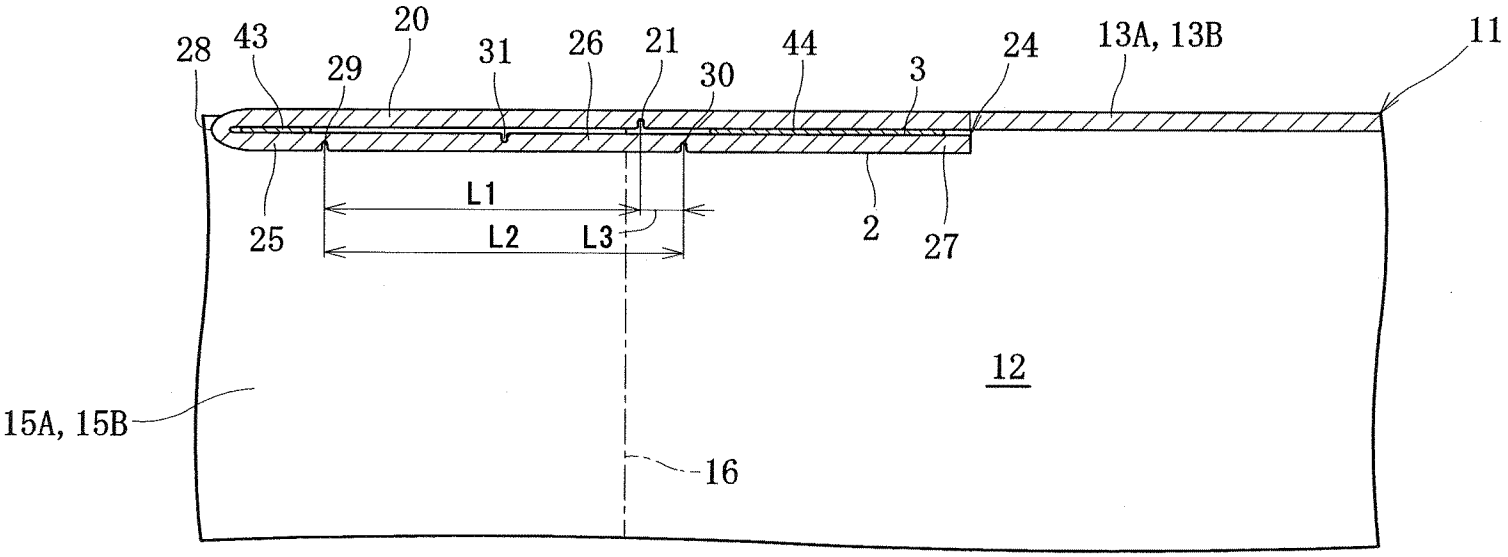
FIG. 11A is a cross-sectional view showing a reinforcing panel of a box body of a packing box according to a sixth embodiment before the packing box is assembled.
Figure 11B:
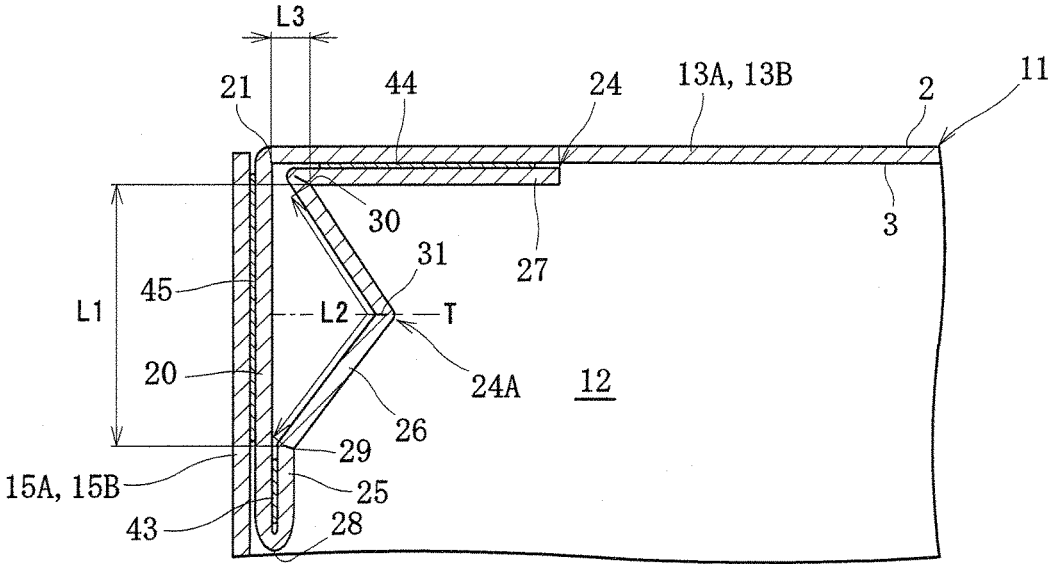
FIG. 11B is a cross-sectional view showing the reinforcing panel of the box body of the packing box according to the sixth embodiment in an assembled state.

FIG. 11A and FIG. 11B show a box body 11 of a packing box 10 according to a sixth embodiment. The sixth embodiment differs from the first embodiment with respect to a point that a reinforcing panel 26 having a triangular shape as viewed in a plan view are provided so as to project from a side panel 15A, 15B. To be more specific, a fold line 30 formed between the reinforcing panel 26 and an inner panel 27 is formed so as to be positioned on an end panel 13A, 13B and also to be positioned in the vicinity of a fold line 21. Assuming a fold line 29 disposed away from the fold line 21 as a reference point, the fold line 21 disposed on an end of an edge panel 20 is positioned away from the fold line 29 by a distance L1. The fold line 30 is positioned away from the fold line 29 by a distance L2. With respect to these distances L1, L2, the distance L2 is longer than the distance L1. That is, the fold line 30 is offset from the fold line 21 by a distance L3.

In this manner, in the sixth embodiment, out of the fold lines 29, 30 disposed on both sides of the reinforcing panel 26, the fold line 30 positioned on a side closer to the fold line 21 than a projecting top portion T in a state where the box body 11 is assembled is offset from the fold line 21 by the distance L3. Accordingly, the reinforcing panel 26 projects inward from an edge panel 20 side at a corner portion formed between the end panel 13A, 13B and the side panel 15A, 15B. In the sixth embodiment, the reinforcing panel 26 projects from the side panel 15A, 15B having the two layered structure where the edge panel 20 overlaps with an inner surface side of the side panel 15A, 15B, and the end panel 13A, 13B side has the two layered structure where the inner panel 27 overlaps with an inner surface side of the end panel 13A, 13B. Accordingly, compressive strength of the box body 11 on the side panel 15A, 15B side can be enhanced.

As described in the above-mentioned first to sixth embodiments, according to the present invention, the fold lines 29, 30 formed on both sides of the reinforcing panel 26 are offset from the fold line 21 formed between the end panel 13A, 13B and the edge panel 20 by the distance L3 and hence, a portion where the reinforcing panel 26 projects and a shape of the reinforcing panel 26 can be changed as desired. Accordingly, when a product where partial applying of compression to a part of the product should be avoided is stored in the box body 11, it is possible to form, in conformity with the shape of the product, the reinforcing panel 26 so as to have a portion or a shape by which the product minimally interferes with the reinforcing panel 26. The box body 11 may be formed by combining the technical features of the respective embodiments as desired such as the incorporation of the configuration described in the second embodiment where the continuous panel 46 is provided.

Seventh Embodiment

Figure 12:
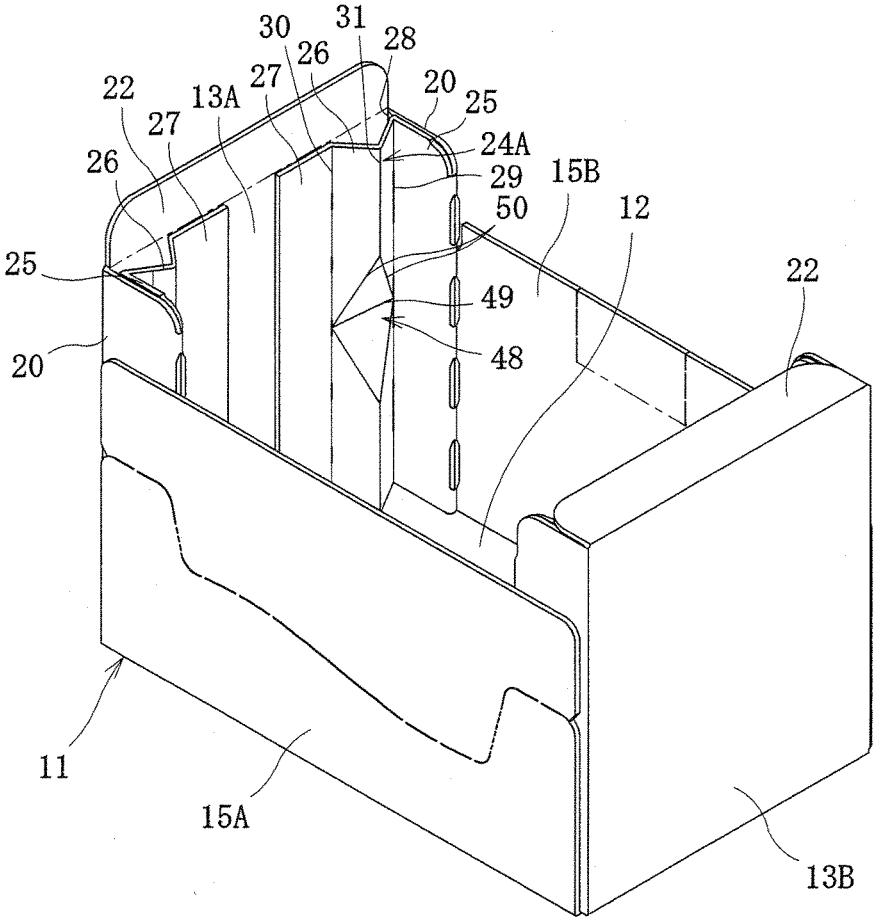
FIG. 12, is a perspective view showing a box body of a packing box according to a seventh embodiment.

FIG. 12 shows a box body 11 of a packing box 10 according to a seventh embodiment. The seventh embodiment differs from the first embodiment with respect to a point that a recessed portion 48 which is recessed outward is formed on a center portion of a reinforcing panel 26 in the height direction. To be more specific, a fold line 49 which extends between fold lines 29, 30 is formed on the center of the reinforcing panel 26, four fold lines 50 which extend toward an upper center portion of the reinforcing panel 26 and a lower center portion of the reinforcing panel 26 from both ends of the fold line 49 are formed on the reinforcing panel 26, and fold lines 31 are formed including intersecting points of the fold lines 50. In this manner, the recessed portion 48 may be formed in conformity with a shape of a product so as to prevent the interference between the product and the reinforcing panel 26. It is needless to say that the configuration which includes the recessed portion 48 is also applicable to the packing boxes 10 of the second to sixth embodiments.

Eighth Embodiment

Figure 13:
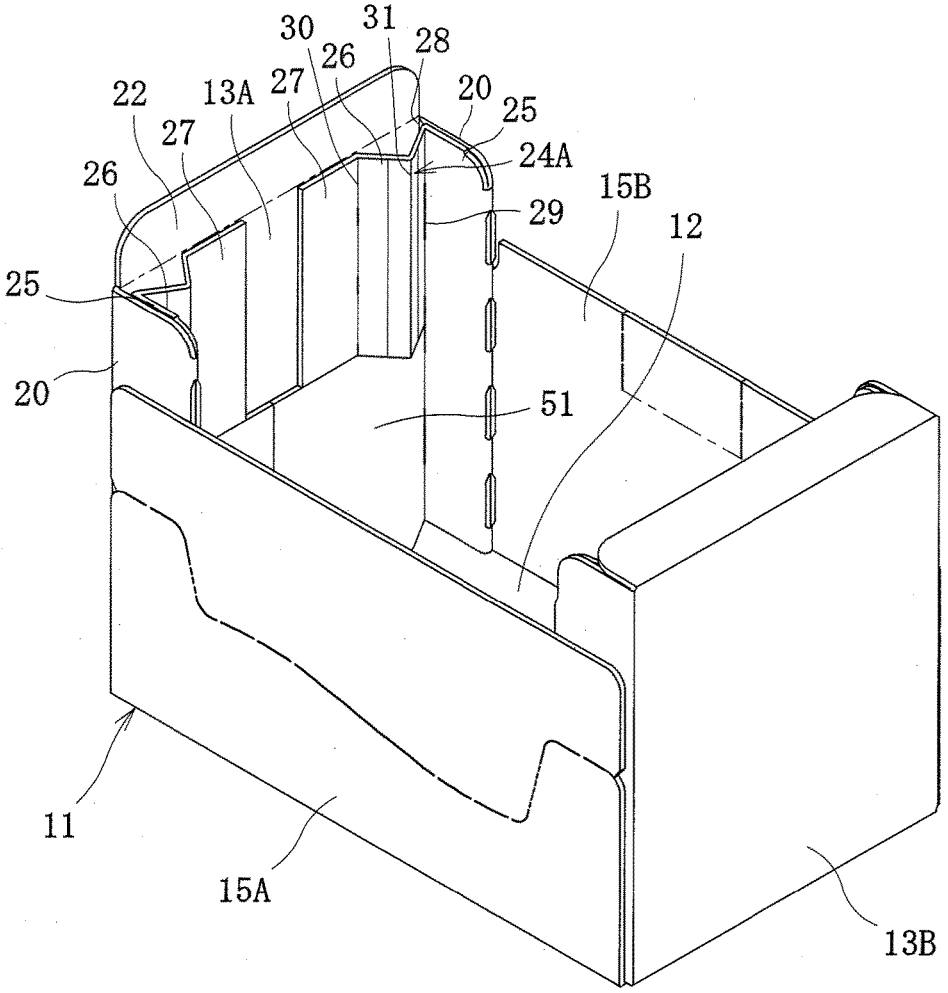
FIG. 13 is a perspective view showing a box body of a packing box according to an eighth embodiment.

FIG. 13 shows a box body 11 of a packing box 10 according to an eighth embodiment. The eighth embodiment differs from the first embodiment with respect to a point that reinforcing panels 26 are made to project only from an upper half portion of an end panel 13A, 13B. To be more specific, the reinforcing panel 26 and an inner panel 27 are formed only on an upper half of a fold-back panel 25 on a distal end side of the fold-back panel 25, and a lower half portion of the fold-back panel 25 is formed of an overlapping panel 51 which wholly overlaps with an inner surface of an end panel 13A, 13B. The reinforcing panel 26 and the inner panel 27 are separated (divided) from the overlapping panel 51 by a cut line. In the eighth embodiment, the reinforcing panel 26 is formed on the upper half of the end panel 13A, 13B. However, the reinforcing panel 26 may be formed on the lower half of the end panel 13A, 13B, or the reinforcing panels 26 may be made to project from intermediate portion of the end panel 13A, 13B in the height direction. It is needless to say that the technical features described in the second to seventh embodiments may be combined to the box body 11 in the eighth embodiment.

Ninth Embodiment

Figure 14:
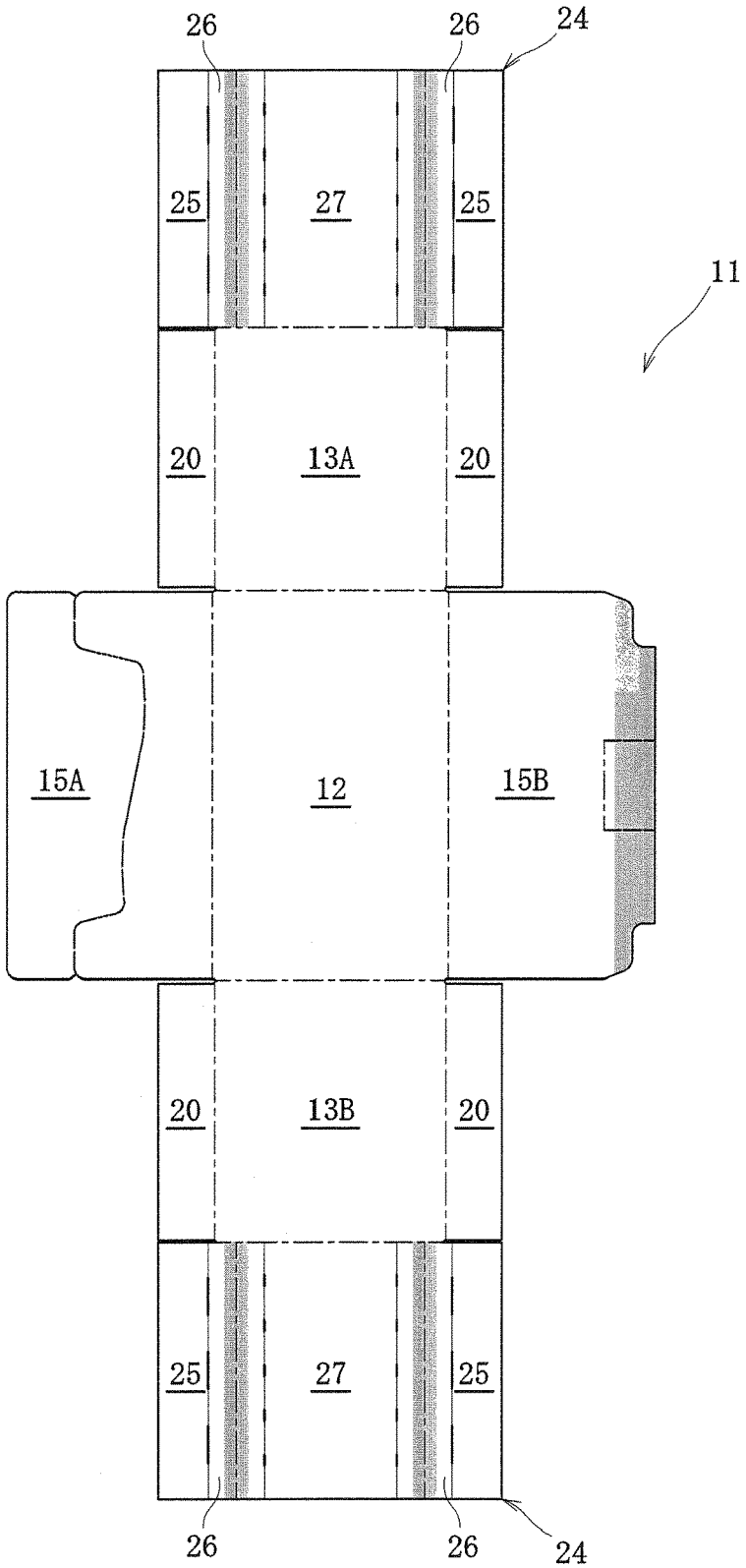
FIG. 14 is a plan view showing a blank for forming a box body of a packing box according to a ninth embodiment.

FIG. 14 shows a blank for forming a box body 11 of a packing box 10 according to a ninth embodiment. The ninth embodiment differs from the first embodiment with respect to a point that a reinforcing column forming portion 24 formed of fold-back panels 25, reinforcing panels 26 and an inner panel 27 is connected to an end edge of an end panel 13A, 13B. In this embodiment, inner panels 27 of the reinforcing column forming portions 24, 24 disposed on both ends of the blank are formed of one panel shared in common by the reinforcing column forming portions 24. The box body 11 in the ninth embodiment having such a configuration can acquire substantially the same manner of operation and advantageous effects as the box body 11 in the first embodiment. It is needless to say that the box body 11 in the ninth embodiment may be configured by incorporating the technical features in the second to eighth embodiments.

In the ninth embodiment, although it is preferable that edge panels 20 and the fold-back panels 25 be fixed to each other by an adhesive agent or the like, it is not always necessary to fix the end panel 13A, 13B and the inner panel 27 to each other.

Tenth Embodiment

Figure 15A:
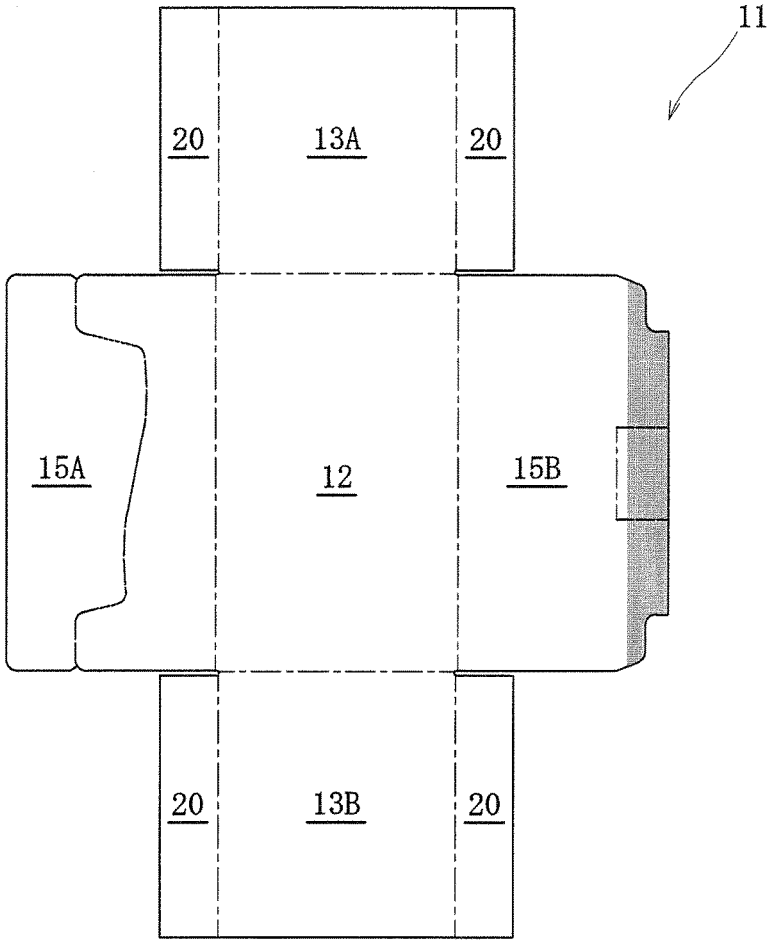
FIG. 15A is a plan view showing a blank for forming a box body of a packing box according to a tenth embodiment.
Figure 15B:
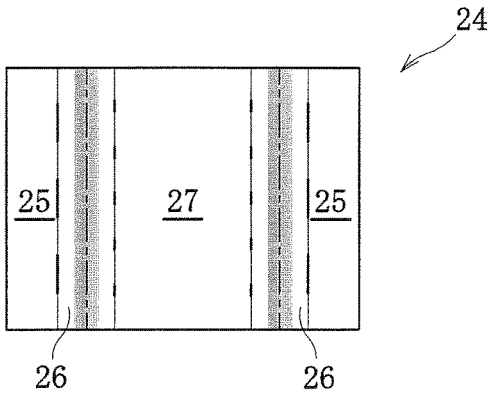
FIG. 15B is a plan view showing a blank for forming a reinforcing column forming portion of the packing box according to the tenth embodiment.

FIG. 15A shows a blank for forming a box body 11 of a packing box 10 according to a tenth embodiment, and FIG. 15B shows a blank for forming a reinforcing column forming portion 24. The tenth embodiment differs from the first embodiment with respect to a point that the box body 11 and the reinforcing column forming portion 24 for forming a reinforcing column 24A are formed as separate bodies. The box body 11 in the tenth embodiment having such a configuration can acquire substantially the same manner of operation and advantageous effects as the box body 11 in the first embodiment. It is needless to say that the technical features described in the second to eighth embodiments may be combined to the box body 11 in the tenth embodiment.

Eleventh Embodiment

Figure 16:
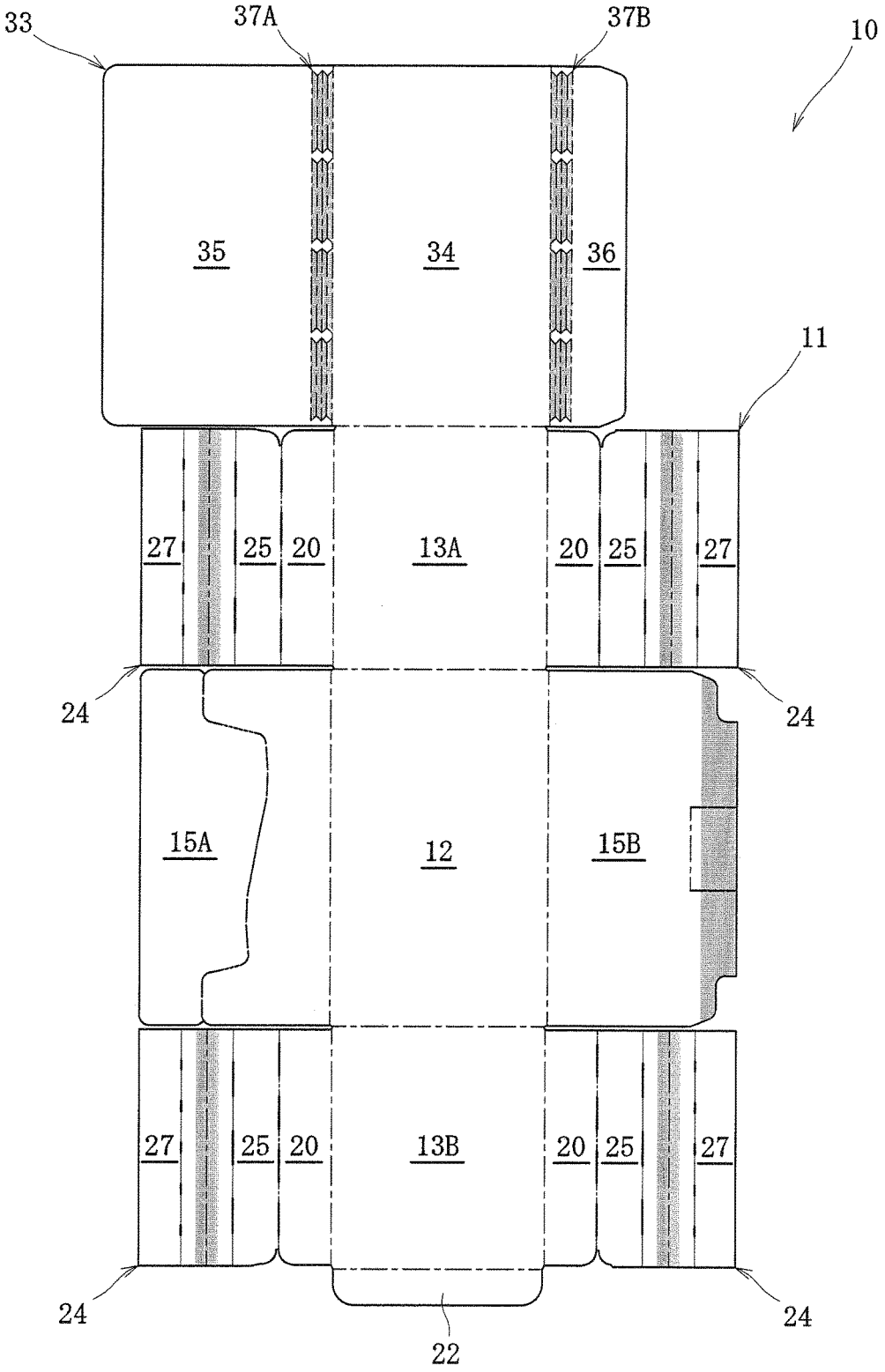
FIG. 16 is a plan view showing a blank for forming a packing box according to an eleventh embodiment.

FIG. 16 shows a blank for forming a packing box 10 according to an eleventh embodiment. The eleventh embodiment differs from the first embodiment with respect to a point that a blank for forming a box body 11 and a blank for forming a lid body 33 are integrally formed with each other as one blank. The blank in the eleventh embodiment having such a configuration can acquire substantially the same manner of operation and advantageous effects as the blank in the first embodiment. Further, the blanks for forming the packing box 10 are collectively formed as one blank and hence, handling convenience can be enhanced. It is needless to say that the technical features described in the second to eighth embodiments may be combined to the box body 11 in the eleventh embodiment.

Twelfth Embodiment

Figure 17A:
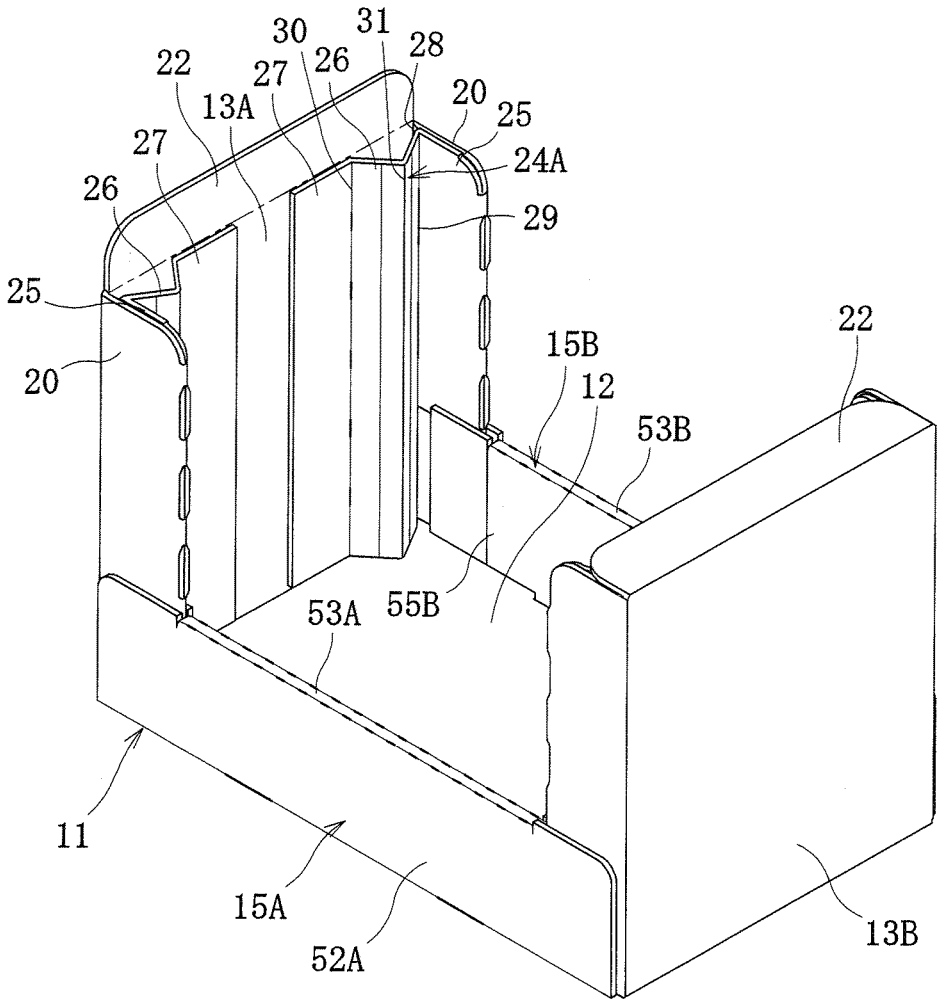
FIG. 17A is a perspective view showing a box body of a packing box according to a twelfth embodiment.
Figure 17B:
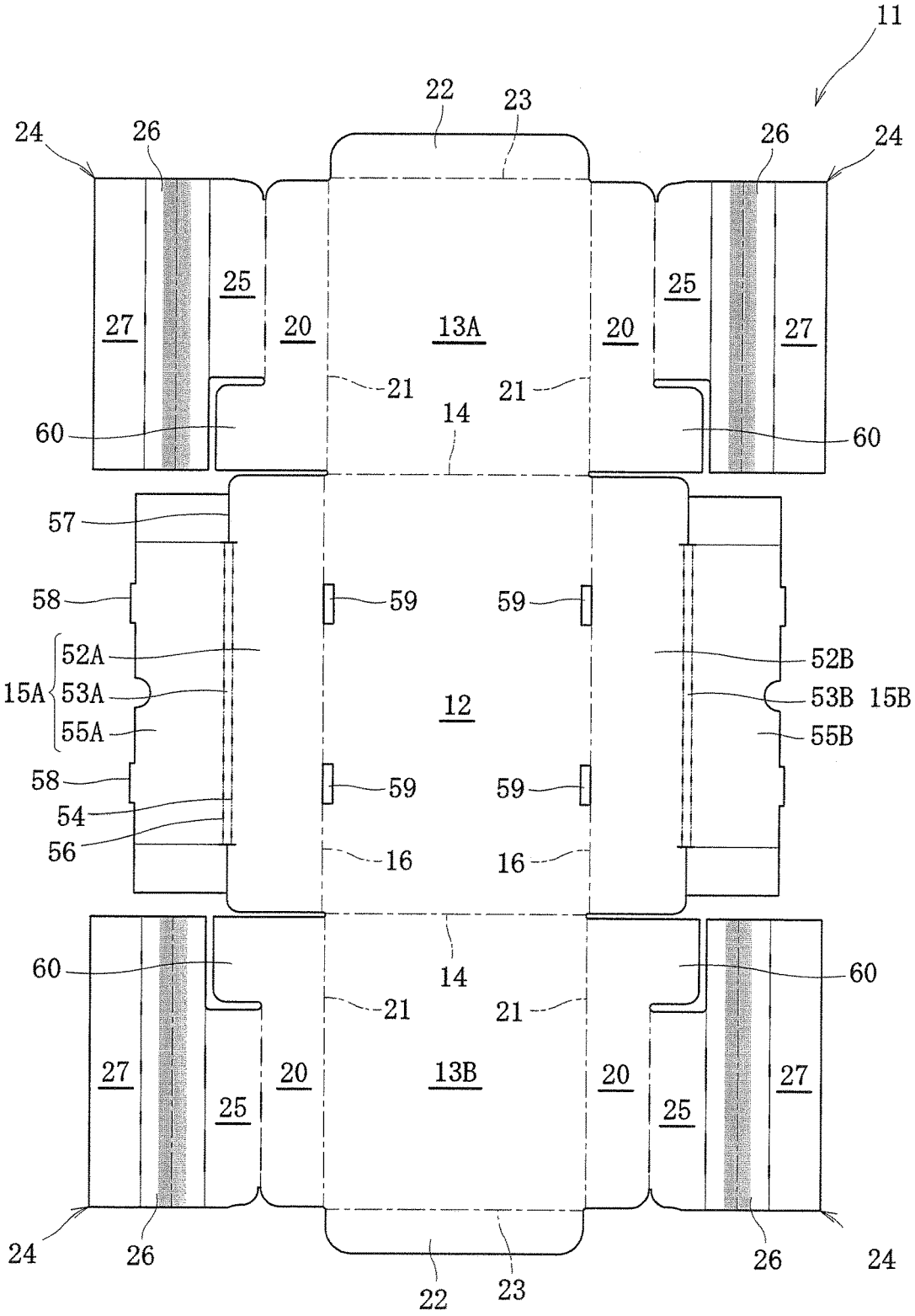
FIG. 17B is a plan view showing a blank for forming the box body in the twelfth embodiment.

FIG. 17A and FIG. 17B show a box body 11 of a packing box 10 according to a twelfth embodiment. The twelfth embodiment differs from the first embodiment with respect to a point that a side panel 15A, 15B has a double panel structure formed of an outer plate portion 52A, 52B and an inner plate portion 55A, 55B, and the side panel 15A, 15B and the edge panel 20 are locked to each other by sandwiching instead of adhering the side panel 15A, 15B and the edge panel 20 to each other by an adhesive agent.

As shown in FIG. 17B, the outer plate portions 52A, 52B are connected to both side edges of a bottom panel 12 via fold lines 16. Upper plate portions 53A, 53B are connected to intermediate portions of outer end edges of the outer plate portions 52A, 52B via fold lines 54 formed of a lead score. The inner plate portions 55A, 55B are connected to outer end edges of the upper plate portions 53A, 53B via fold lines 56 formed of a lead score. A cut line 57 is formed on both ends of the upper plate portion 53A, 53B in the longitudinal direction, and the outer plate portion 52A, 52B and the inner plate portion 55A, 55B are divided from each other by the cut line 57. A pair of locking projecting portions 58, 58 is formed on an outer end of the inner plate portion 55A, 55B, and locking hole portions 59, 59 are formed in the bottom panel 12 at positions which correspond to the locking projecting portions 58, 58 in a state where the box body 11 is assembled.

An inserting and locking portion 60 which is inserted into and disposed between the outer plate portion 52A, 52B of the side panel 15A, 15B and the inner plate portion 55A, 55B in a state where the box body 11 is assembled is formed on a lower portion of each edge panel 20 in a projecting manner. In this embodiment, a fold-back panel 25 is connected to an upper side of the inserting and locking portion 60, and a reinforcing panel 26 and an inner panel 27 substantially equal to the reinforcing panel 26 and the inner panel 27 in the first embodiment are connected to an outer end edge of each fold-back panel 25.

In the same manner as the first embodiment, the box body 11 in the twelfth embodiment having such a configuration is delivered to a product manufacturer in a developed state where the fold-back panels 25 are adhered to the edge panels 20, and the inner panels 27 are adhered to end panels 13A, 13R. In assembling the box body 11 at the product manufacturer, the end panels 13A, 13B are folded against the bottom panel 12 and, thereafter, the edge panels 20 are folded against the end panels 13A, 13B. Thereafter, as shown in FIG. 17A, the outer plate portions 52A, 52B are folded against the bottom panel 12 and, then, the upper plate portions 53A, 53B and the inner plate portions 55A, 55B are folded so as to wind up the inserting and locking portions 60, and the locking projecting portions 58 are inserted into and locked into the locking hole portions 59.

In this manner, according to the box body 11 in the twelfth embodiment, the box body 11 can be assembled without performing an adhering operation at a product manufacturer. Accordingly, assembling operability at the product manufacturer can be largely enhanced. Further, the box body 11 includes the reinforcing panels 26 which project inward when the box body 11 is assembled and hence, the box body 11 in the twelfth embodiment can acquire substantially the same manner of operation and advantageous effects as the box body 11 in the first embodiment. It is needless to say that the technical features described in the second to eleventh embodiments may be combined to the box body 11 in the twelfth embodiment.

Thirteenth Embodiment

Figure 18:
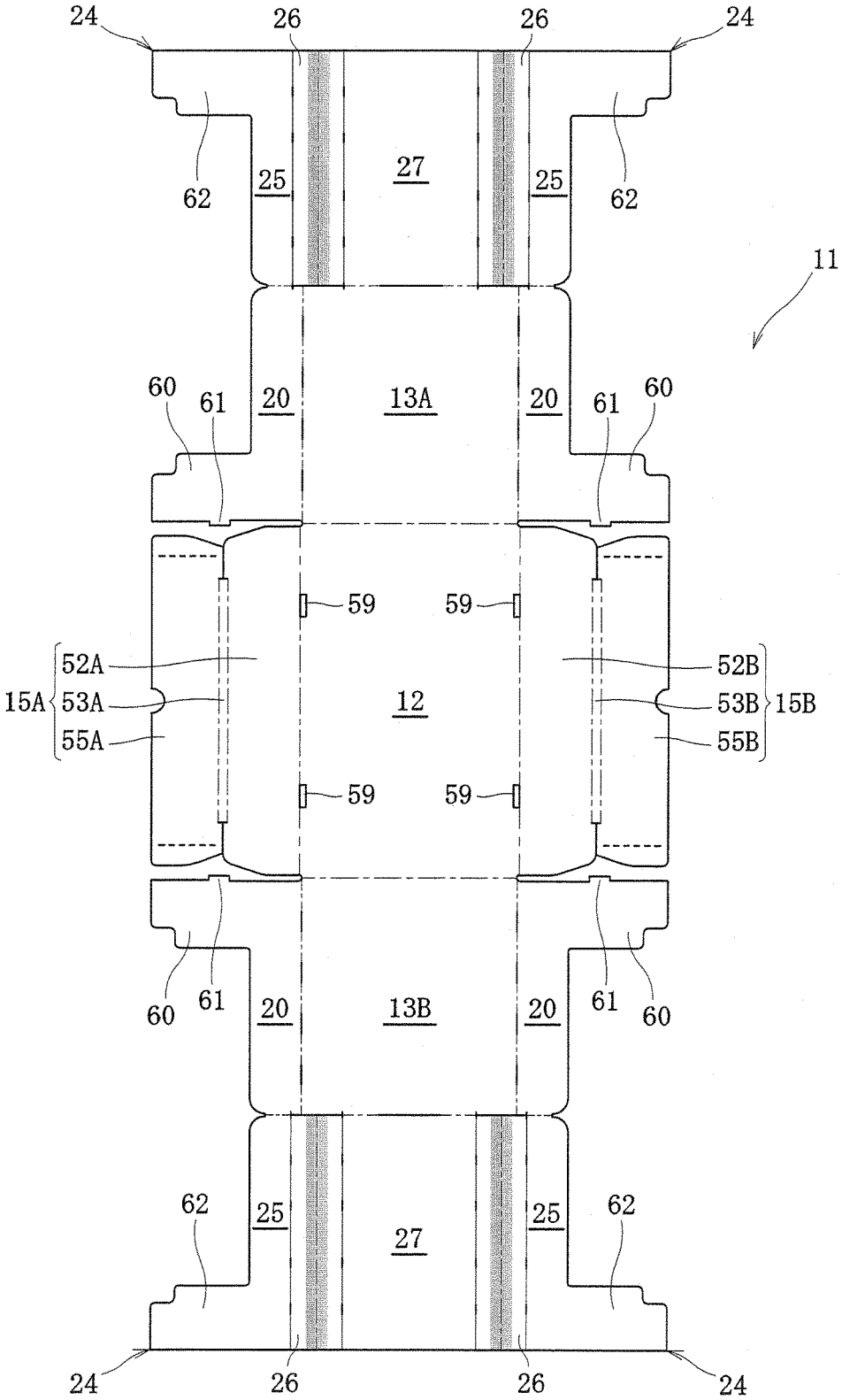
FIG. 18 is a plan view showing a blank for forming a box body of a packing box according to a thirteenth embodiment.

FIG. 18 shows a blank for forming a box body 11 of a packing box 10 according to a thirteenth embodiment. The thirteenth embodiment differs from the first embodiment with respect to a point that reinforcing column forming portions 24 are connected to an end edge of an end panel 13A, 13B in the same manner as the ninth embodiment shown in FIG. 14, and, at the same time, a side panel 15A, 15B has the double panel structure in the same manner as the twelfth embodiment shown in FIG. 17B.

An outer plate portion 52A, 52B, an upper plate portion 53A, 53B and an inner plate portion 55A, 55B are connected to both side edges of a bottom panel 12 in this order. The side panel 15A, 15B is formed such that the outer plate portion 52A, 52B is folded against the bottom panel 12, the upper plate portion 53A, 53B is folded against the outer plate portion 52A, 52B, and the inner plate portion 55A, 55B is folded against the upper plate portion 53A, 53B.

An inserting and locking portion 60 which is inserted into and disposed between the outer plate portion 52A, 52B and the inner plate portion 55A, 55B of the side panel 15A, 15B is formed on a lower portion of each edge panel 20 in a projecting manner. A locking projecting portion 61 which is inserted into and locked to a locking hole portion 59 formed in the bottom panel 12 is formed on the inserting and locking portion 60 in a projecting manner.

In the same manner as the ninth embodiment, a pair of reinforcing column forming portions 24, 24 uses one inner panel 27 in common. A reinforcing panel 26 and a fold-back panel 25 are connected to both sides of the inner panel 27 in this order. An inserting and locking portion 62 which is made to overlap with an inner surface side of the inserting and locking portion 60 formed on the edge panel 20 is formed on the fold-back panel 25 in a projecting manner.

In the same manner as the ninth embodiment, the blank in the thirteenth embodiment having such a configuration includes one continuously formed inner panel 27 and hence, it is unnecessary to adhere the end panel 13A, 13B and the inner panel 27 to each other. Further, the side panel 15A, 15B has the double panel structure having the outer plate portion 52A, 52B and the inner plate portion 55A, 55B and hence, in the same manner as the twelfth embodiment, the box body 11 can be assembled by fixing the edge panels 20 and the side panels 15A, 15B to each other without performing an adhering operation. Further, the inserting and locking portion 62 which is sandwiched into the side panel 15A, 15B is formed on each fold-back panel 25 and hence, even when the edge panels 20 and the fold-back panels 25 are not adhered to each other, the box body 11 can be assembled by fixing the edge panels 20 and the fold-back panels 25 at fixed positions.

Accordingly, the box body 11 in the thirteenth embodiment can acquire substantially the same manner of operation and advantageous effects as the box body 11 in the first embodiment. Further, it is possible to omit all adhering operation and hence, assembling operability at a product manufacturer can be enhanced. Further, a box product manufacturer can directly deliver the packing box 10 in the form of a blank and hence, a cost can be further reduced. It is needless to say that the fold-back panels 25 may be adhered to the edge panels 20, and the inner panels 27 may be adhered to the end panels 13A, 13B.

The configuration of the packing box 10 of the present disclosure is not limited to the configuration described in the above-mentioned embodiments, and various modifications are conceivable.

For example, in the respective embodiments, the respective panels are adhered to each other by an adhesive agent. However, the respective panels may be fixed to each other using well-known methods and well-known structures by which the respective panels can be fixed to each other. In the above-mentioned embodiments, the packing box 10 is formed of the box body 11 and the lid body 33. However, the box body 11 may be sealed by a shrink film instead of the lid body 33, and the lid body 33 may not be provided.

In the above-mentioned embodiments, the end panel 13A, 13B and the side panel 15A, 15B are formed so as to have different overall heights. However, the end panel 13A, 13B and the side panel 15A, 15B may be formed so as to have the same overall height. In the above-mentioned embodiments, the edge panels 20 and the fold-back panels 25 are fixed to each other by an adhesive agent. However, the edge panels 20 and the fold-back panels 25 may not be fixed to each other.

In the above-mentioned respective embodiments, the packing box 10 is formed so as to have a rectangular shape as viewed in a plan view. However, the packing box 10 may have an octagonal shape as viewed in a plan view where a chamfered panel is formed between the end panels 13A, 13B and the side panels 15A, 15B. A shape of the packing box 10 such as a shape as viewed in a plan view or a shape as viewed in a side view can be changed as desired.

In the above-mentioned embodiments, the packing box 10 is formed by punching out the blank for forming the packing box 10 from the paper-made corrugated board sheet 1. However, the packing box 10 may be formed by punching out a blank for forming the packing box 10 from a resin-made corrugated board sheet. A material from which the blank is punched out is not limited to a single corrugated board sheet, and may be a single heavy paper or a single resin sheet.

In the above-mentioned embodiments, the configuration is described where the reinforcing column forming portions 24 are adhered to the end panels 13A, 13B and the edge panels 20, and the packing box 10 is delivered to a product manufacturer. However, a blank for forming the box body 11 and a blank for forming the lid body 33 may be directly delivered to the product manufacturer.

To be more specific, it is sufficient for the reinforcing column forming portions 24 to be folded and fixed to the end panel 13A, 13B and the edge panels 20 such that the reinforcing column forming portion 24 flatly overlaps with the end panels 13A, 13B and the edge panel 20. Thereafter, by folding the edge panels 20 against the end panel 13A, 13B, the reinforcing panels 26 are made to project due to the difference between a size from the fold line 21 to the second fold line 30 and a size from the first fold line 29 to the second fold line 30 (difference between the distance L1 and the distance L2). Next, the end panels 13A, 13B are folded against the bottom panel 12 and, thereafter, the side panels 15A, 15B are folded against the bottom panel 12. Then, the edge panels 20 are fixed to the side panel 15A, 15B so that the assembling of the box body 11 is completed. As described above, according to the present invention, complicated folding working is not required and hence, the box body 11 can be automatically manufactured by a box manufacturing apparatus 101.

(Embodiment of Box Manufacturing Apparatus 101)

Figure 19:
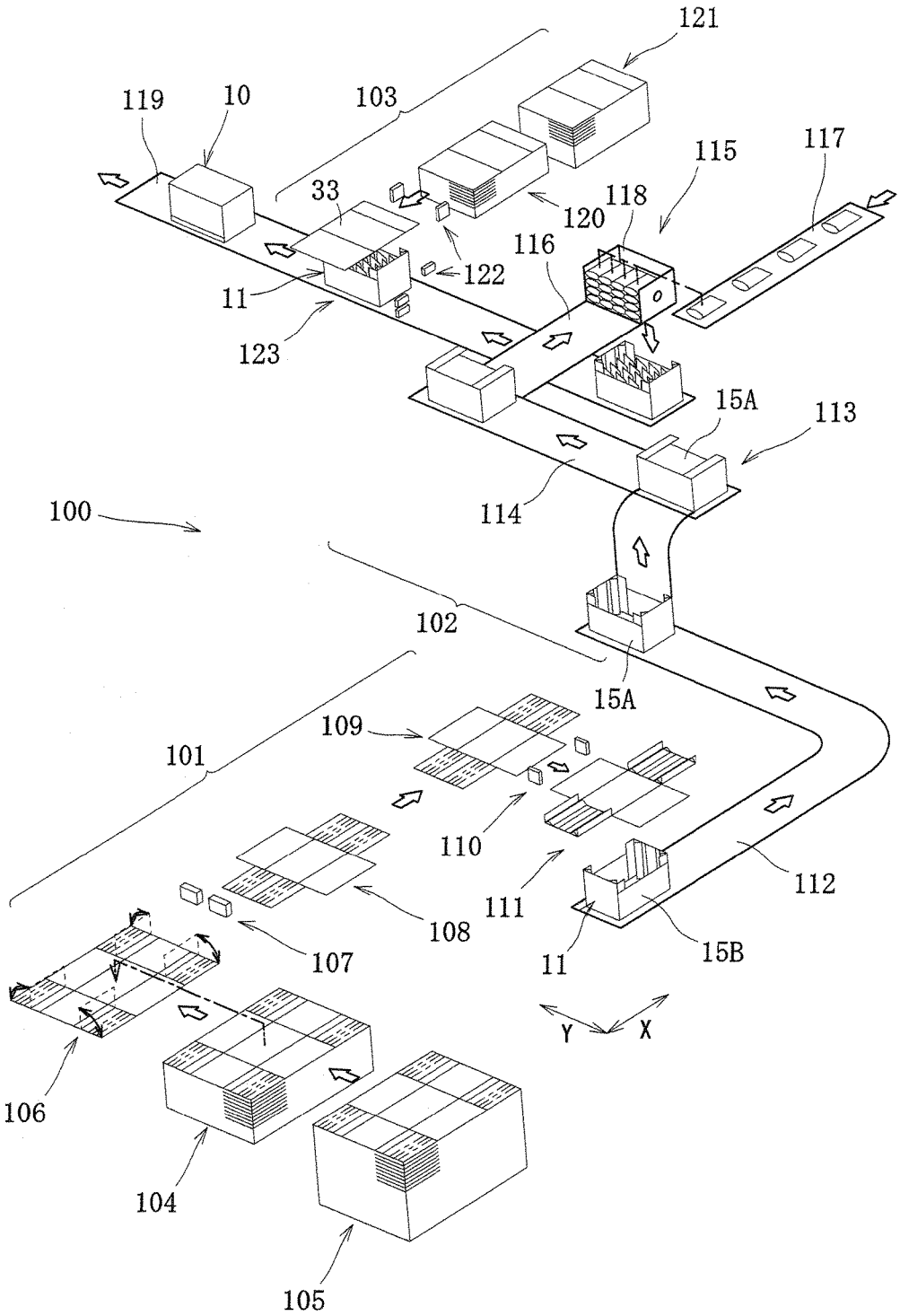
FIG. 19 is a schematic view showing a set-up caser which uses a box manufacturing apparatus according to the present invention.

Next, a box manufacturing apparatus 101 which automatically manufactures the box body 11 shown in FIG. 1 is described. As shown in FIG. 19, the box manufacturing apparatus 101 is used in a set-up caser 100 which performs all steps ranging from a step of manufacturing the box body 11 to a step of sealing the box body 11 using the lid body 33 through a step of storing products in the box body 11.

(Configuration of Set-Up Caser 100)

The set-up caser 100 schematically includes: the box manufacturing apparatus 101; a storing device 102; and a sealing device 103. The box manufacturing apparatus 101 includes: a board feeding part 104; a temporarily folding part 106; a first coating part 107; a fixing part 108; a direction changing part 109; a second coating part 110; and a forming part 111. The storing device 102 includes: a direction changing part 113; and a boxing portion 115. The sealing device 103 includes: a board feeding part 120; a coating part 122; and a sealing part 123. In this embodiment, products to be stored in the packing box 10 are standing pouches filled with a liquid. However, the products to be stored in the packing box 10 are not limited to the standing pouches.

The board feeding part 104 includes a replenishing part 105 where blanks for forming the box bodies 11 (hereinafter abbreviated as "box blanks") are arranged. In the board feeding part 104, the box blanks transported from the replenishing part 105 in a stacked state are taken out one by one, and are supplied to the temporarily folding part 106 one by one. The box blank is transported in a state where the Y direction extending between side panels 15A, 15B is set as the transport direction.

In the temporarily folding part 106, reinforcing panels 26 of the supplied box blank are folded along third fold lines 31 each of which is formed between first and second fold lines 29, 30 thus imparting a folding habit along the fold lines 31. Thereafter, the box blank is transported to the fixing part 108 by setting the X direction which extends between end panels 13A, 13B as the transport direction while being held in the same posture.

In the first coating part 107, during the transportation of the box blank from the temporarily folding part 106 to the fixing part 108, an adhesive agent made of a hot-melt resin is applied (hot melted) by coating to the box blank. In the box blank, an adhesive agent is applied by coating to edge panels 20 and portions of end panels 13A, 13B with which inner panels 27 overlap.

In the fixing part 108, fold-back panels 25 are folded against the edge panels 20 thus making each reinforcing column forming portion 24 overlap with the edge panel 20 and the end panel 13A, 13B as a whole. Due to such an operation, the fold-back panels 25 and the inner panels 27 are adhered to the edge panels 20 and the end panels 13A, 13B to which an adhesive agent is applied by coating. Thereafter, the box blank is transported to the direction changing part 109 by setting the X direction as the transport direction while being held in the same posture.

In the direction changing part 109, the transport direction of the box blank is changed from the X direction to the Y direction while the box blank is being held in the same posture. Due to such an operation, the box blank is transported to the forming part 111 while setting the Y direction as the transport direction.

In the second coating part 110, during the transportation of the box blank from the direction changing part 109 to the forming part 111, an adhesive agent made of a hot-melt resin is applied by coating to the box blank. On the box blank, an adhesive agent is applied by coating to portions of the side panels 15A, 15B with which the edge panels 20 overlap.

In the forming part 111, firstly, the edge panels 20 are folded against the end panels 13A, 13B thus making the reinforcing panels 26 disposed on inner surface sides of the end panels 13A, 13B project inward. Next, the end panels 13A, 13B are folded against a bottom panel 12 and, thereafter, the side panels 15A, 15B are folded against the bottom panel 12. Due to such operations, the edge panels 20 are adhered to the side panels 15A, 15B to which an adhesive agent is applied by coating.

The box body 11 assembled by the box manufacturing apparatus 101 as described above is discharged in a state where the bottom panel 12 is positioned on a lower side, and is transported to the direction changing part 113 of the storing device 102 arranged downstream of the box manufacturing apparatus 101 by a conveyor 112. As the conveyor 112, a roller conveyor where a large number of rollers are arranged parallel to each other is used, for example. Although the conveyor 112 adopts a transport path which is bent in an L shape, the conveyor 112 is not limited to such a configuration.

In the direction changing part 113, a posture of the box body 11 is changed to a horizontally laid state, and the box body 11 is transported. To be more specific, the box body 11 is transported by the conveyor 112 in a posture where the bottom panel 12 is positioned on the lower side, and opening of the box body 11 surrounded by the end panels 13A, 13B and the side panels 15A, 15B is positioned on an upper side. In the direction changing part 113, the box body 11 on the conveyor 112 is picked up, and is arranged on a conveyor 114 in a horizontally laid state where the side panel 15A is positioned on the upper side, and the opening is positioned on a boxing portion 115 side. The box body 11 is transported to the boxing portion 115 in the horizontally laid posture by the conveyor 114.

The boxing portion 115 includes: two conveyors 116, 117; and a temporarily arranging box 118. The conveyor 116 transports the box body 11 to the temporarily arranging box 118 in a state where an opening side of the box body 11 is disposed on a front side in the transport direction. The conveyor 117 transports products to be stored in the box body 11 to the temporarily arranging box 118 in a row. The products picked up by a suction device not shown in the drawing from the conveyor 117 are arranged in the temporarily arranging box 118 in a row. The box body 11 is arranged so as to store the temporarily arranging box 118, and the temporarily arranging box 118 is rotated such that only the products are stored in the box body 11.

The box body 11 in which the products are stored in the storing device 102 as described above is discharged in a state where the bottom panel 12 is positioned on the lower side, and is transported to the sealing device 103 arranged downstream of the storing device 102 by a conveyor 119.

The board feeding part 120 includes a replenishing part 121 where blanks for forming lid bodies 33 (hereinafter abbreviated as "lid blanks") are arranged. In the board feeding part 120, the lid blank transported from the replenishing part 121 in a stacked state are taken out one by one, and are supplied to the sealing part 123 one by one. The lid blank is transported in a state where a direction extending between adhesion portions 35, 36 extends in the transport direction, and the first adhesion portion 35 is positioned on a front side in the transport direction.

In the coating part 122, during the transportation of the lid blank from the board feeding part 120 to the sealing part 123, an adhesive agent made of a hot-melt resin is applied by coating to the lid blank. In the lid blank, the adhesive agent is applied by coating to portions of the adhesion portions 35, 36 of the lid body 33 where the side panels 15A, 15B overlap.

The box body 11 in which the products are stored is transported to the sealing part 123 by the conveyor 119 in a state where the opening of the box body 11 is positioned on an upper side. The lid body 33 transported from the board feeding part 120 is arranged over the opening of the box body 11. In the sealing part 123, the adhesion portions 35, 36 of the lid body 33 are folded against the lid main body 34. Due to such operations, the adhesion portions 35, 36 of the lid body 33 to which the adhesive agent is applied by coating are adhered to the side panels 15A, 15B of the box body 11.

As described above, in the set-up caser 100, the box blank punched out from a corrugated board sheet can be automatically manufactured into the box body 11 and products can be stored in the box body 11 and, thereafter, the box body 11 can be sealed by the lid body 33. Accordingly, a box manufacturer can deliver box blanks and lid blanks to a product manufacturer in a flat state and hence, a cost of the packing box 10 can be further reduced.

(Overall Configuration of Box Manufacturing Apparatus 101)

Next, specific configurations of respective parts 104 to 111 of the box manufacturing apparatus 101 according to this embodiment are described.

Figure 20:
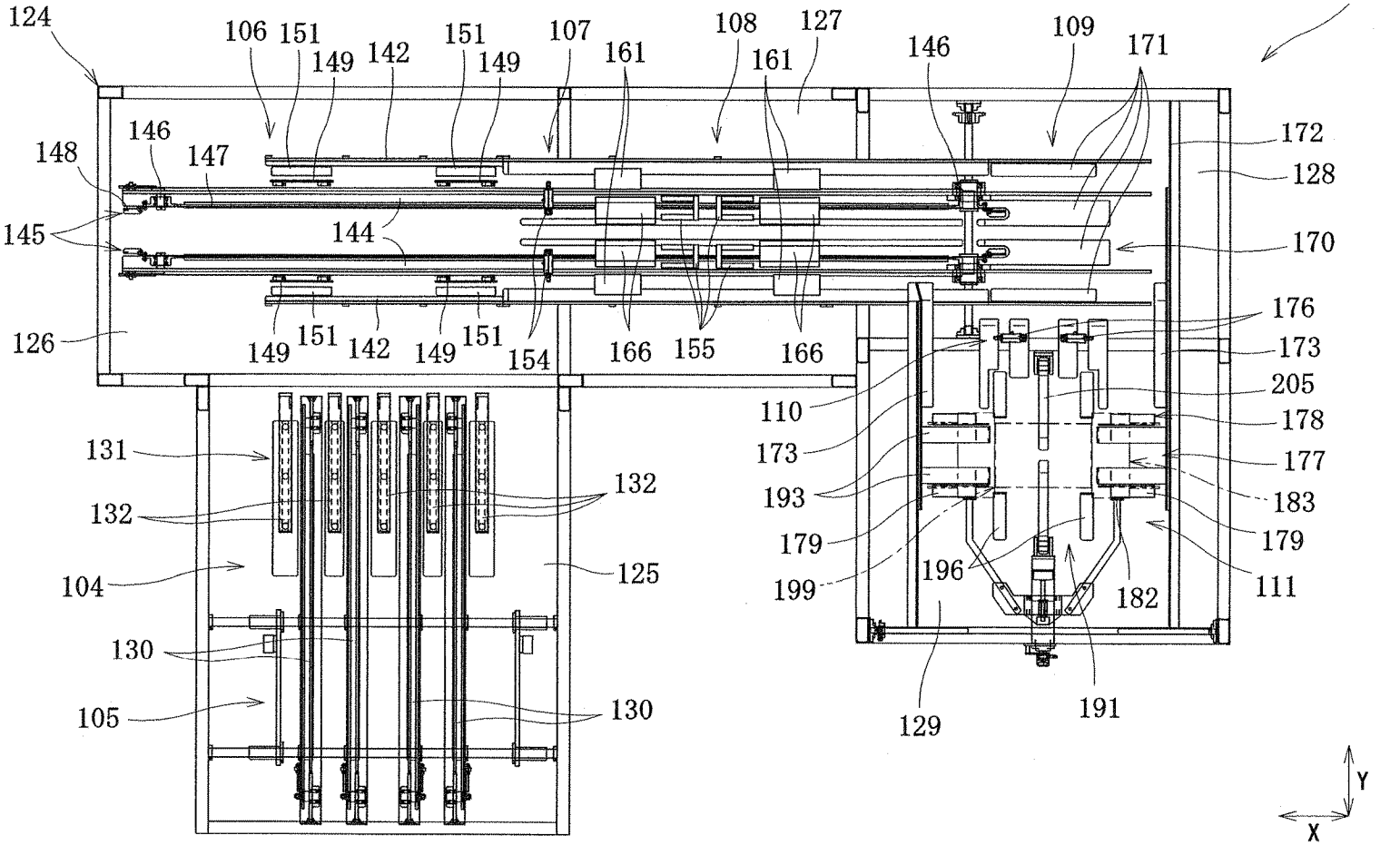
FIG. 20 is a plan view showing the box manufacturing apparatus.

As shown in FIG. 20, the box manufacturing apparatus 101 has a casing 124 which is divided into five zones. First and second zones 125, 126 are disposed adjacently to each other in the Y direction, second to fourth zones 126 to 128 are disposed adjacently to each other in the X direction in the order, and fourth and fifth zones 128, 129 are further disposed adjacently to each other in the Y direction. The board feeding part 104 including the replenishing part 105 is disposed in the first zone 125, the temporarily folding part 106 is disposed in the second zone 126, the fixing part 108 is disposed in the third zone 127, the direction changing part 109 is disposed in the fourth zone 128, and the forming part 111 is disposed in the fifth zone 129.

In the box manufacturing apparatus 101, the box blank is transported in a state where the box blank is held in the same posture. To be more specific, in the replenishing part 105 disposed in the first zone 125, the box blank is arranged such that the Y direction of the box blank extending between the side panels 15A, 15B extends between a front side (depth side) and a rear side (viewer's side) in the transport direction. While keeping such a posture, the box blank is transported from the first zone 125 to the second zone 126 in the Y direction. Next, the box blank is transported from the second zone 126 to the fourth zone 128 while setting the X direction of the box blank extending between end panels 13A, 13B as the transport direction. Then, the box blank is transported from the fourth zone 128 to the fifth zone 129 while setting the Y direction of the box blank as the transport direction again.

(Configuration of Board Feeding Part 104)

Figure 21:
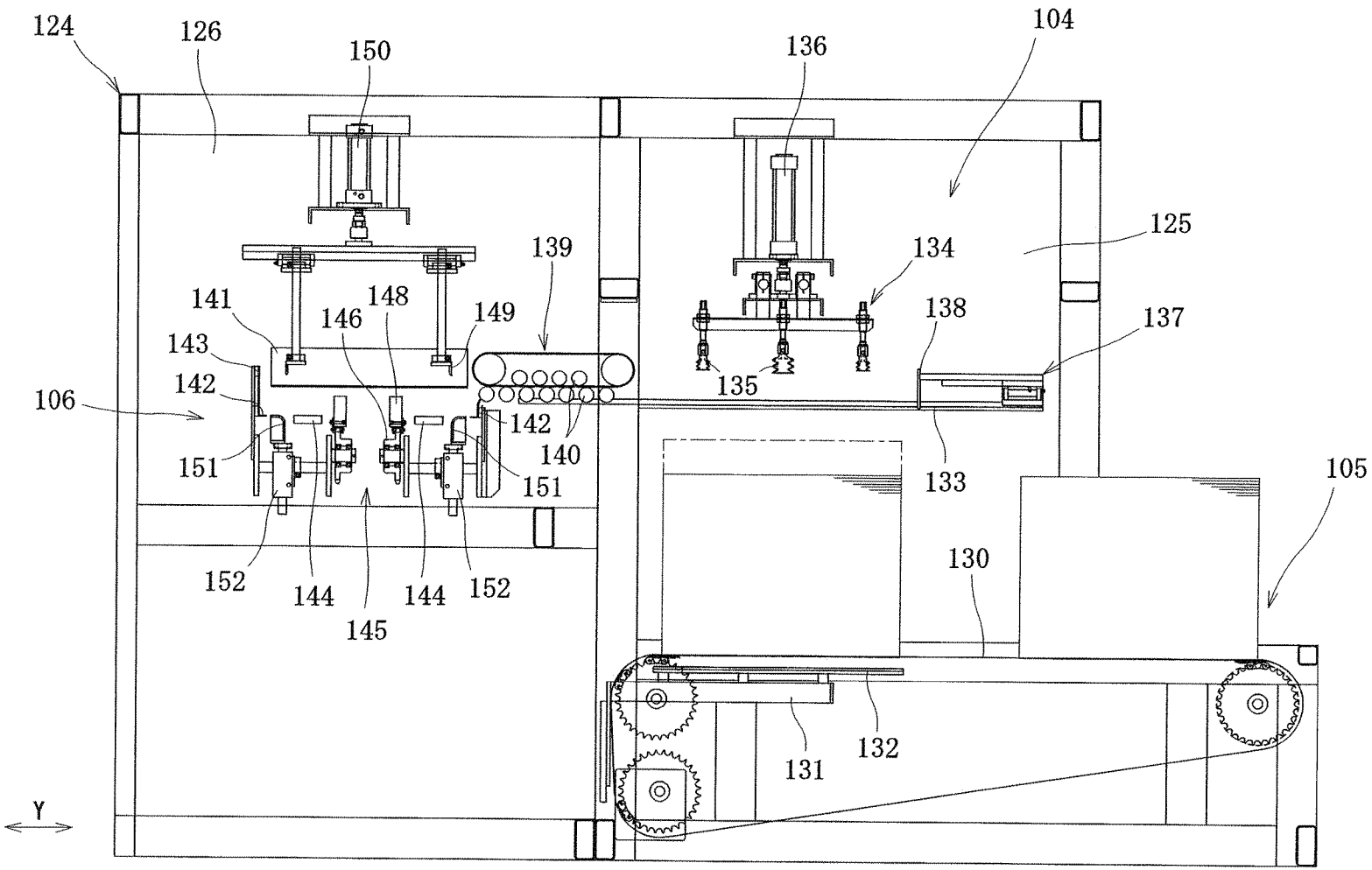
FIG. 21 is a side view showing a board feeding part and a temporarily folding part.

As shown in FIG. 20 and FIG. 21, the board feeding part 104 includes a plurality of (four in this Embodiment conveyors 130 extending between both ends of the first zone 125 in the Y direction. The replenishing part 105 where box blanks are arranged is disposed on a side of the conveyor 130 opposite to the second zone 126 (viewer's side). The board feeding part 104 is disposed on the second zone 126 side of the conveyors 130. The board feeding part 104 includes a lift 131 which lifts a bundle of box blanks to a board feeding position indicated by a chain line in FIG. 21. The lift 131 includes a pedestal 132 between the conveyors 130, 130 and on both sides of the conveyors 130, 130, and the pedestal is lifted and lowered by a drive means not shown in the drawing.

As shown in FIG. 21, the board feeding part 104 includes a pair of guide rails 133, 133 which supports both sides of the box blank above the conveyors 130. The guide rail 133 is a member extending in the Y direction and having an L shape in cross section, and is rotatable using the longitudinal direction as an axis of rotation. The board feeding part 104 includes a takeout member 134 for arranging one box blank on the guide rail 133 above the lift 131. The takeout member 134 includes suction members 135 connected to a suction pump not shown in the drawing. The suction member 135 can be lifted and lowered by a cylinder 136 within a range from a board feeding position to an upper side of the guide rail 131.

The board feeding part 104 includes a push-out part 137 which moves the box blank on the guide rails 133 to a temporarily folding part 106 side and a feeding part 139. The push-out part 137 is arranged on a front side (right side in FIG. 21) of the guide rails 133 in the transport direction. The push-out part 137 includes a slider 138 which can be advanced and retracted by a drive means not shown in the drawing along the guide rails 133. The feeding part 139 is arranged on a depth side (left side in FIG. 21) of the guide rails 133 in the transport direction. The feeding part 139 includes a plurality of feed rollers 140 which are rotated by a drive means not shown in the drawing.

In the board feeding part 104, when the lift 131 runs out of box blanks, a bundle of box blanks arranged in the replenishing part 105 in a stacked state is transported by the conveyor 130. Then, the bundle of box blanks is lifted by the lift 131 until an upper end of the bundle of box blanks reaches the board feeding position, and the guide rails 133 are rotated to a non-holding position where the guide rails 133 are opened outward. Thereafter, one box blank is sucked by the takeout member 134, and is lifted to a position above the guide rail 133. Next, the guide rails 133 are rotated to a holding position and the suction of the box blank by the takeout member 134 is stopped thus arranging the box blank on the guide rails 133. Thereafter, the slider 138 of the push-out part 137 is advanced thus moving the box blank on the guide rails 133 to the temporarily folding part 106. When a distal end of the box blank enters the feeding part 139 by being pressed by the push-out part 137, the box blank is fed to the temporarily folding part 106 by the feed rollers 140.

(Transport Means in Second to Fourth Zones 126 to 128)

Figure 22:
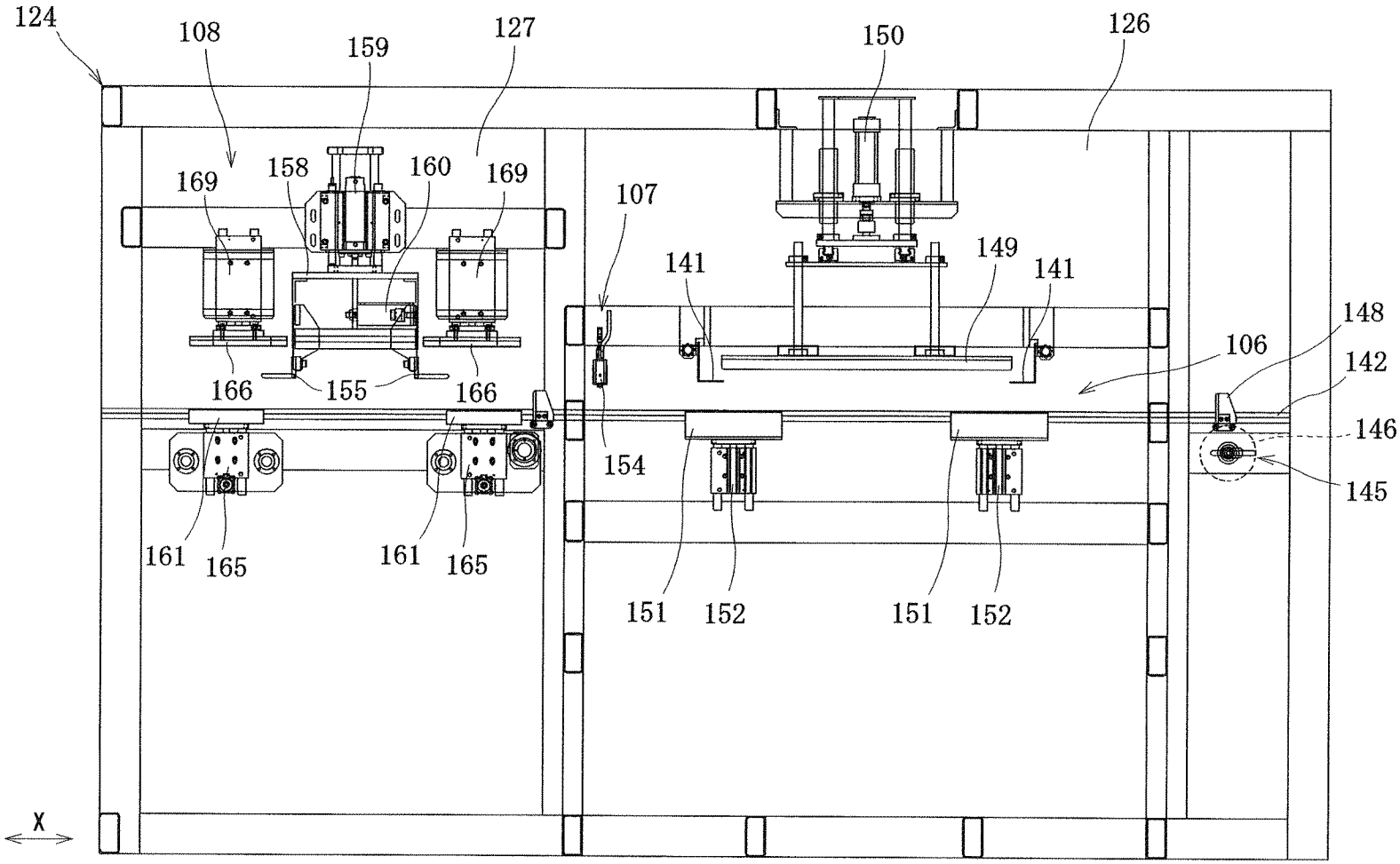
FIG. 22 is a side view showing the temporarily folding part and a fixing part.

As shown in FIG. 21 and FIG. 22, the second zone 126 where the temporarily folding part 106 is disposed includes a pair of guide rails 141, 141 which receives the box blank supplied from a first zone 125 side. The guide rails 141 are members extending in the Y direction and having an L shape in cross section, and are rotatable using the longitudinal direction as an axis of rotation. A pair of guide rails 142, 142 which receives the box blank is arranged below the guide rails 141. To describe the configuration of the guide rails 142 with reference to FIG. 20, the guide rails 142 extend from the second zone 126 to the fourth zone 128 in the X direction. A stopper 143 extending upward exceeding a transport surface of the guide rail 141 is mounted on the guide rails 142 positioned on a left side in FIG. 21. The stopper 143 makes the box blank transported to the guide rail 141 by the feed rollers 140 stop on the guide rails 141.

As shown in FIG. 20 and FIG. 22, a pair of support rails 144, 144 which supports a lower surface of the box blank is disposed between the guide rails 142, 142. Transport parts 145 which move the box blank in the X direction are arranged inside the respective support rails 144, 144. The transport part 145 includes: gears 146, 146 arranged at an end portion of the second zone 126 and at an approximately intermediate portion of the fourth zone 128; and an endless chain 147 extending between and wound around the respective gears 146, 146. A pair of transport parts 145 each of which is formed of the gears 146 and the chain 147 is arranged with a predetermined distance therebetween in the Y direction. Transport members 148 projecting outward are mounted on the chain 147. A plurality of transport members 148 are mounted on the chain 147 at intervals longer than a total length of the box body 11 in the X direction. The moving member 148 is brought into contact with a rear side end of the box blank in the transport direction, and moves the box blank in the X direction along with the rotation of the chain 147.

(Configuration of Temporarily Folding Part 106)

As shown in FIG. 21 and FIG. 22, the temporarily folding part 106 includes: plates 149 positioned above transport surfaces of the guide rails 142; and folding members 151 positioned below the transport surfaces of the guide rails 142.

The plate 149 is positioned above an area in the vicinity of a fold line 31 on a second panel portion 26*b* of the reinforcing panel 26 of the box blank arranged on the guide rail 142. Lower ends of the plates 149 can be lifted and lowered by a cylinder 150 within a range from a position above the transport surface of the guide rail 141 by a predetermined distance to an upper surface of the box blank. A total length of the plate 149 is shorter than the total length of the box blank in the X direction, and is longer than a total length of the bottom panel 12 in the X direction. Accordingly, the positioning of a pair of fold lines 31, 31 positioned on a linear line in the X direction can be performed using one plate 149.

The folding member 151 is positioned in the vicinity of the fold line 31 below a first panel portion 26*a* of the reinforcing panel 26 below the reinforcing column forming portion 24 of the box blank arranged on the guide rails 142. Upper ends of the folding member 151 can be lifted and lowered by a cylinder 152 within a range from the transport surface of the guide rail 142, that is, from a lower surface of the box blank to a position above the transport surface of the guide rail 142 by a distance corresponding to a size of an inner panel 27 in the Y direction. An arcuate chamfered portion 153 (see FIG. 23A) is formed on an upper end corner portion of the folding member 151 on a fold line 31 side.

Figure 23A:
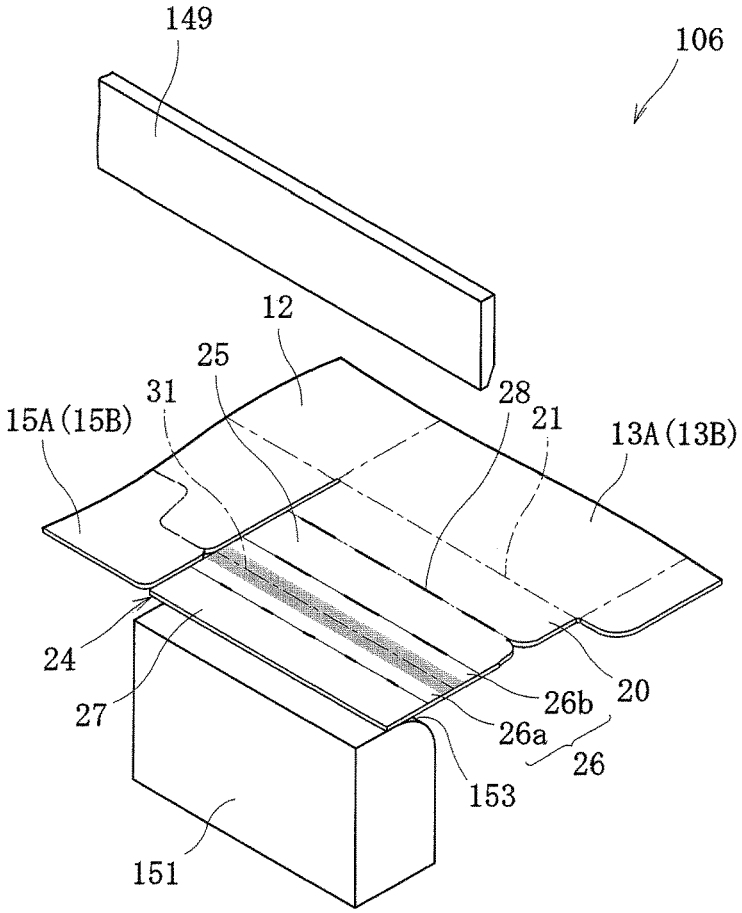
FIG. 23A is a perspective view showing the configuration of the temporarily folding part.
Figure 23B:
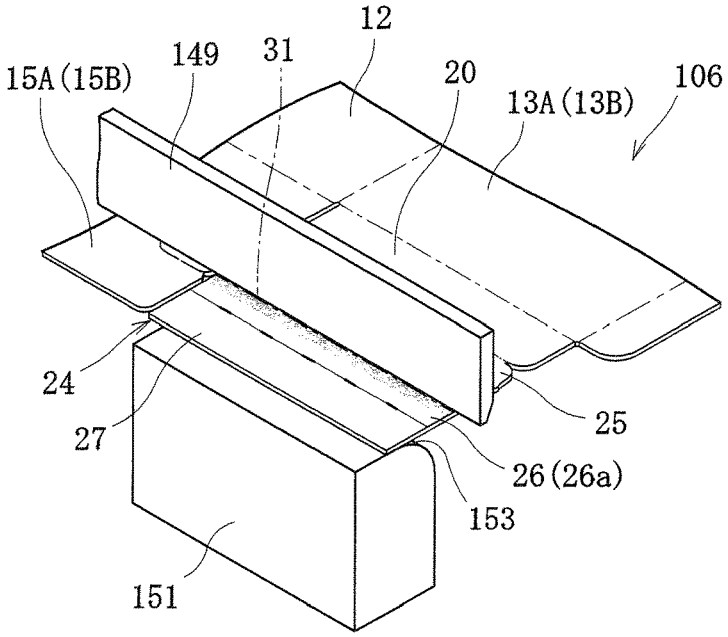
FIG. 23B is a perspective view showing the temporarily folding part in a first operation state.
Figure 23C:
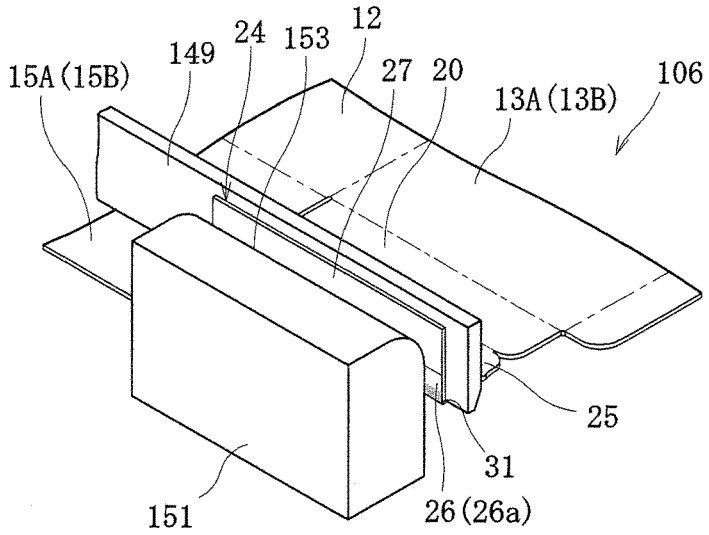
FIG. 23C is a perspective view showing the temporarily folding part in a second operation state.

When the box blank is arranged in the temporarily folding part 106 as shown in FIG. 23A, the plate 149 is lowered and is arranged along the fold line 31 on a lid blank as shown in FIG. 23B. Next, as shown in FIG. 23C, the folding member 151 is lifted thus folding the first panel portion 26*a* against the second panel portion 26*b* about the fold line 31. Due to such an operation, a folding habit extending along the fold line 31 can be imparted to the reinforcing panel 26 of the reinforcing column forming portion 24. By imparting such a folding habit to the reinforcing panel 26, in folding the edge panel 20 against the end panel 13A, 13B in the forming part 111 in succeeding steps, it is possible to make the reinforcing panel 26, project inward such that die fold line 31 forms a top portion.

Next, the folding member 151 is returned to the origin by lowering the folding member 151 and, thereafter, the plate 149 is returned to the origin by lifting the plate 149. Due to such operations, the reinforcing column forming portion 24 of the box blank is restored so as to be flatly positioned with respect to the end panel 13A, 13B due to rigidity (stiffness) of a corrugated board sheet 1. When a series of operations of temporarily folding the box blank is finished, the transport parts 145 are operated, and the box blank is transported to the fixing part 108.

(Configuration of First Coating Part 107)

As shown in FIG. 20 and FIG. 22, the first coating part 107 is disposed between the second zone 126 and the third zone 127. The first coating part 107 includes a pair of coating devices 154, 154 arranged with a predetermined distance therebetween in the Y direction orthogonal to the X (transport) direction. The respective coating devices 154, 154 can jet an adhesive agent toward two different portions of the box blank. The coating device 154 positioned on a left side with respect to the transport direction jets the adhesive agent toward areas on both sides of the fold line 21 on a left side of the end panel 13A, 13B. The coating device 154 positioned on a right side with respect to the transport direction jets the adhesive agent toward areas both sides of the fold line 21 on the right side of the end panel 13A, 13B. Due to such operations, the adhesive agent is linearly applied by coating to both side portions of the end panel 13A, 13B and the center of each edge panel 20 in the box blank.

(Configuration of Fixing Part 108)

As shown in FIG. 20 and FIG. 22, the fixing part 108 includes: positioning members 155 each of which performs positioning of an area on the edge panel 20 in the vicinity of a fold line 28; folding members 161 which fold the fold-back panels against the edge panels 20; and pressing members 166 which press the reinforcing column forming portions 24. The fixing part 108 includes a stopper (not shown in the drawing) which is arranged movably in the vertical direction, and stops the transported box blank at a fixed position.

Figure 24A:
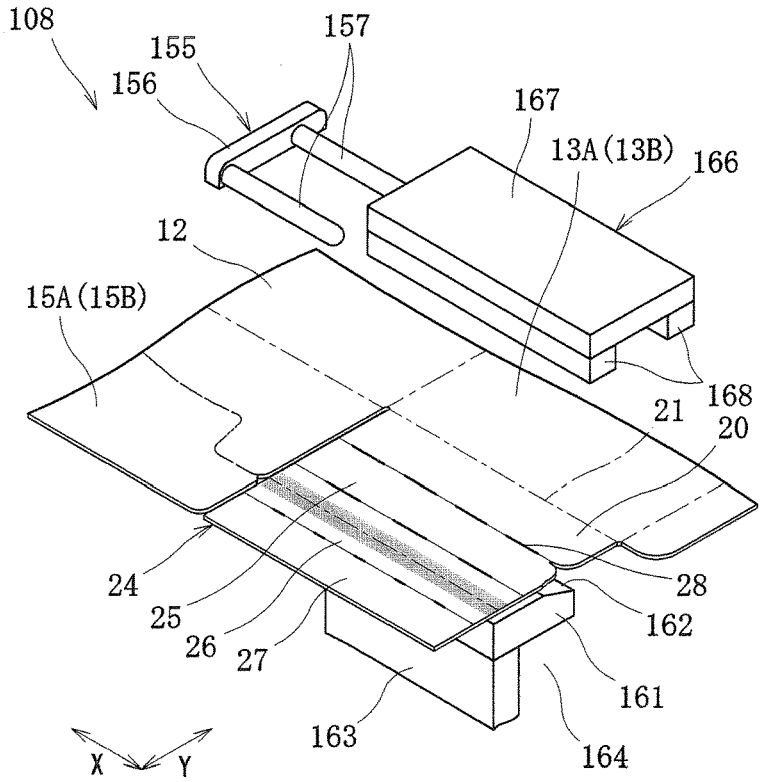
FIG. 24A is a perspective view showing the configuration of the fixing part.

As shown in FIG. 20 and FIG. 22, the positioning members 155 are arranged so as to be positioned in the vicinity of four corners of the bottom panel 12 of the box blank respectively. As shown in FIG. 24A, each positioning member 155 includes a connecting portion 156 extending in the Y direction orthogonal to the X (transport) direction. Each connecting portion 156 is arranged so as to extend between the bottom panel 12 and the side panel 15A, 15B in a straddling manner. A pair of arms 157, 157 is formed on each connecting portion 156. The arms 157 of the positioning members 155 which are disposed on a front side in the transport direction project toward the front side in the transport direction. The arms 157 of the positioning members 155 which are disposed on a rear side in the transport direction project toward a rear side in the transport direction. One arm 157 projects from a side panel 15A, 15B side, and the other arm 157 projects from a bottom panel 12 side.

As shown in FIG. 22, four positioning members 155 are connected to one frame body 158. The frame body 158 can be lifted and lowered by a cylinder 159 within a range from a position above the bottom panel 12 by a predetermined distance to an upper surface of the bottom panel 12. In the inside of the frame body 158, cylinders 160 each of which makes the positioning member 155 advance or retract along the transport direction are disposed. When the cylinders 160 are in a retracted state, the arms 157 of the positioning members 155 are positioned above the bottom panel 12 and the side panels 15A, 15B. When the cylinders 160 are in an advanced state, the arms 157 of the positioning members 155 covering half of or more than half of a total length of arms 157 are positioned on the end panel 13A, 13B and the edge panel 20.

As shown in FIG. 20 and FIG. 22, the folding members 161 are arranged below the respective reinforcing column forming portions 24 of the box blank. To describe the configuration of the folding member 161 with reference to FIG. 24A, the folding member 161 has a rectangular columnar shape extending in the transport direction, and has a chamfered portion 162 on an end panel 13A, 13B side of an upper surface thereof. The folding member 161 includes a connecting member 163 projecting downward from an outer side of a lower surface of the folding member 161 as viewed in the transport (X) direction. A space 164 for preventing the interference of the folding member 161 with the support rail 144 is formed below the folding member 161 on an end panel 13A, 13B side of the connecting member 163. The connecting members 163 are connected to drive parts 165 respectively. The drive part 165 moves the folding member 161 upward and inward in the Y direction by setting a state where an upper surface of the folding member 161 agrees with the transport surface of the guide rail 142 and an inner side surface of the folding member 161 extending along the Y direction is positioned in the vicinity of the fold line 28 on the reinforcing column forming portion 24 as an origin.

As shown in FIG. 20 and FIG. 22, the pressing members 166 are arranged so as to be positioned on both sides of the end panel 13A, 13B of the box blank respectively. As shown in FIG. 24A, the pressing member 166 includes a substrate 167 extending between the end panel 13A, 13B to the approximately center of the edge panel 20. A pair of pressing parts 168, 168 which presses a side portion of the end panel 13A, 13B and the center of the edge panel 20 of the box blank to which an adhesive agent is applied by coating are formed on the substrate 167 in a projecting manner. The pressing member 166 can be lifted and lowered by a drive part 169 within a range from a position above the box blank by a predetermined distance to the upper surface of the box blank.

Figure 24B:
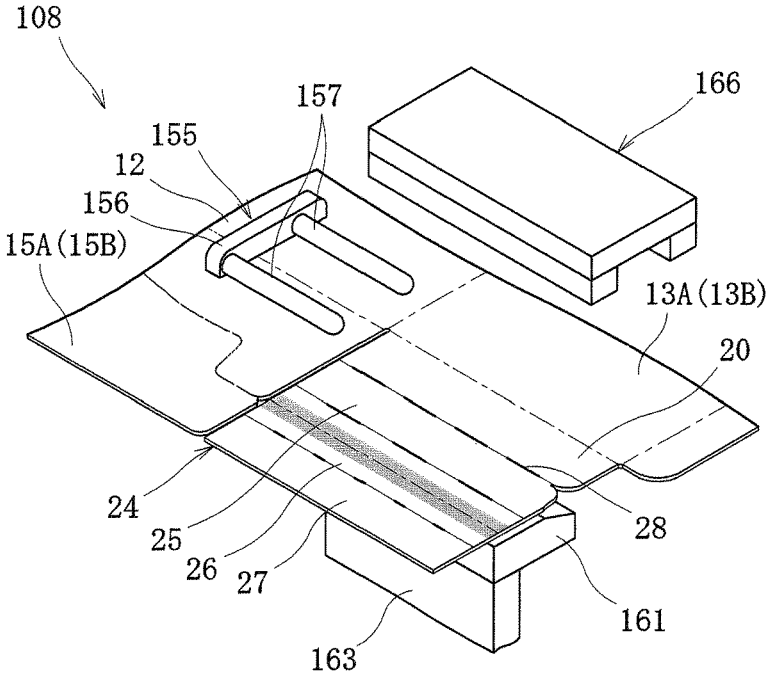
FIG. 24B is a perspective view showing the fixing part in a first operation state.
Figure 24C:
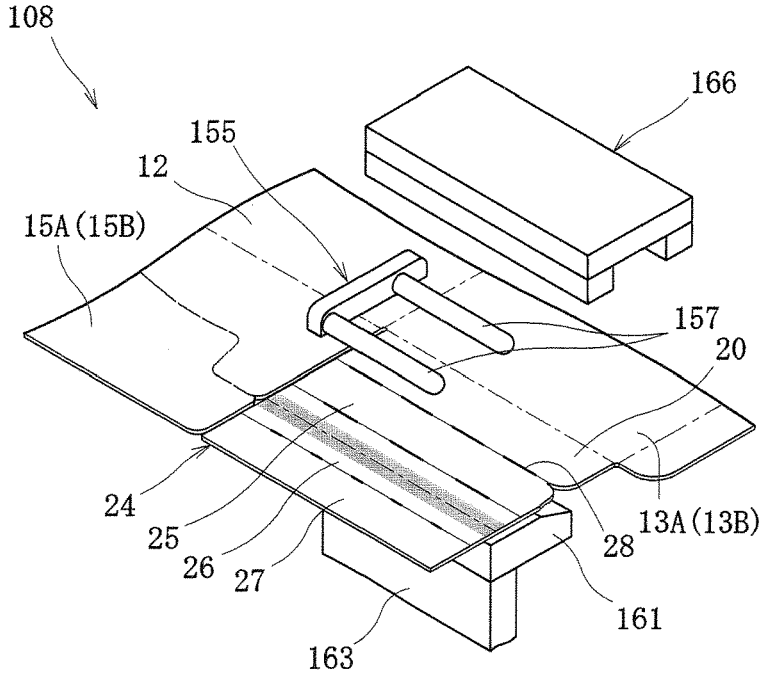
FIG. 24C is a perspective view showing the fixing part in a second operation state.

In the fixing part 108, the box blank transported from the temporarily folding part 106 along the guide rails 142 is arranged. When the box blank is arranged in the fixing part 108, as shown in FIG. 24B, the positioning member 155 is lowered thus arranging the positioning member 155 on upper surfaces of the bottom panel 12 and the side panel 15A, 15B of the box blank. Next, as shown in FIG. 24C, the positioning member 155 is advanced thus arranging the arms 157, 157 on upper surfaces of the end panel 13A, 13B and the edge panel 20 of the box blank. Due to such operations, positioning of the edge panel 20 of the box blank is performed so that the fold-back panel 25 can be folded against the edge panel 20 along the fold line 28 with certainty. Further, it is possible to prevent the reinforcing panel 26 from being folded along the fold line 31 to which a folding habit is imparted.

Figure 24D:
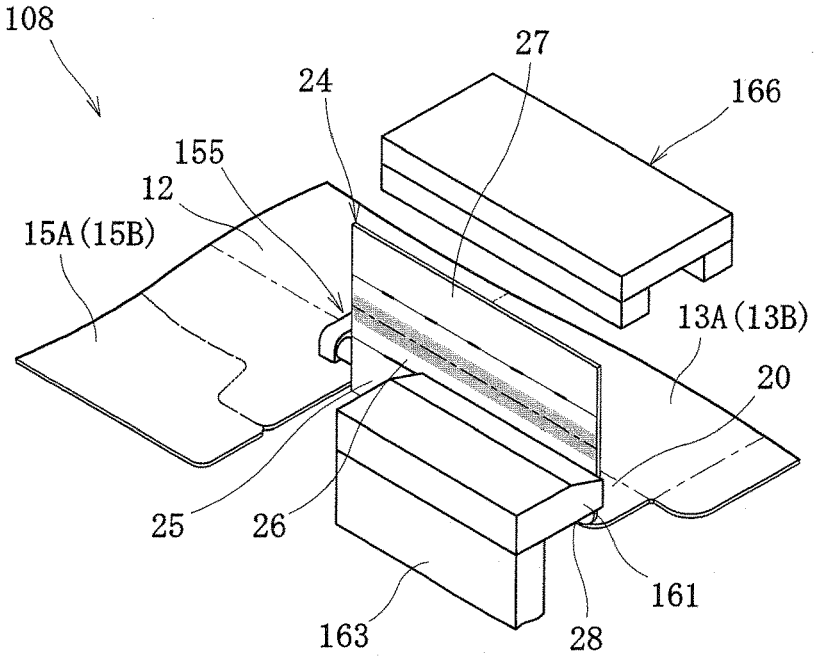
FIG. 24D is a perspective view showing the fixing part in a third operation state.
Figure 24E:
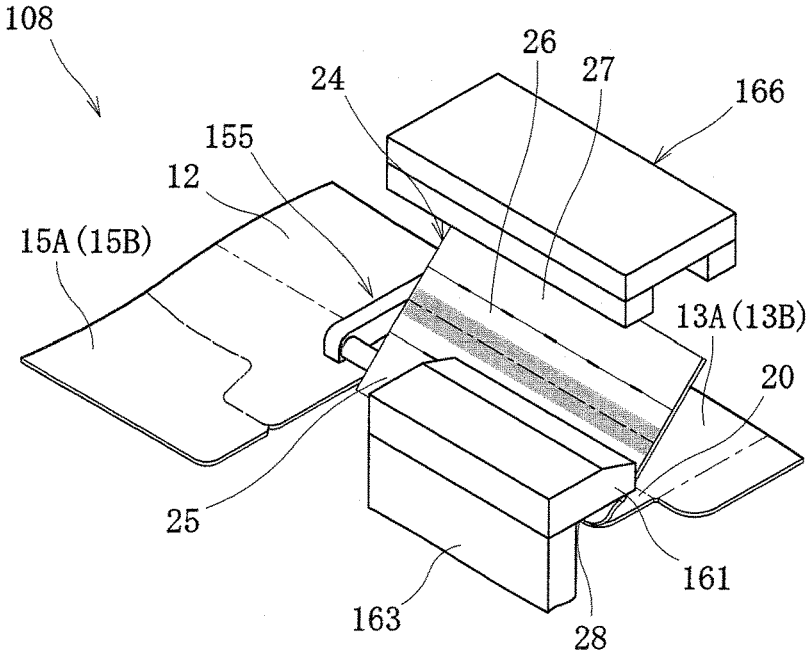
FIG. 24E is a perspective view showing the fixing part in a fourth operation state.
Figure 24F:
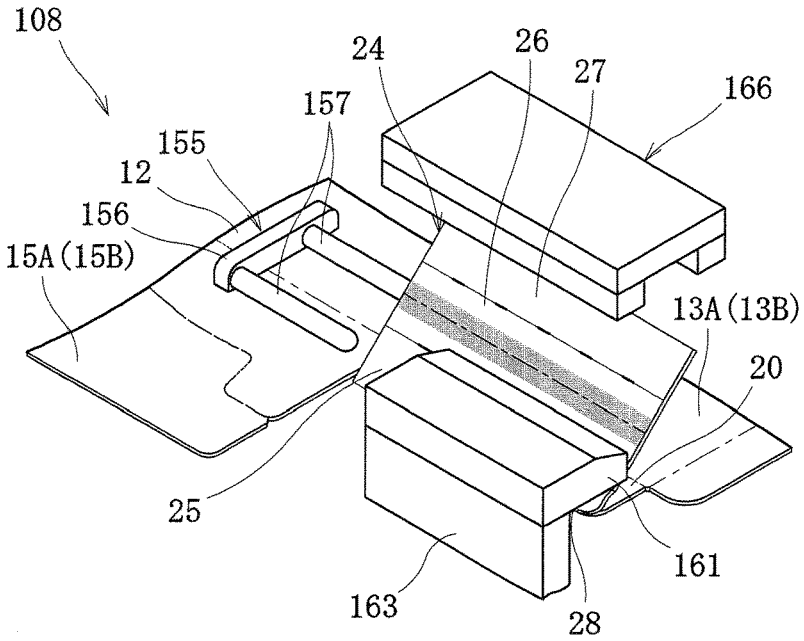
FIG. 24F is a perspective view showing the fixing part in a fifth operation state.

Next, as shown in FIG. 24D, the folding member 161 is moved upward from below the fold-back panel 25 (origin) thus folding the reinforcing column forming portion 24 upward against the edge panel 20 (first folding step). Next, as shown in FIG. 24E, the folding member 161 is moved inward in the Y direction toward the end panel 13A, 13B thus inwardly folding the reinforcing column forming portion 24 against the edge panel 20 (second folding step). Then, as shown in FIG. 24F, the positioning member 155 is retracted thus making the arms 157, 157 positioned on the upper surfaces of the bottom panel 12 and the side panel 15A, 15B of the box blank.

Figure 24G:
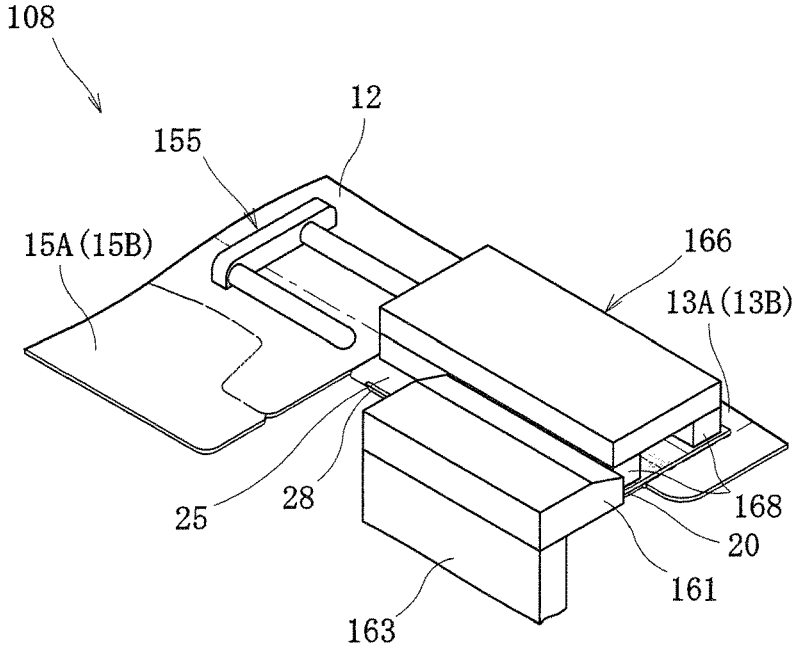
FIG. 24G is a perspective view of the fixing part in a sixth operation state.

Thereafter, as shown in FIG. 24G, the folding member 161 is moved downward (third folding step) and, at the same time, the pressing member 166 is moved downward substantially simultaneously. At this stage of operation, the folding member 161 and the pressing member 166 are positioned with a gap formed therebetween so as to prevent the interference between the folding member 161 and the pressing member 166. Due to such operations, the fold-back panel 25 is made to overlap with the edge panel 20 of the box blank and, at the same time, the inner panel 27 is made to overlap with the end panel 13A, 13B. The edge panel 20 and the fold-back panel 25 are pressure-bonded to each other and the end panel 13A, 13B and the inner panel 27 are pressure-bonded to each other by applying an adhesive agent to these portions by coating and by pressing these portions by the pressing member 166. In this manner, the folding member 161 is moved upward from the origin and is moved inward and, thereafter, is moved downward and hence, it is possible to make the fold-back panel 20 overlap with the edge panel 20 with certainty.

Next, the positioning member 155, the folding member 161 and the pressing member 166 are returned to the origin. To be more specific, the positioning member 155 and the pressing member 166 are lifted. The folding member 161 is lifted and, then, is moved outward so as to be separated from the end panel 13A, 13B and, thereafter, is lowered. When a series of folding operations is completed, the transport parts 145 are operated so as to transport the box blank to the direction changing part 109.

(Configuration of Direction Changing Part 109)

As shown in FIG. 20, the direction changing part 109 includes a lift 170 having four mounting parts 171 positioned on distal ends of the guide rail 142 and distal ends of the support rail 144. To describe the configuration of the direction changing part 109 with reference to FIG. 25, using a state where upper surfaces of the mounting parts 171 Agree with the transport surfaces of the guide rails 142 and the transport surfaces of the support rails 144 as the origin, the mounting parts 171 are movable upward by a drive means not shown in the drawing.

As shown in FIG. 20, the direction changing part 109 includes a guide plate 172 extending between both ends of the fourth and fifth zones 128, 129 in the Y direction on a distal end side of the mounting parts 171 in the transport (X) direction along which the box blank is transported by the transport part 145. The guide plate 172 extends upward from below the mounting parts 171 returned to the origin to a position above the lifted mounting parts 171. With such a configuration, the box blank transported along the guide rails 142 is brought into contact with the guide plate 172 so that the box blank is stopped on the lift 170.

Figure 25:
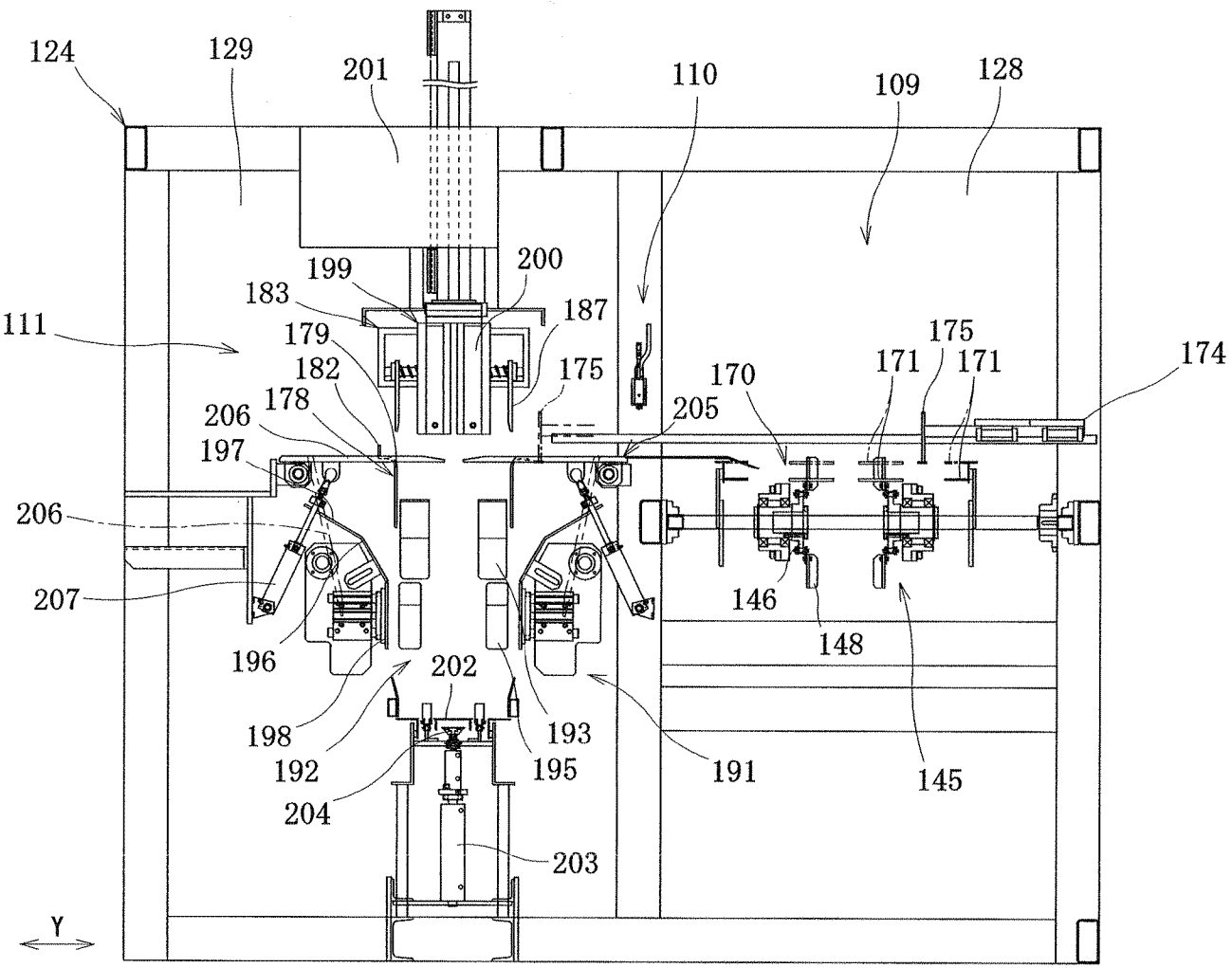
FIG. 25 is a front view showing a direction changing part and a forming part.

As shown in FIG. 20 and FIG. 25, the direction changing part 109 includes a pair of guide rails 173, 173 which agrees with positions where the mounting parts 171 are lifted. The guide rails 173, 173 are positioned with a gap of a size corresponding to a total length of the box blank in the X direction therebetween. The direction changing part 109 includes a push-out part 174 which moves the box blank lifted by the lift 170 to a forming part 111 side along the guide rails 173. The push-out part 174 is disposed on a front side (right side in FIG. 25) of the guide rail 173 in the transport direction. The push-out part 174 includes a slider 175 which can be advanced and retracted by a drive means not shown in the drawing along the guide rails 173. The slider 175 can be advanced to the inside of the fifth zone 129 as shown in FIG. 25 by a chain line.

In the direction changing part 109, when the box blank is moved to the lift 170, the lift 170 is operated, and the box blank is lifted to a height of the guide rail 173. Thereafter, the slider 175 is advanced so that the box blank on the lift 170 is moved in the Y direction to the forming part 111 along the guide rails 173.

(Configuration of Second Coating Part 110)

As shown in FIG. 20 and FIG. 25, the second coating part 110 is disposed between the fourth zone 128 and the fifth zone 129. The second coating part 110 includes a pair of coating devices 176, 176 arranged with a predetermined distance therebetween in the X direction orthogonal to the Y (transport) direction. The respective coating devices 176, 176 jet an adhesive agent toward portions of the side panel 15A, 15B where the edge panels 20 overlap with the side panel 15A, 15B. Due to such operations, the adhesive agent is linearly applied by coating to both side portions of the side panel 15A, 15B of the box blank.

(Configuration of Forming Part 111)

Figure 26:
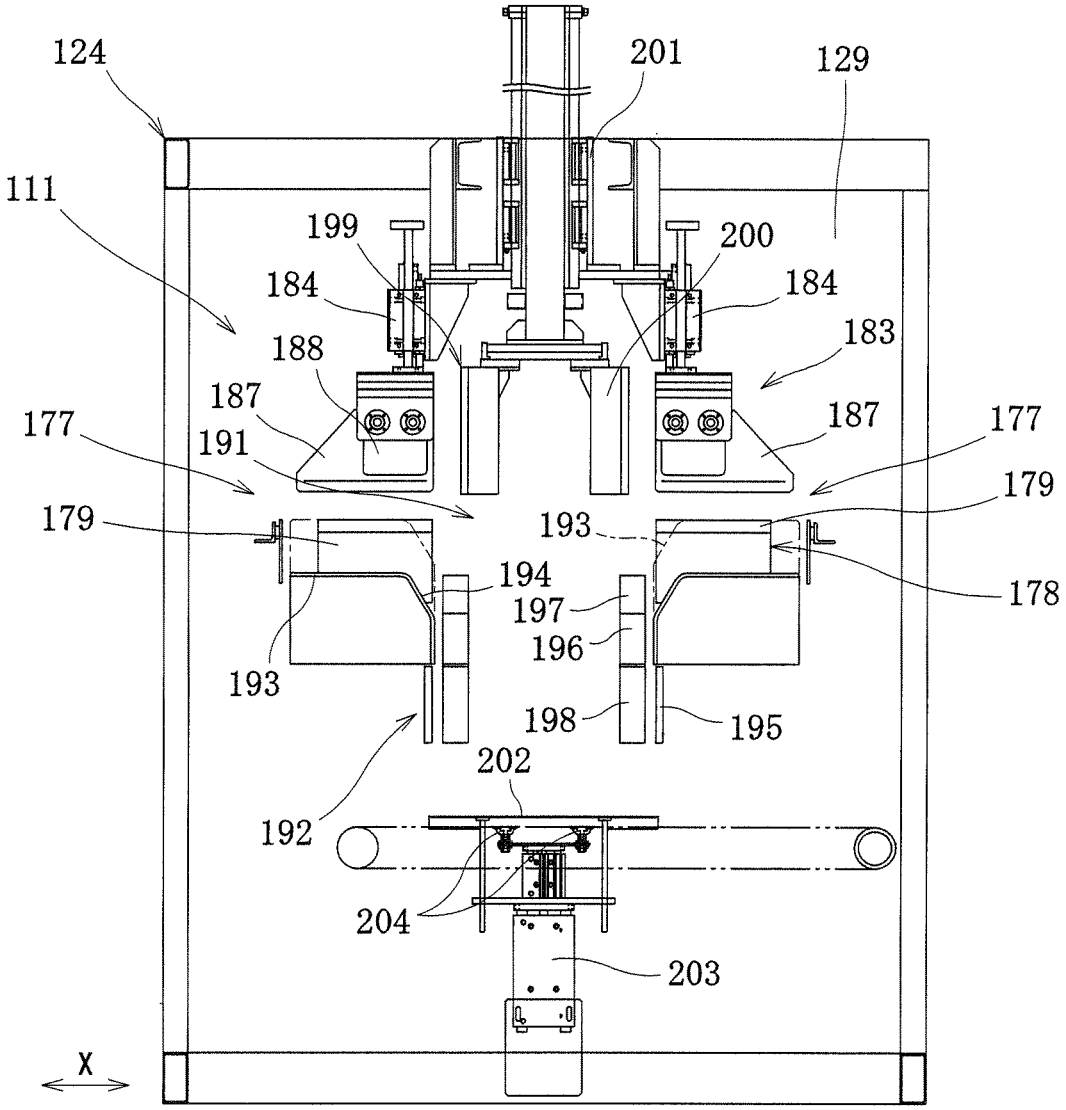
FIG. 26 is a side view showing the forming part.

As shown most clearly in FIG. 26, the forming part 111 includes: first folding portions 177 each of which folds the edge panel 20 against the end panel 13A, 13B; and a second folding portion 191 which folds the end panels 13A, 13B and the side panels 15A, 15B against the bottom panel 12. To describe the configuration of the forming part 111 with reference to FIG. 25, the forming part 111 includes a guide part 205 which guides the box blank so as to be transported to a fixed position from the direction changing part 109.

(Configuration of First Folding Portion 177)

Figure 27A:
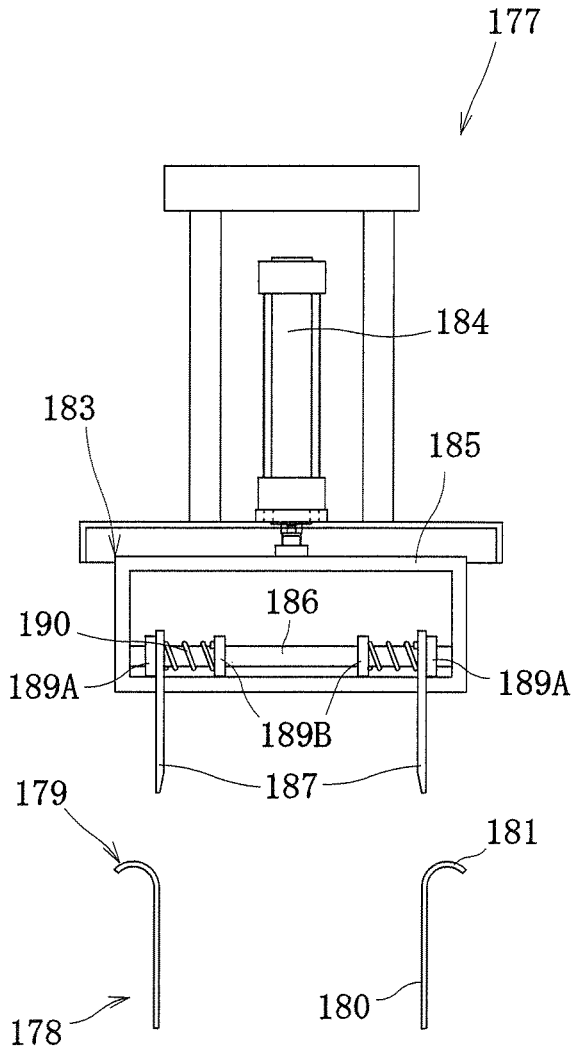
FIG. 27A is a front view showing a first folding portion of a forming part.

As shown in FIG. 26 and FIG. 27A, the first folding portion 177 includes: a fixed lower die 178 arranged below the end panel 13A, 13B and the edge panels 20 disposed on both sides of the end panel 13A, 13B; and a movable upper die 183 positioned above the lower die 178 with a distance from the lower die 178.

As shown most clearly in FIG. 27A, the lower die 178 includes guide plates 179 positioned below the edge panels 20, 20 disposed in front of the upper die 183 in the advancing direction of the upper die 183. The guide plate 179 includes: a flat plate portion 180 positioned in the vicinity of the fold line 21 on the edge panel 20; and a bent portion 181 which is bent in the direction away from the end panel 13A, 13B and is arranged on an upper side of the flat plate portion 180. The bent portion 181 guides the box blank such that the edge panel 20 is folded against the end panel 13A, 13B about the fold line 21. An upper top portion of the bent portion 181 is positioned at the same height as the transport surfaces of the guide rails 173. To describe the configuration of the guide plate 179 with reference to FIG. 25, the guide plate 179 disposed on a distal end side in the transport (Y) direction includes a stopper 182 projecting upward at an end edge of the bent portion 181. The stopper 182 stops the box blank transported to the forming part 111 at a fixed position.

As shown in FIG. 27A, the upper die 183 includes a frame body 185 which can be lifted and lowered by a cylinder 184 between a position above the guide rails 173 and a position below the guide rails 173. The frame body 185 has a rectangular cylindrical shape with both ends thereof in the X direction opened, and includes a mounting shaft 186 extending in the Y (transport) direction in the inside thereof. A pair of forming plates 187 having a plate shape is mounted on the mounting shaft 186 in a slidable manner. Each forming plate 187 has an opening portion 188 which allows a lower panel of the frame body 185 to pass therethrough (see FIG. 26). Each forming plate 187 is arranged between a pair of stoppers 189A, 189B arranged on the mounting shaft 186. Between the forming plate 187 and the inner stopper 189B, a biasing member 190 which biases the forming plate 187 toward the outer stopper 189A is arranged. With such a configuration, using a state where the forming plate 187 is brought into contact with the stopper 189A as the origin, the forming plate 187 is slidable toward a stopper 189B side against a biasing force of the biasing member 190.

Figure 27B:
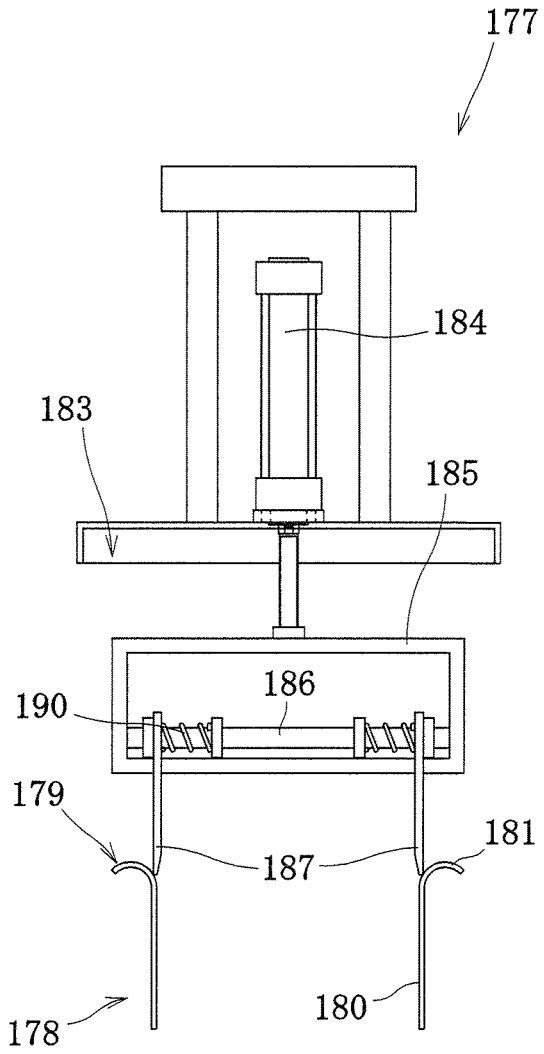
FIG. 27B is a front view showing the first folding portion in a first operation state.
Figure 27C:
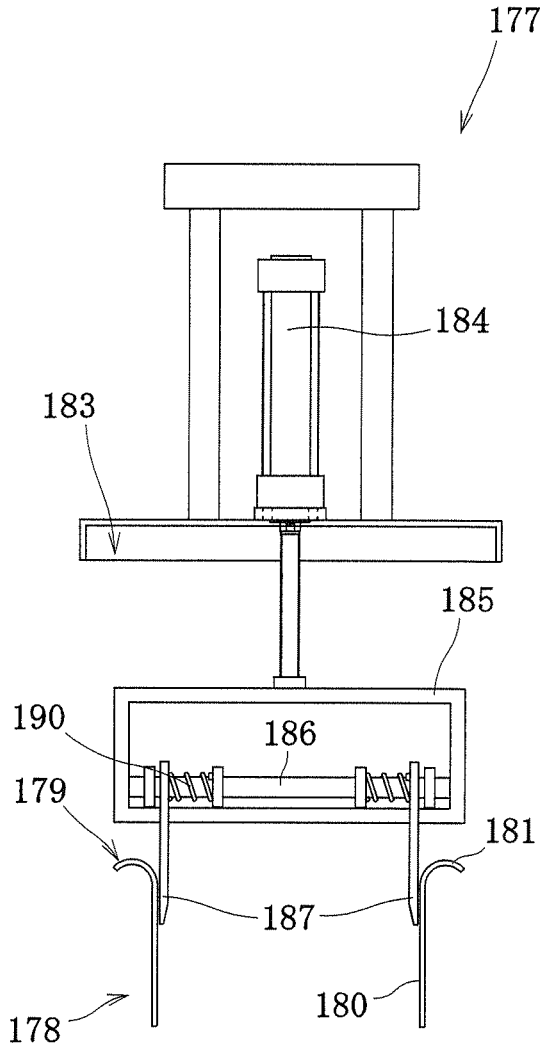
FIG. 27C is a front view showing the first folding portion in a second operation state.
Figure 28A:
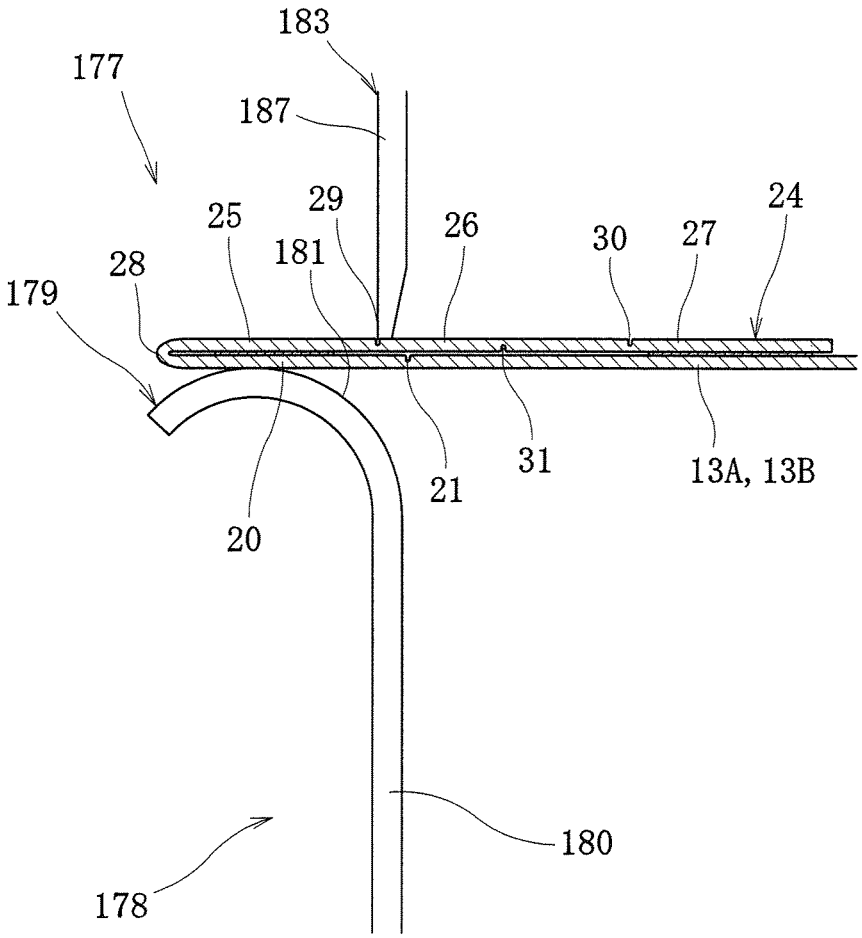
FIG. 28A is an enlarged view of the first folding portion in a first operation state.

As shown most clearly in FIG. 28A, the origin of the forming plate 187 is positioned in the vicinity of the first fold line 29 on the reinforcing panel 26 of the box blank where the reinforcing column forming portion 24 is adhered to the end panel 13A, 13B and the edge panel 20. With such a configuration, the forming plate 187 is slidable in the direction away from the fold-back panel 25 (from a fold-back panel 25 side to a reinforcing panel 26 side). The biasing member 190 biases the forming plate 187 from the reinforcing panel 26 side to the fold-back panel 25 side. As shown in FIG. 27B, the forming plates 187 at the origin are positioned on the bent portions 181 of the guide plates 179 so that when the upper die 183 is lowered in such a state, the forming plates 187 interfere with the bent portions 181. However, when the lowering of the upper die 183 progresses, the forming plates 187 slide inward along the bending of the bent portions 181 and are positioned on inner surface sides of the flat plate portions 180, 180.

As shown in FIG. 28A, in the first folding portion 177, when the box blank is transported to the forming part 111, the upper die 183 is moved downward. Then, the forming plate 187 is brought into contact with a portion of the box blank in the vicinity of the fold line 29 and presses the box blank downward along with the lowering of the forming plate 187. In such a state, the fold line 29 on the reinforcing column forming portion 24 is positioned outside the fold line 21 disposed between the end panel 13A, 13B and the edge panel 20 (positioned on the bent portion 181).

Figure 28B:
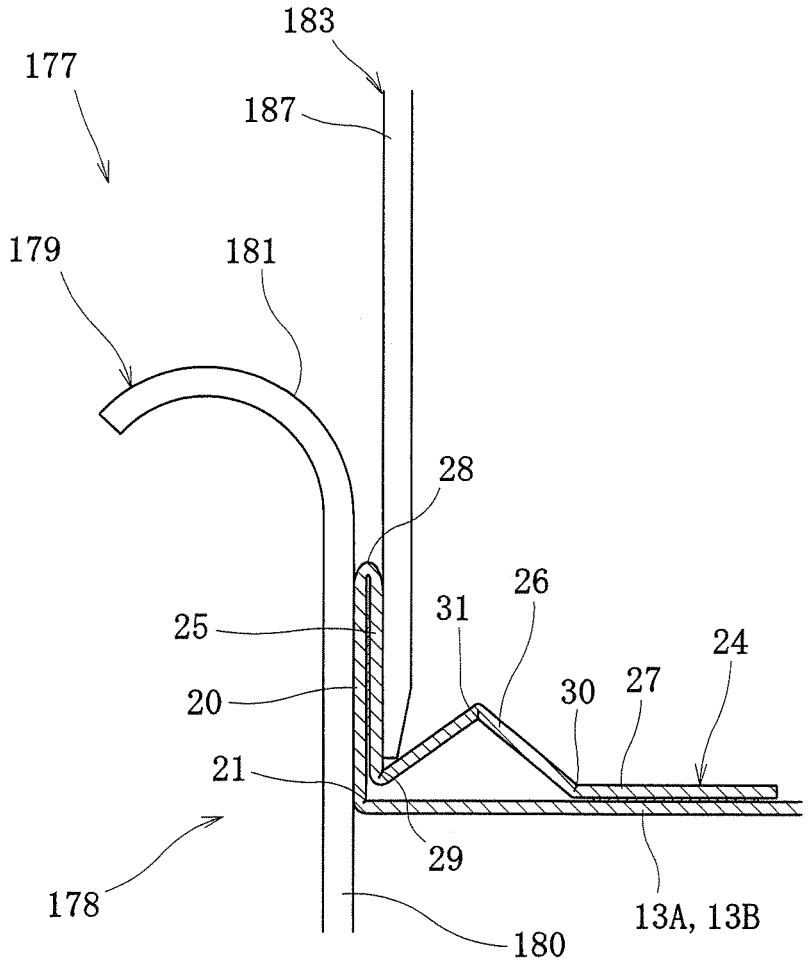
FIG. 28B is an enlarged view showing the first folding portion in a second operation state.

When the lowering of the upper die 183 progresses, as shown in FIG. 28B, the edge panel 20 is folded against the end panel 13A, 13B along with the bending of the bent portion 181. Then, the fold line 29 on the reinforcing column forming portion 24 is positioned with a distance L3 from the fold line 21 and hence, the fold line 29 is moved to an end panel 13A, 13B side about the fold line 21. Due to such movement of the fold line 29, the fold-back panel 25 and the reinforcing panel 26 are folded about the fold line 29. The forming plate 187 guides the folding of the fold-back panel 25 and the reinforcing panel 26 about the fold line 29 while moving to the end panel 13A, 13B side along with the movement of the fold line 29. Accordingly, the folding of the fold-back panel 25 and the reinforcing panel 26 at positions different from the positions where the fold-back panel 25 and the reinforcing panel 26 are to be folded can be prevented and hence, the reinforcing panel 26 can be folded against the fold-back panel 25 along the fold line 29 with certainty. The edge panel 20 and the fold-back panel 25 adhered to each other are brought into a state where the edge panel 20 and the fold-back panel 25 are sandwiched between the guide plate 179 and the forming plate 187. With respect to the reinforcing panel 26 formed between the fold-back panel 25 and the inner panel 27 adhered to the end panel 13A, 13B, the first and second panel portions 26*a*, 26*b* are folded such that the fold line 31 to which a folding habit is imparted by the temporarily folding part 106 forms a top portion and projects upward.

(Configuration of Second Folding Portion 191)

As shown in FIG. 25 and FIG. 26, the second folding portion 191 includes: a fixed female die 192 positioned at an outer peripheral portion of the bottom panel 12; and a movable male die 199 positioned above the bottom panel 12. The second folding portion 191 also includes a bottom receiving portion 202 which receives the bottom panel 12 of the assembled box body 11.

The female die 192 includes: first die portions 193 arranged below the end panels 13A, 13B; and second die portions 196 arranged below the side panels 15A, 15B. These die portions 193, 196 are arranged below the lower die 178 of the first folding portion 177. These die portions 193, 196 fold the edge panels 20 against the end panels 13A, 13B and, thereafter, fold the end panel 13A, 13B and the side panels 15A, 15B against the bottom panel 12 in this order.

A pair of first die portions 193 is arranged between the guide plates 179, 179. An end surface of each first die portion 193 on a bottom panel 12 side is positioned in the vicinity of the fold line 14 disposed on a lower side of the end panel 13A, 13B. A first inclined portion 194 which guides the end panel 13A, 13B such that the end panel 13A, 13B is folded against the bottom panel 12 about the fold line 14 is formed on an upper portion of each first die portion 193 on the bottom panel 12 side. First holding portions 195 for holding a state where the end panels 13A, 13B are folded against the bottom panel 12 are arranged below the first die portions 193.

A pair of second die portions 196 is arranged so as to be positioned on both sides of the side panel 15A, 15B. An end surface of each second die portion 196 on a bottom panel 12 side is positioned in the vicinity of a fold line 16 disposed on a lower side of the side panel 15A, 15B. A second inclined portion 197 which guides the side panel 15A, 15B such that the side panel 15A, 15B is folded against the bottom panel 12 about the fold line 16 is formed on an upper portion of each second die portion 196 on a bottom panel 12 side. The second inclined portion 197 is formed with a gentle inclination angle compared with the first inclined portion 194 so as to allow the side panel 15A, 15B to be folded against the bottom panel 12 after the end panel 13A, 13B is folded against the bottom panel 12. Second holding portions 198 for holding a state where the side panels 15A, 15B are folded against the bottom panel 12 are arranged below the second die portions 196. The second holding portions 198 are positioned outside the edge panels 20 in a state where the end panel 13A, 13B is folded against the bottom panel 12.

The male die 199 includes press-in parts 200 positioned at four corners of the bottom panel 12. The press-in part 200 has a rectangular columnar shape extending in the vertical direction, and is arranged in the vicinity of the fold line 14, 16 on the bottom panel 12. A total length of the press-in part 200 is longer than a total length of the end panel 11A, 11R. The male die 199 can be lifted and lowered by a drive part 201 between a position above the guide rails 173 and a position below the guide rails 173. To be more specific, the male die 199 can be lowered to a height where the male die 199 is positioned in the holding portions 195, 198 of the female die 192 disposed below the guide rails 173.

The bottom receiving portion 202 is positioned below the center of the bottom panel 12. The bottom receiving portion 202 can be lifted and lowered by a cylinder 203 between a lifted position where the bottom receiving portion 202 is brought into contact with the bottom panel 12 which is lowered by the male die 199 and a lowered position where the bottom receiving portion 202 is not brought into contact with the bottom panel 12. The bottom receiving portion 202 includes suction members 204 connected to a suction pump not shown in the drawing.

In the second folding portion 191, substantially simultaneously with the starting of the lowering of the upper die 183 of the first folding portion 177, the bottom receiving portion 202 is moved to the lifted position. Next, in a state where the upper die 183 of the first folding portion 177 is lowered, the lowering of the male die 199 is started. The lowering of the male die 199 is once stopped at a height where the male die 199 is brought into contact with the bottom panel 12 of the box blank. In such a state, the lifting of the upper die 183 of the first folding portion 177 is started. With such an operation, it is possible to prevent the box blank from being lifted together with the upper die 183 of the first folding portion 177.

When the upper die 183 is lifted, the lowering of the male die 199 of the second folding portion 191 is restarted. Then, the bottom panel 12 of the box blank is pressed by the male die 199 from above so that the bottom panel 12 is moved downward toward the inside of the female die 192. Accordingly, the end panels 13A, 13B are folded against the bottom panel 12 by the first inclined portions 194 of the first die portions 193. Thereafter, the side panels 15A, 15B are folded against the bottom panel 12 by the second inclined portions 197 of the second die portions 196. As a result, the side panels 15A, 15B are made to overlap with outer surface sides of the edge panels 20 connected to the end panels 13A, 13B.

Next, the male die 199 is further lowered so that the box body 11 where the end panels 13A, 13B and the side panels 15A, 15B are raised with respect to the bottom panel 12 is moved to the inside of the holding portions 195, 198. Accordingly, both sides of the side panel 15A, 15B and the edge panels 20 to which an adhesive agent is applied by coating are sandwiched between the second holding portion 198 and the press-in part 200, so that the side panel 15A, 15B and the edge panels 20 are pressure bonded to each other. The bottom panel 12 is brought into contact with the bottom receiving portion 202, and is sucked by the suction members 204. The male die 199 is restored to the origin by being lifted in such a state that it is possible to prevent the box body 11 from being lifted together with the male die 199.

(Configuration of Guide Part 205)

As shown in FIG. 20 and FIG. 25, the guide part 205 includes a pair of holding members 206, 206 arranged between the pair of second die portions 196, 196. Each holding member 206 is rotatable by a cylinder 207 within a range from a holding position indicated by a solid line in FIG. 25 where the holding member 206 extends in a horizontal direction to a retracted position indicated by a chain line in FIG. 25 where the holding member 206 extends in the downward direction. The holding members 206 at the holding position are positioned at the same height as the transport surfaces of the guide rails 173. The holding members 206 at the retracted position are positioned outside the second holding portions 198 so that the holding members 206 do not impede the pressing in of the box blank by the male die 199.

As shown in FIG. 26, the first die portions 193 of the second folding portion 191 also function as the guide part 205. Each first die portion 193 can be lifted and lowered by a cylinder not shown in the drawing between a lowered position indicated by a solid line in FIG. 26 and a lifted position indicated by a chain line in FIG. 26. The first die portions 193 at the lowered position fold the end panels 13A, 13B against the bottom panel 12 as described above. The first die portions 193 at the lifted position are positioned at the same height as the transport surfaces of the guide rails 173.

In the guide part 205, simultaneously with the starting of the transportation of the box blank by the direction changing part 109, the holding members 206 are rotated to the holding position and, at the same time, the first die portions 193 are lifted to the lifted position. Due to such operations, regions of the holding members 206 and regions of the first die portions 193 which are positioned coplanar with the guide rails 173 are ensured so that the guide rails 173 guides the box blank such that the box blank is transported to a fixed position of the forming part 111. Then, when the box blank is transported to the fixed position, the holding members 206 are rotated to the retracted position and, at the same time, the first die portions 193 are lowered to the lowered position. Thereafter, operations of the first and second folding portions 177, 191 are started.

In the box manufacturing apparatus 101 having such a configuration, the box blank arranged in the board feeding part 104 is transported one by one, and folding habits extending along the fold lines 31 on the reinforcing panels 26 are imparted by the temporarily folding part 106. Next, an adhesive agent is applied by coating to predetermined positions of the box blank by the first coating part 107 and, thereafter, the reinforcing column forming portions 24 are made to overlap with and fixed to the end panels 13A, 13B and the edge panels 20 by the fixing part 108. Then, the transport direction of the box blank is changed by the direction changing part 109, and an adhesive agent is applied by coating to predetermined positions of the box blank by the second coating part 110. Thereafter, the edge panels 20 are folded against the end panels 13A, 13B by the forming part 111 and, then, the end panels 13A, 13B are folded against the bottom panel 12 and, thereafter, the side panels 15A, 15B are folded against the bottom panel 12, and the side panels 15A, 15B and the edge panels 20 are made to overlap with each other and are fixed to each other. Due to such operations, the box body 11 having the reinforcing columns 24A projecting inward can be automatically manufactured.

The configuration of the box manufacturing apparatus 101 according to the present disclosure is not limited to the configurations described in the above-mentioned embodiments, and various modifications are conceivable.

For example, in the embodiment, the temporarily folding part 106 is arranged as a preceding stage of the fixing part 108. However, when the blank can be folded easily by taking into account a panel thickness of the corrugated board sheet 1, a pitch of the intermediate core 4, and sheet workability such as foldability of a blank along the fold line 31, the box manufacturing apparatus 101 may be configured not to include the temporarily folding part 106. In the embodiment, the fixing part 108 includes the positioning member 155. However, when the blank can be folded easily by taking into account sheet workability, in the same manner as the above, the box manufacturing apparatus 101 may be configured not to include the positioning member 155. In the embodiment, in the forming part 111, the upper die 183 includes the slidable forming plates 187. However, when the blank can be folded easily by taking into account sheet workability, the box manufacturing apparatus 101 may be configured to include the upper die 181 which can push only the end panels 13A, 13B in place of the forming plates 187.

DESCRIPTION OF SYMBOLS

10: packing box, 11: box body, 12: bottom panel, 13A, 13B: end panel, 15A, 15B side panel, 20: edge panel, 21: fold line (outer panel fold line), 24: reinforcing column forming portion, 25: fold-back panel, 26: reinforcing panel, 27: inner panel, 28: fold line, 29: fold line (first fold line), 30: fold line (second fold line), 31: fold line (third fold line), 33: lid body, 43: first fixing part, 44: second fixing part, 45: third fixing part, 100: set-up caser, 101: box manufacturing apparatus, 102: storing device, 103: sealing device, 104: board feeding part, 105: replenishing part, 106: temporarily folding part, 107: first coating part, 108: fixing part, 109: direction changing part, 110: second coating part, 111: forming part, 149: plate, 151: folding member, 154: coating device, 155: positioning member, 161: folding member, 166: pressing member, 176: coating device, 178: lower die, 183: upper die, 187: forming plate, 190: biasing member, 192: female die, 193: first die portion, 196: second die portion, 199: male die, 202: bottom receiving portion

The invention claimed is:

1. A packing box comprising:

a bottom panel;

end panels raised from first edges of the bottom panel;

side panels raised from second edges of the bottom panel extending in a direction which intersects with the first edges, the side panels arranged adjacently to the end panels;

edge panels connected to side edges of the end panels via outer panel fold lines, and fixed to inner side surfaces of the side panels arranged adjacently to the edge panels;

fold-back panels arranged on inner side surfaces of the edge panels;

inner panels arranged on inner side surfaces of the end panels; and reinforcing panels continuously formed with the fold-back panels via first fold lines, and continuously formed with the inner panels via second fold lines, each reinforcing panel being formed in an inwardly projecting manner between the fold-back panel and the inner panel, wherein any of the first fold line and the second fold line positioned on a side closer to the outer panel fold line than a projecting top portion is arranged away from the outer panel fold line by a distance.

2. The packing box according to claim 1, wherein the inner panel is fixed to the end panel, wherein the first fold line positioned on the side closer to the outer panel fold line than the projecting top portion is arranged away from the outer panel fold line by a distance, and wherein the reinforcing panel is projected inward from the end panel side.

3. The packing box according to claim 1, wherein a third fold line is provided between the first and second fold lines of the reinforcing panel, the third fold line extending parallel to the first and second fold lines.

4. The packing box according to claim 3, wherein the packing box is made of a paper-made corrugated board sheet, and wherein a stage collapsed portion where a panel thickness of the paper-made corrugated board sheet is reduced by compression is formed on the reinforcing panel with a predetermined width so as to include the third fold line.

5. The packing box according to claim 1, wherein the fold-back panel is fixed to the inner side surface of the edge panel.

6. The packing box according to claim 1, wherein the fold-back panel, the reinforcing panel and the inner panel are integrally formed with the edge panel.

7. A box manufacturing apparatus for automatically manufacturing the packing box according to claim 2, the box manufacturing apparatus comprising:

a first coating part which applies by coating an adhesive agent to the inner panel or a portion of the end panel to which the inner panel overlaps;

a fixing part which folds the fold-back panel against the edge panel, and fixes the inner panel continuously formed with the fold-back panel to the end panel;

a second coating part which applies by coating an adhesive agent to the edge panel or a portion of the side panel to which the edge panel overlaps; and a forming part which folds the edge panel against the end panel, bends the first and second fold lines on both sides of the reinforcing panel thus making the reinforcing panel project inwardly, and folds the end panel against the bottom panel and, thereafter, folds the side panel against the bottom panel, and fixes the edge panel and the side panel to each other.

8. The box manufacturing apparatus according to claim 7, wherein the forming part includes a forming plate which is arranged in the vicinity of the first fold line, and guides the reinforcing panel such that the reinforcing panel is folded against the fold-back panel along the first fold line in folding the edge panel against the end panel.

9. The box manufacturing apparatus according to claim 8, wherein the forming part includes:

an upper die which is configured to make the forming plate slideable to a reinforcing panel side from a fold-back panel side; and a lower die which is arranged in front of the upper die in an advancing direction of the upper die, and guides folding of the edge panel against the end panel.

10. The box manufacturing apparatus according to claim 9 further comprising a biasing member which biases the forming plate to the fold-back panel side from the reinforcing panel side.

11. The box manufacturing apparatus according to claim 9 or claim 10, wherein the forming part includes:

a male die which is configured to move a blank for forming the packing box downward by pressing the bottom panel from above; and a female die which is arranged below the lower die, and is configured to fold the end panel and the side panel against the bottom panel due to the movement of the blank by the male die.

12. The box manufacturing apparatus according to claim 7, wherein the fixing part includes:

a folding member which folds the fold-back panel against the edge panel; and a pressing member which presses at least the inner panel to the end panel.

13. The box manufacturing apparatus according to claim 12, wherein the fixing part further includes a positioning member for positioning an area in the vicinity of a fold line between the edge panel and the fold-back panel.

14. The box manufacturing apparatus according to claim 12, wherein the folding member is configured to fold the fold-back panel against the edge panel through a first folding step where the folding member is moved upward from below the fold-back panel thus folding the fold-back panel upward against the edge panel, a second folding step where the folding member is moved inward toward an end panel side thus folding the fold-back panel inward against the edge panel, and a third folding step where the folding member is moved downward thus making the fold-back panel overlap with the edge panel.

15. The box manufacturing apparatus according to claim 7 further comprising a temporarily folding part which is disposed in front of the first coating part, and is configured to impart a folding habit by folding the reinforcing panel along a third fold line provided between the first and second fold lines.

* * * * *